US008311831B2

(12) United States Patent
Kato et al.

(10) Patent No.: US 8,311,831 B2
(45) Date of Patent: Nov. 13, 2012

(54) VOICE EMPHASIZING DEVICE AND VOICE EMPHASIZING METHOD

(75) Inventors: Yumiko Kato, Osaka (JP); Takahiro Kamai, Kyoto (JP); Masakatsu Hoshimi, Osaka (JP)

(73) Assignee: Panasonic Corporation, Osaka (JP)

( * ) Notice: Subject to any disclaimer, the term of this patent is extended or adjusted under 35 U.S.C. 154(b) by 662 days.

(21) Appl. No.: 12/447,775

(22) PCT Filed: Sep. 29, 2008

(86) PCT No.: PCT/JP2008/002706

§ 371 (c)(1),
(2), (4) Date: Apr. 29, 2009

(87) PCT Pub. No.: WO2009/044525

PCT Pub. Date: Apr. 9, 2009

(65) Prior Publication Data

US 2010/0070283 A1 Mar. 18, 2010

(30) Foreign Application Priority Data

Oct. 1, 2007 (JP) ..... 2007-257931

(51) Int. Cl.
*G10L 13/06* (2006.01)

(52) U.S. Cl. ..... 704/268; 704/261; 704/E13.004; 704/E13.014; 381/62

(58) Field of Classification Search ..... 704/268, 704/261, E13.004, E13.014
See application file for complete search history.

(56) References Cited

U.S. PATENT DOCUMENTS

| | | | | | |
|---|---|---|---|---|---|
| 3,855,418 | A * | 12/1974 | Fuller | ..... | 704/272 |
| 4,142,067 | A * | 2/1979 | Williamson | ..... | 704/258 |
| 5,463,713 | A * | 10/1995 | Hasegawa | ..... | 704/260 |
| 5,524,173 | A * | 6/1996 | Puckette | ..... | 704/268 |
| 5,559,927 | A * | 9/1996 | Clynes | ..... | 704/258 |
| 5,748,838 | A * | 5/1998 | Stevens | ..... | 704/261 |
| 5,758,320 | A * | 5/1998 | Asano | ..... | 704/258 |
| 5,963,907 | A * | 10/1999 | Matsumoto | ..... | 704/270 |
| 6,289,310 | B1 * | 9/2001 | Miller et al. | ..... | 704/268 |
| 6,304,846 | B1 * | 10/2001 | George et al. | ..... | 704/270 |

(Continued)

FOREIGN PATENT DOCUMENTS

JP 2002-162978 6/2002

(Continued)

OTHER PUBLICATIONS

Reid. "Synth Secrets, Part 11: Amplitude Modulation" 2000.*

(Continued)

*Primary Examiner* — Greg Borsetti
(74) *Attorney, Agent, or Firm* — Wenderoth, Lind & Ponack, L.L.P.

(57) ABSTRACT

A voice emphasizing device emphasizes in a speech a "strained rough voice" at a position where a speaker or user of the speech intends to generate emphasis or musical expression. Thereby, the voice emphasizing device can provide the position with emphasis of anger, excitement, tension, or an animated way of speaking, or musical expression of Enka (Japanese ballad), blues, rock, or the like. As a result, rich vocal expression can be achieved. The voice emphasizing device includes: an emphasis utterance section detection unit (12) detecting, from an input speech waveform, an emphasis section that is a time duration having a waveform intended by the speaker or user to be converted; and a voice emphasizing unit (13) increasing fluctuation of an amplitude envelope of the waveform in the detected emphasis section.

11 Claims, 35 Drawing Sheets

U.S. PATENT DOCUMENTS

| | | | | |
|---|---|---|---|---|
| 6,336,092 | B1 * | 1/2002 | Gibson et al. | 704/268 |
| 6,349,277 | B1 * | 2/2002 | Kamai et al. | 704/207 |
| 6,421,642 | B1 * | 7/2002 | Saruhashi | 704/268 |
| 6,477,495 | B1 * | 11/2002 | Nukaga et al. | 704/268 |
| 6,556,967 | B1 * | 4/2003 | Nelson et al. | 704/233 |
| 6,629,076 | B1 * | 9/2003 | Haken | 704/271 |
| 6,647,123 | B2 * | 11/2003 | Kandel et al. | 381/318 |
| 6,865,533 | B2 * | 3/2005 | Addison et al. | 704/260 |
| 7,117,154 | B2 * | 10/2006 | Yoshioka et al. | 704/258 |
| 7,139,699 | B2 * | 11/2006 | Silverman et al. | 704/206 |
| 7,191,134 | B2 * | 3/2007 | Nunally | 704/270 |
| 7,444,280 | B2 * | 10/2008 | Vandali et al. | 704/200.1 |
| 7,562,018 | B2 * | 7/2009 | Kamai et al. | 704/268 |
| 2001/0044721 | A1 * | 11/2001 | Yoshioka et al. | 704/258 |
| 2002/0126861 | A1 * | 9/2002 | Colby | 381/106 |
| 2003/0046079 | A1 * | 3/2003 | Yoshioka et al. | 704/268 |
| 2003/0055635 | A1 * | 3/2003 | Bizjak | 704/225 |
| 2003/0061047 | A1 * | 3/2003 | Yoshioka et al. | 704/258 |
| 2003/0093280 | A1 * | 5/2003 | Oudeyer | 704/266 |
| 2003/0163320 | A1 | 8/2003 | Yamazaki et al. | |
| 2005/0125227 | A1 * | 6/2005 | Kamai et al. | 704/258 |
| 2005/0197832 | A1 * | 9/2005 | Vandali et al. | 704/206 |
| 2006/0069567 | A1 * | 3/2006 | Tischer et al. | 704/260 |
| 2006/0080087 | A1 * | 4/2006 | Vandali et al. | 704/207 |
| 2006/0111903 | A1 | 5/2006 | Kemmochi et al. | |
| 2006/0165240 | A1 * | 7/2006 | Bloom et al. | 381/56 |
| 2007/0118359 | A1 * | 5/2007 | Vandali et al. | 704/205 |
| 2009/0089051 | A1 * | 4/2009 | Ishii et al. | 704/225 |

FOREIGN PATENT DOCUMENTS

| | | |
|---|---|---|
| JP | 2002-215198 | 7/2002 |
| JP | 2002-268699 | 9/2002 |
| JP | 2004-177984 | 6/2004 |
| JP | 2004-279436 | 10/2004 |
| JP | 03703394 | 7/2005 |
| JP | 3760833 | 1/2006 |
| JP | 2006-145867 | 6/2006 |
| JP | 2007-068847 | 3/2007 |
| JP | 2007-093795 | 4/2007 |

OTHER PUBLICATIONS

Hass. "Principles of Audio-Rate Frequency Modulation" 2001.*
Gibbon. "Multiplication: amplitude modulation" 1996.*
Jeon et al. "The Intelligent Artificial Vocal Vibrato Effecter using Pitch Detection and Delay-Line" 2005.*
Gerhard. "Pitch Extraction and Fundamental Frequency: History and Current Techniques" 2003.*
Green et al. "Enhancing temporal cues to voice pitch in continuous interleaved sampling cochlear implants" 2004.*
International Search Report issued Nov. 25, 2008 in the International (PCT) Application of which the present application is the U.S. National Stage.
Carlos Toshinori Ishii et al., "Acoustic Analysis of Pressed Phonation Using EGG", pp. 221-222, Mar. 6, 2007, (with English translation).
Carlos Toshinori Ishii et al., "Acoustic Analysis for Automatic Detection of Pressed Voice", SP2006-27, vol. 106, No. 178, pp. 1-6, Jul. 14, 2006 (with English translation).
Hideki Kawahara et al., "Scat Generation Research Program Based on STRAIGHT, a High-quality Speech Analysis, Modification and Synthesis System", Information Processing Society of Japan, vol. 43, No. 2, pp. 208-218, Feb. 15, 2002.
Minoru Shigenaga et al., "Emotion Represented by Emotively Uttered Words", May 19, 1995, vol. 95, No. 42, SP95-15, pp. 39-46, (with English translation of Table 2).
Yumiko Kato et al., "Prediction of harsh 'rikimi' voiced mora in emotional speech", The Acoustical Society of Japan, 2007, spring, lecture papers CD-ROM, Mar. 6, 2007, pp. 285-286 (with partial English translation).
Kasuya Hideki et al., "Voice quality associated with voice source", The Journal of the Acoustical Society of Japan, vol. 51, No. 11, (Nov. 1, 1995), pp. 869-875, (with partial English translation).
Curtis Roads, "Konpyuta Ongaku—Rekishi,Tekunorogi, Ato", translated and edited by Aoyagi Tatsuya et al., Tokyo Denki University Press, Jan. 2001, pp. 353-355, and its original text, "The Computer Music Tutorial", The MIT Press, p. 437-439.
Gudrun Klasmeyer et al., Voice quality Measurement, Chapter 15 Voice and Emotional States, pp. 339-357, 2000.
Kaliappan Gopalan et al., An Analysis of Speech Under Stress Using Certain Modulation Features. 1999 IEEE, pp. 1193-1197.

* cited by examiner

FIG. 8

Noticeably Unnatural:1 No Unnaturalness:5

| | Fixed Modulation Frequency | Random Modulation Frequency |
|---|---|---|
| Test Subject 1 | 3.0 | 3.0 |
| Test Subject 2 | 2.7 | 3.5 |
| Test Subject 3 | 2.3 | 3.0 |
| Test Subject 4 | 3.3 | 3.5 |
| Test Subject 5 | 5.0 | 4.2 |
| Test Subject 6 | 2.7 | 2.3 |
| Test Subject 7 | 1.7 | 2.3 |
| Test Subject 8 | 2.3 | 3.0 |
| Test Subject 9 | 2.7 | 2.7 |
| Test Subject 10 | 2.3 | 2.7 |
| Test Subject 11 | 1.7 | 2.5 |
| Test Subject 12 | 3.3 | 2.7 |
| Test Subject 13 | 4.3 | 4.3 |
| Test Subject 14 | 2.3 | 2.5 |
| Test Subject 15 | 1.3 | 2.2 |

Schematic Diagram of Amplitude Dynamic Range Extension

VOICE EMPHASIZING DEVICE AND VOICE EMPHASIZING METHOD

TECHNICAL FIELD

The present invention relates to technologies of generating "strained rough" voices having a feature different from that of normal utterances. Examples of the "strained rough" voice include: a hoarse voice, a rough voice, and a harsh voice that are produced when a human sings or speaks forcefully with emphasis; expressions such as "kobushi (tremolo or vibrato)" and "unari (growling or groaning voice)" that are produced in singing Enka (Japanese ballad) and the like, for example; and expressions such as "shout" that are produced in singing blues, rock, and the like. More particularly, the present invention relates to a voice emphasizing device that can generate voices capable of expressing: emotion such as anger, emphasis, strength, and liveliness; vocal expression; an utterance style; or an attitude, situation, tension of a phonatory organ, or the like of a speaker, all of which are included in the above-mentioned voices.

BACKGROUND ART

Conventionally, voice conversion or voice synthesis technologies have been developed aiming for expressing emotion, vocal expression, attitude, situation, and the like using voices, and particularly for expressing the emotion and the like, not using verbal expression of voices, but using para-linguistic expression such as a way of speaking, a speaking style, and a tone of voice. These technologies are indispensable to speech interaction interfaces of electronic devices, such as robots and electronic secretaries. Moreover, technologies used in Karaoke machines or music sound effect devices have been developed to process a waveform of a speech in order to add musical expression such as tremolo or vibrato or emphasize expression of the speech.

In order to provide expression using voice quality as para-linguistic expression or musical expression of an input speech, there has been developed a voice conversion method of analyzing the input speech to calculate synthetic parameters and then changing the calculated parameters to convert quality of a voice in the input speech (refer to Patent Reference 1, for example). However, by the above conventional method, the parameter conversion is performed according to a uniform conversion rule that is predetermined for each emotion. This fails to reproduce various kinds of voice quality such as voice quality having a partially strained rough voice which are produced in natural utterances. Furthermore, in the conventional method, the uniform conversion rule is applied on the entire input speech. Therefore, it is impossible to convert only a part of the input speech where a speaker desires to emphasize, or to convert the input speech to emphasize a strength of emotion or expression originally expressed in the input speech.

In the meanwhile, there has been disclosed a method of converting singing voices of a user to imitate how an original singer of the song sings (refer to Patent Reference 2, for example). In more detail, based on singing data indicating musical expression of a way of singing of the original singer, namely, information of which section of the song has tremolo or vibrato, a "strained rough voice", or a "unari (growling or groaning voice) at how much degree, the above conventional method converts the user's singing voices changing amplitude or fundamental frequency or adding with noise.

Moreover, in order to address a time lag in singing a song between singing data of a user and singing of an original singer of the song, a method has been disclosed to compare the user's singing data and data of the song (namely, the original singer's singing) (refer to Patent Reference 3, for example). The combination of these conventional technologies makes it possible to convert input singing voices (user's singing data) to imitate a way of singing of the original singer, as far as singing timings of the user's singing data match singing timings of the original singer's singing closely, even if not precisely.

As one of various kinds of voice quality partially produced in a speech, a voice called "creaky" or "vocal fry" is studied being referred to as a "pressed voice" that is different from the "strained rough voice" or "unari (growling or groaning voice)" described in this description and produced in an utterance in excitement or as expression in singing voices. Non-Patent Reference 1 discloses that acoustic features of the "creaky voice" are: significant partial change of energy; lower and less-stable fundamental frequency than fundamental frequency of normal utterance; and smaller power than that of a section of normal utterance. Non-Patent Reference 1 also discloses that these features sometimes occur when a larynx is pressed thereby disturbing periodicity of vocal cord vibration. It is further disclosed that a "pressed voice" often occurs in a duration longer than an average syllable-basis duration. The "creaky voice" is considered to have an effect of enhancing impression of sincerity of a speaker in emotion expression such as interest or hatred, or attitude expression such as hesitation or humble attitude. The "pressed voice" described in Non-Patent Reference 1 often occurs in: a process of gradually ceasing a speech generally in an end of a sentence, a phrase, or the like; ending of a word uttered to be extended in speaking while selecting words or in speaking while thinking; and exclamation or interjection such as "well . . . " and "um . . . " uttered in having no ready answer. Non-Patent Reference 1 still further discloses that each of the "creaky voice" and the "vocal fry" includes a diplophonia that causes a new period of a double beat or a double of a fundamental period. For a method of generating such diplophonia occurred in "vocal fry", there is disclosed a method of superposing voices with a phase being shifted from another by a half period of a fundamental frequency.

Patent Reference 1: Japanese Patent No. 3703394

Patent Reference 2: Japanese Unexamined Patent Application Publication No. 2004-177984

Patent Reference 3: Japanese Patent No. 3760833

Non-Patent Reference 1: "Acoustic analysis for automatic detection of pressed voice", Carlos Toshinori ISHII, Hiroshi ISHIGURO, and Norihiro HAGITA, Technical Report of the Institute of Electronics, Information and Communication Engineers, SP2006, vol. 7, pp. 1-6, 2006

DISCLOSURE OF INVENTION

Problems that Invention is to Solve

Unfortunately, the above-described conventional methods, either individually or in combination, fail to generate a "strained rough" voice occurred in a portion of a speech, such as: a hoarse voice, a rough voice, or a harsh voice produced when speaking forcefully in excitement, nervousness, anger, or with emphasis; or a "strained rough" voice, such as "kobushi (tremolo or vibrato)", "unari (growling or groaning voice)", or "shout" in singing. The above "strained rough" voice occurs when the utterance is produced forcefully and a phonatory organ is thereby strained more than usual utterances or tensioned strongly. In fact, such a "strained rough voice" uttered forcefully has a rather large amplitude. In addition, the "strained rough" voice occurs not only in exclamation and interjection, but also in various portions of speech regardless of whether the portion is a content word or a function word. From the above explanation, it is clear that this "strained rough voice" is a voice phenomenon different from the "pressed voice" achieved by the above-described conventional methods. Therefore, the conventional methods fail to generate the "strained rough" voice addressed in this description. This means that the above-described conventional methods have problems of difficulty in richly expressing vocal expression such as anger, excitement, or an animated or lively way of speaking, using voice quality conversion by generating the "strained rough" voice capable of expressing how a phonatory organ is strained and tensioned. Furthermore, in the conventional method of converting singing voices, singing timings of the user's singing data need to match singing timings of an original singer. This fails to provide musical expression to the user's singing data if the user sings the song at timings significantly different from timings of the original singer's singing. Moreover, if the user desires to sing the song with "strained rough voices" or "unari (growling or groaning voices)" at desired timings different from timings of the original singer, or if there is no singing data of the original singer, it is impossible to satisfy the desire or intension of the user to sing with the "strained rough voices".

That is, the above-described conventional methods have problems of: difficulty in providing a speech with various kinds of voice quality partially at desired timings; and impossibility of providing a speech with vocal expression having reality or rich musical expression.

Thus, the present invention overcomes the problems of the conventional technologies as described above. It is an object of the present invention to provide a voice emphasizing device that generates the above-described "strained rough" voice at a position where a speaker or user intends to provide emphasis or musical expression, so that rich vocal expression can be achieved by providing a speech of the speaker or user with (i) emphasis such as anger, excitement, nervousness, or a lively way of speaking or (ii) musical expression used in Enka (Japanese ballad), blues, rock, or the like.

It is another object of the present invention to provide a voice emphasizing device that guesses intention of a speaker or user to provide emphasis or musical expression in a speech according to features of voices in the speech, and thereby generates the above-described "strained rough" voice in a voice section which is guessed to have the intension, so that rich vocal expression can be achieved by providing the speech with (i) emphasis such as anger, excitement, nervousness, or a lively way of speaking or (ii) musical expression used in Enka (Japanese ballad), blues, rock, or the like.

Means to Solve the Problems

In accordance with an aspect of the present invention for achieving the above objects, there is provided a voice emphasizing device including: an emphasis utterance section detection unit configured to detect an emphasis section from an input speech waveform, the emphasis section being a time duration having a waveform intended by a speaker of the input speech waveform to be converted; and a voice emphasizing unit configured to increase fluctuation of an amplitude envelope of the waveform in the emphasis section detected by the emphasis utterance section detection unit from the input speech waveform, wherein the emphasis utterance section detection unit is configured to (i) detect a state from the input speech waveform as a state where a vocal cord of the speaker is strained, and (ii) determine a time duration of the detected state as the emphasis section, the state having a frequency of the fluctuation of the amplitude envelope of the waveform within a predetermined range from 10 Hz to lower than 170 Hz.

With the above structure, the voice emphasizing device can detect, from the input speech waveform, a voice section where a speaker or user utters a "strained rough voice" intending to produce emphasis or musical expression, then converts a voice of the detected section to a "strained rough voice" satisfying the intention, and outputs the converted voice. Therefore, according to the intention of the speaker or user uttering the "strained rough voice" for emphasis or musical expression, the voice emphasizing device can provide the voice with expression of emphasis or tension or musical expression. As a result, the voice emphasizing device can produce rich vocal expression.

It is preferable that the voice emphasizing unit is configured to modulate the waveform to periodically fluctuate the amplitude envelope.

With the above structure, the voice emphasizing device can generate a speech with rich vocal expression, without holding a great amount of voice waveforms of various features enough to support any desired voices by which a target voice waveform can be replaced. In addition, merely the modulation including amplitude fluctuation on an input voice can provide vocal expression to the voice. Therefore, while keeping an original feature of the voice, such simple processing can convert a waveform of the voice to have expression of emphasis or tension or musical expression.

It is further preferable that the voice emphasizing unit is configured to modulate the waveform to periodically fluctuate the amplitude envelope, using signals having a frequency in a range of 40 Hz to 120 Hz.

With the above structure, at the voice section detected by the emphasis utterance section detection unit as a portion where the speaker or user utters a "strained rough voice" intending to produce emphasis or musical expression, the voice emphasizing device can fluctuate an amplitude with a frequency ranging enough to be perceived as a "strained rough voice". Thereby, the voice emphasizing device can generate a voice waveform capable to convey expression of emphasis or tension or musical expression more clearly to listeners.

It is still further preferable that the voice emphasizing unit is configured to fluctuate the frequency of the signals to range from 40 Hz to 120 Hz.

With the above structure, at the voice section detected by the emphasis utterance section detection unit as a portion where the speaker or user utters a "strained rough voice" intending to produce emphasis or musical expression, the voice emphasizing device can fluctuate an amplitude with a frequency ranging enough to be perceived as a "strained rough voice". Here, in the amplitude fluctuation, the frequency is not fixed but varied in a range where the amplitude fluctuation can be perceived as a "strained rough voice". Thereby, the voice emphasizing device can generate a more natural "strained rough voice".

It is still further preferable that the voice emphasizing unit is configured to modulate the waveform to periodically fluctuate the amplitude envelope, by multiplying the waveform by periodic signals.

With the above structure, the voice emphasizing device uses simpler processing to perform the amplitude fluctuation perceived as a "strained rough voice" on the input voice. Thereby, the voice emphasizing device can provide the input voice with more clear expression of emphasis or tension or musical expression. As a result, the voice emphasizing device can produce rich vocal expression.

It is still further preferable that the voice emphasizing unit includes: an all-pass filter configured to shift a phase of the waveform; and an addition unit configured to add (i) the waveform provided to the all-pass filter with (ii) a waveform with the phase shifted by the all-pass filter.

With the above structure, the voice emphasizing device can fluctuate the amplitude differently depending on frequency components. Thereby, it is possible to fluctuate the amplitude complicatedly more than using simple modulation to perform the same amplitude fluctuation for all frequency components. As a result, the voice emphasizing device can generate a voice which has expression of emphasis or tension or musical expression and is perceived as a more natural voice.

It is still further preferable that the voice emphasizing unit is configured to extend a dynamic range of an amplitude of the waveform.

With the above structure, at the voice section detected by the emphasis utterance section detection unit as a portion where the speaker or user utters a "strained rough voice" intending to produce emphasis or musical expression, the voice emphasizing device extends a dynamic range of amplitude. Thereby, the voice emphasizing device can emphasize features of the original amplitude fluctuation to be enough to be perceived as emphasis or musical expression, and output the result. Therefore, according to the intention of the speaker or user uttering a "strained rough voice" for emphasis or musical expression, the voice emphasizing device can use original features of the input voice to produce expression of emphasis or tension or musical expression, thereby achieving richer vocal expression more naturally.

It is still further preferable that the voice emphasizing unit is configured to (i) compress the amplitude of the waveform when a value of the amplitude envelope of the waveform is equal to or smaller than a predetermined value, and (ii) amplifies the amplitude of the waveform when the value is greater than the predetermined value.

With the above structure, the voice emphasizing device uses simpler processing to extend a dynamic range of amplitude of the input voice. Therefore, according to the intention of the speaker or user uttering a "strained rough voice" for emphasis or musical expression, the voice emphasizing device can use the simpler processing to use original features of the input voice to produce expression of emphasis or tension or musical expression, thereby achieving richer vocal expression, more naturally.

It is still further preferable that the emphasis utterance section detection unit is configured to detect, as the emphasis section, a time duration in which the frequency of the fluctuation is within a predetermined range from 10 Hz to lower than 170 Hz and an amplitude modulation ratio indicating a ratio of the fluctuation is smaller than 0.04.

With the above structure, regarding the voice section where the speaker or user utters a "strained rough voice" intending to produce emphasis or musical expression, the emphasis utterance section detection unit in the voice emphasizing device detects, as emphasis sections, portions except portions perceived as "strained rough voice" without being emphasized. Then, regarding the voice section where the speaker or user utters a "strained rough voice" intending to produce emphasis or musical expression, the emphasis utterance section detection unit in the voice emphasizing device does not emphasize a portion having enough vocal expression of the speaker or user in the original voice, and emphasizes only a portion inadequate to convey intended vocal expression by the voice. In other words, while keeping original vocal expression of the input voice, the emphasis utterance section detection unit in the voice emphasizing device emphasizes a "strained rough voice" only at a portion where the speaker or user utters the "strained rough voice" but fails to produce intended expression. Thereby, while keeping more natural original vocal expression of the input voice, the voice emphasizing device can provide the input voice with expression of emphasis or tension or musical expression, thereby achieving rich vocal expression.

It is still further preferable that the emphasis utterance section detection unit is configured to detect the emphasis section based on a time duration where a glottis of the speaker is closed.

With the above structure, the voice emphasizing device can detect more accurately a state where a larynx of a speaker or singer is strained in order to determine an emphasis section, so that intension of the speaker or singer is more correctly influenced.

It is still further preferable that the voice emphasizing device further includes a pressure sensor configured to detect a pressure produced by a movement of the speaker in synchronization with a timing of the utterance of the waveform, wherein the emphasis utterance section detection unit is configured to determine whether or not an output value of the pressure sensor exceeds a predetermined value and detects as the emphasis section a time duration having the output value of the pressure sensor exceeding the predetermined value.

With the above structure, the voice emphasizing device can easily and directly detect a state where a speaker or singer utters forcefully.

It is preferable that the pressure sensor is provided to a holding part of a microphone receiving the input speech waveform.

With the above structure, the voice emphasizing device can easily and directly detect a state where the speaker or singer utters or sings forcefully, according to a natural movement in uttering or singing.

It is preferable that the pressure sensor is provided to an axilla (underarm) or an arm of the speaker using a supporting part.

With the above structure, the voice emphasizing device can easily and directly detect a state where the speaker or singer utters or sings forcefully, according to a natural movement in uttering or singing especially when the speaker or singer holds a handheld microphone by a hand.

It is preferable that the voice emphasizing device further includes a movement sensor configured to detect a movement of the speaker in synchronization with time of uttering the input speech waveform, wherein the emphasis utterance section detection unit is configured to detect as the emphasis section a time duration having an output value of the movement sensor greater than a predetermined value.

With the above structure, the voice emphasizing device can detect gesture in uttering or singing, thereby easily detecting a state where the speaker or singer utters or sings forcefully, according to a size of the detected movement.

It is preferable that the voice emphasizing device further includes an acceleration sensor configured to detect an acceleration of a movement of the speaker in synchronization with time of uttering the input speech waveform, wherein the emphasis utterance section detection unit is configured to detect as the emphasis section a time duration having an output value of the acceleration sensor greater than a predetermined value.

With the above structure, the voice emphasizing device can detect gesture in uttering or singing, thereby easily detecting a state where the speaker or singer utters or sings forcefully, according to a size of the detected gesture.

It should be noted that the present invention can be implemented not only as the voice emphasizing device including the above characteristic units, but also as: a voice emphasizing method including steps performed by the characteristic units of the voice emphasizing device: a program causing a computer to execute the characteristic steps of the voice emphasizing method; and the like. Of course, the program can be distributed by a recording medium such as a Compact Disc-Read Only Memory (CD-ROM) or by a transmission medium such as the Internet.

EFFECTS OF THE INVENTION

The voice emphasizing device according to the present invention can generate a "strained rough" voice at a position where a speaker or user intends to provide vocal emphasis or musical expression. The "strained rough voice" has a feature different from that of normal utterances. Examples of the "strained rough" voice includes: a hoarse voice, a rough voice, and a harsh voice that are produced when, for example, a human yells, speaks excitedly or nervously, or speaks forcefully with emphasis; expressions such as "kobushi (tremolo or vibrato)" and "unari (growling or groaning voice)" that are produced in singing Enka (Japanese ballad) and the like; and expressions such as "shout" that are produced in singing blues, rock, and the like. Thereby, the voice emphasizing device according to the present invention can convert an input speech to a speech having rich vocal expression conveying how a speaker or singer utters the speech forcefully or with emotion.

BRIEF DESCRIPTION OF DRAWINGS

FIG. 8 is a table showing degrees of unnaturalness when a modulation frequency is fixed and when a modulation frequency is varied at random.

NUMERICAL REFERENCES

Figure 1:
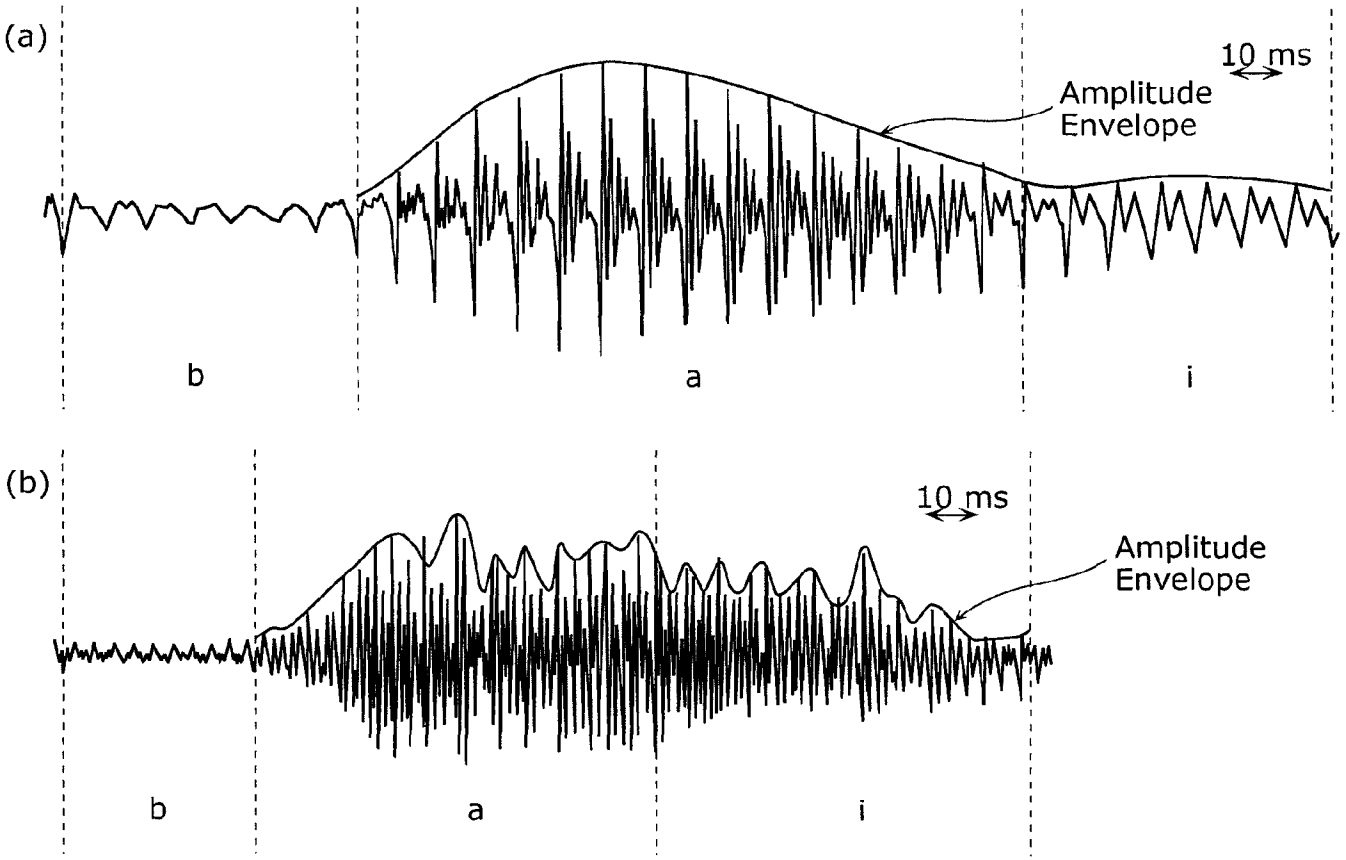
FIG. 1 is diagrams showing an example of a waveform and an amplitude envelope of each of a normal voice and a strained rough voice, which is observed in a recorded speech.

11 speech input unit
12, 44, 52 emphasized-utterance section detection unit
13 voice emphasizing unit
14 speech output unit
15 strained-rough-voice determination unit
16, 47, 57 strained-rough-voice emphasis determination unit
17 periodic signal generation unit
18 amplitude modulation unit
19 periodicity analysis unit
20 second harmonic extraction unit
21 amplitude envelope analysis unit
22 fluctuation frequency analysis unit
23 fluctuation frequency determination unit
24 amplitude modulation ratio calculation unit
25 modulation ratio determination unit
26 all-pass filter
27 switch
28 adder
31 amplitude dynamic range extension unit
41 handheld microphone
42, 76 microphone
43 pressure sensor
45, 55 standard value calculation unit
46, 56 standard value storage unit
51 EGG sensor
61 average input amplitude calculation unit
62 amplitude amplification compression unit
71 terminal
71*a* portable personal computer
71*b* mobile telephone
71*c* network game device
72 network
73 speech processing server
74, 80 speech data receiving unit
75, 79 speech data transmitting unit
77 A/D converter
78 input speech data storage unit
81 emphasized-voice data storage unit
82 D/A converter
83 electroacoustic converter
84 speech output instruction input unit
85 output speech extraction unit
86, 92, 96, 102 speech waveform
90, 104 amplitude envelope
88 boundary input level
94, 98 envelope

BEST MODE FOR CARRYING OUT THE INVENTION

First, description is given for features of strained rough voices in speeches based on which the present invention is implemented.

It is known that, in a speech with emotion or vocal expression, voices having various kinds of voice quality exist and characterize emotion and vocal expression of the speech thereby creating impression of the speech (refer to Non-Patent Reference of "Ongen kara mita seishitsu (Voice Quality Associated with Voice Sources)", Hideki Kasuya and Yang Chang-Sheng, Journal of The Acoustical Society of Japan, Vol. 51, No. 11, 1995, pp 869-875, and Patent Reference of Japanese Unexamined Patent Application Publication No. 2004-279436, for example). In speeches with emotion of "rage" and "anger", a "strained rough" voice expressed as a hoarse voice, rough voice, or harsh voice is often produced. A research of waveforms of such "strained rough" voices shows that an amplitude is periodically fluctuated (hereinafter, referred to also as "amplitude fluctuation") in most of the waveforms. FIG. 1 (*a*) shows a speech waveform of a normal voice "bai" in a speech "Tokubai shiemasuyo ( . . . is on sale as a special price)" that is uttered "calmly" without any emotion, and a schematic shape of an amplitude envelope of the waveform. FIG. 1 (*b*) shows a speech waveform of a corresponding portion "bai" in a speech "Tokubai shiemasuyo ( . . . is on sale as a special price)" that is uttered with emotion of "rage", and a schematic shape of an amplitude envelope of the waveform. For each of the waveforms, a boundary between phonemes is shown by a broken line. In portions uttering "a" and "i" in the waveform of FIG. 1 (*a*), it is observed that an amplitude is changed smoothly. In normal utterances, as shown in the waveform of FIG. 1 (*a*), an amplitude is smoothly increased from the beginning of a vowel, then has its peak at an around center of the phoneme, and is decreased gradually towards a phoneme boundary. If a vowel ends, an amplitude is smoothly decreased towards an amplitude of silence or a consonant following to the vowel. If a vowel follows a vowel as shown in FIG. 1 (*a*), an amplitude is gradually decreased or increased towards amplitude of the following vowel. In normal utterances, repetition of increase and decrease of an amplitude in a signal vowel as shown in FIG. 1 (*b*) is hardly observed, and no report shows voices having such amplitude fluctuation in which relationship with a fundamental frequency is not certain. Therefore, in this description, assuming that such amplitude fluctuation is a feature of a strained rough voice, a fluctuation period of an amplitude envelope of a voice labeled as a strained rough voice is determined by the following processing.

Firstly, in order to extract a sine wave component representing speech waveforms, band-pass filters each having as a central frequency the second harmonic of a fundamental frequency of a speech waveform to be processed are formed sequentially, and each of the formed filters filters the corresponding speech waveform. Hilbert transformation is performed on the filtered waveform to generate analytic signals, and a Hilbert envelope is determined using an absolute value of the generated analytic signals thereby determining an amplitude envelope of the speech waveform. Hilbert transformation is further performed on the determined amplitude envelope, then an instant angular velocity is calculated for each sample point, and based on a sampling period the calculated angular velocity is converted to a frequency. A histogram is created for each phoneme regarding an instantaneous frequency determined for each sample point, and a mode value is assumed to be a fluctuation frequency of an amplitude envelope of a speech waveform of the corresponding phoneme.

Figure 2:
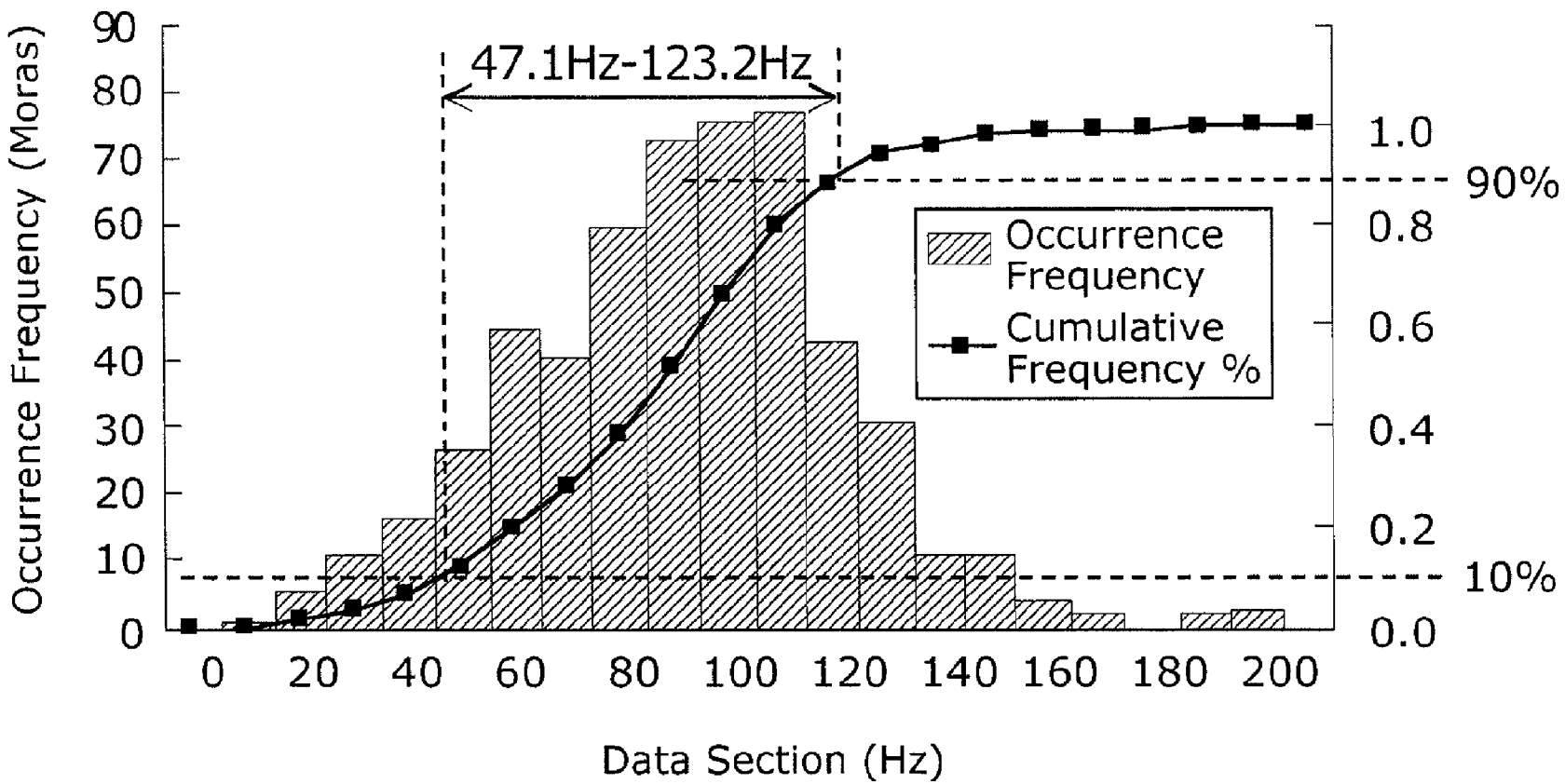
FIG. 2 shows a histogram and a cumulative frequency graph plotting fluctuation frequency distribution of amplitude envelopes of moras uttered as strained rough voices observed in recorded speeches.

FIG. 2 shows a histogram and a cumulative frequency graph regarding distribution of the analyzed fluctuation frequencies of amplitude envelopes of strained rough voices produced in speeches of a male speaker having emotion of "rage". Table 1 shows occurrence frequency and cumulative frequency of the fluctuation frequencies of the amplitude envelopes of the strained rough voices shown in FIG. 2.

TABLE 1

| Data Section | Occurrence Frequency | Cumulative Frequency (%) |
|---|---|---|
| 0 | 0 | 0.00% |
| 10 | 1 | 0.18% |
| 20 | 6 | 1.29% |
| 30 | 11 | 3.33% |
| 40 | 17 | 6.47% |
| 50 | 27 | 11.46% |
| 60 | 45 | 19.78% |
| 70 | 41 | 27.36% |
| 80 | 60 | 38.45% |
| 90 | 73 | 51.94% |
| 100 | 76 | 65.99% |
| 110 | 77 | 80.22% |
| 120 | 43 | 88.17% |
| 130 | 31 | 93.90% |
| 140 | 11 | 95.93% |
| 150 | 11 | 97.97% |
| 160 | 4 | 98.71% |
| 170 | 2 | 99.08% |
| 180 | 0 | 99.08% |
| 190 | 2 | 99.45% |
| 200 | 3 | 99.45% |
| Next Grade | 0 | 100.00% |

Normal voices that are not strained rough voices have no periodic fluctuation in amplitude envelopes. Therefore, a "strained rough" voice is distinguished from a normal voice by distinguishing a state with periodic fluctuation from a state without periodic fluctuation. As seen in the histogram of FIG. 2, occurrence frequency of strained rough voices rises from a point where a frequency of amplitude fluctuation (amplitude fluctuation frequency) is between 10 Hz and 20 Hz, and is rapidly increased in a range where the amplitude fluctuation frequency is between 40 Hz and 50 Hz. It is considered that a reasonable lower limit of the amplitude fluctuation frequency is around 40 Hz. However, when strained rough voices are detected comprehensively from a wider range, the lower limit may be set to 10 Hz. 90% of phonemes labeled as strained rough voices according to the cumulative frequency have amplitude fluctuation at a frequency equal to or higher than 47.1 Hz. Based on the above observation, a lower limit of the amplitude fluctuation frequency may be 47.1 Hz. The higher a frequency of amplitude fluctuation is, the less a human hears the amplitude fluctuation. From the characteristics, it is desirable to set an upper limit of the amplitude fluctuation frequency to detect strained rough voices according to amplitude fluctuation. A human has hearing characteristics in that a human senses "roughness" of sound mostly at a frequency of around 70 Hz and the sense of "roughness" is reduced gradually when a frequency is from 100 Hz to 200 Hz, although the characteristics depend on an original sound modulated.

In the histogram of FIG. 2, occurrence frequency of strained rough voices is rapidly decreased in a range where an amplitude fluctuation frequency is between 110 Hz and 120 Hz, and decreased by half in a range between 130 Hz and 140 Hz. The upper limit of the frequency of amplitude fluctuation characterizing strained rough voices needs to set to around 130 Hz. Moreover, like the lower limit, when strained rough voices are detected comprehensively from a wider range, the upper limit of the amplitude fluctuation frequency may be set to 170 Hz based on the observation that the occurrence frequency temporarily reaches 0 in a range of the amplitude fluctuation frequency between 170 Hz and 180 Hz in FIG. 2. It is effective if the lower limit of an amplitude fluctuation frequency is set to 47.1 Hz and the upper limit is set to 123.2 Hz, so that 80% of phonemes labeled as strained rough voices according to the cumulative frequency are included.

Figure 3A:
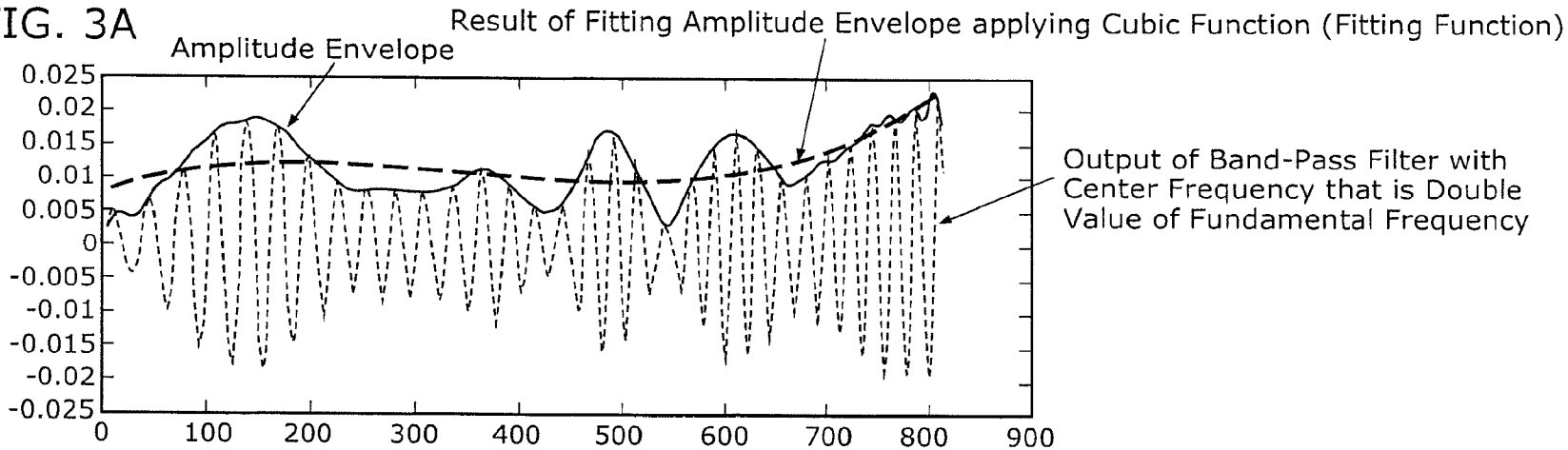
FIG. 3A is a graph showing an example of the second harmonics, amplitude envelopes, and fitting by polynomial expressions of strained rough voices observed in recorded speeches.
Figure 3B:
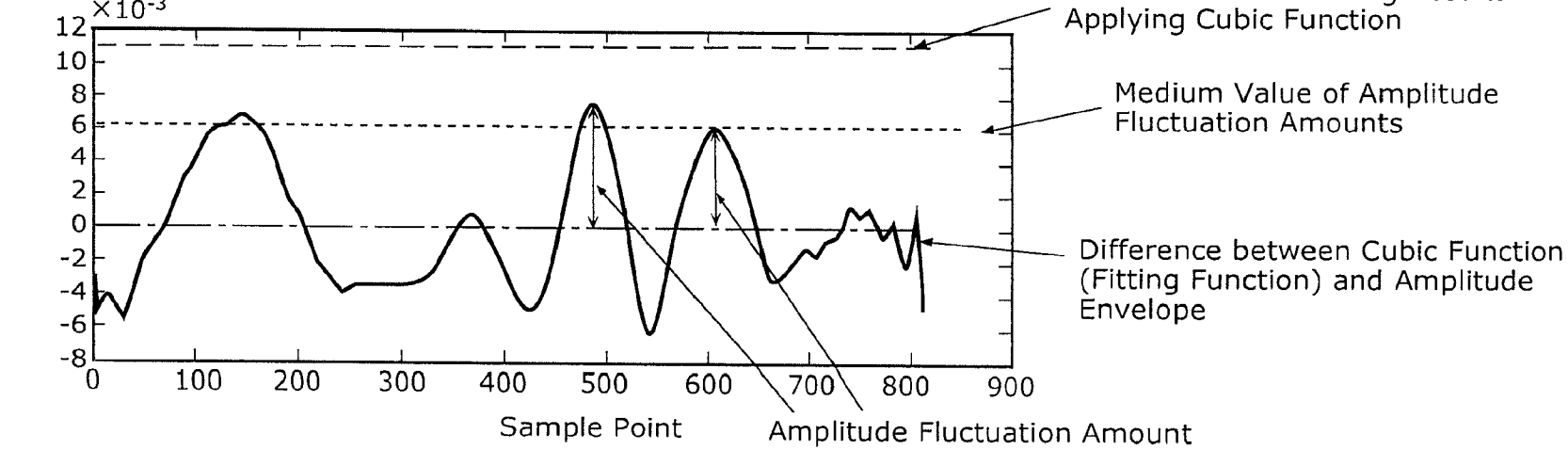
FIG. 3B is a graph for explaining an example of calculating amplitude fluctuation amounts.

Each of FIGS. 3A and 3B is a graph for explaining a modulation ratio of an amplitude envelope of a strained rough voice. While in the commonly-known amplitude modulation a constant amplitude of carrier signals is modulated, a speech waveform that is signals to be modulated has amplitude fluctuation originally. Therefore, in this description, a modulation ratio (amplitude modulation ratio) of amplitude fluctuation is defined as the following. As shown in FIG. 3A, polynomial approximation is applied on an amplitude envelope that is generated as a Hilbert envelope having a waveform passing through a band-pass filter having the second harmonic as a center frequency. Thereby, a fitting function is generated applying a polynomial expression. FIG. 3A shows a result of fitting applying a cubic function. The fitting function is considered as an amplitude envelope having a waveform before the modulation. As shown in FIG. 3B, a difference between a value of application of the fitting function and a value of the amplitude envelope is calculated for each peak of the amplitude envelope, and the difference is considered to be an amount of the amplitude fluctuation (hereinafter, referred to also as an "amplitude fluctuation amount"). Since values of the fitting function are not the same and the amplitude fluctuation amounts are not constant, a medium value of the values of the fitting function and a medium value of the amplitude fluctuation amounts are calculated among phonemes. Then, a ratio between the medium values is set as a modulation ratio.

Figure 4:
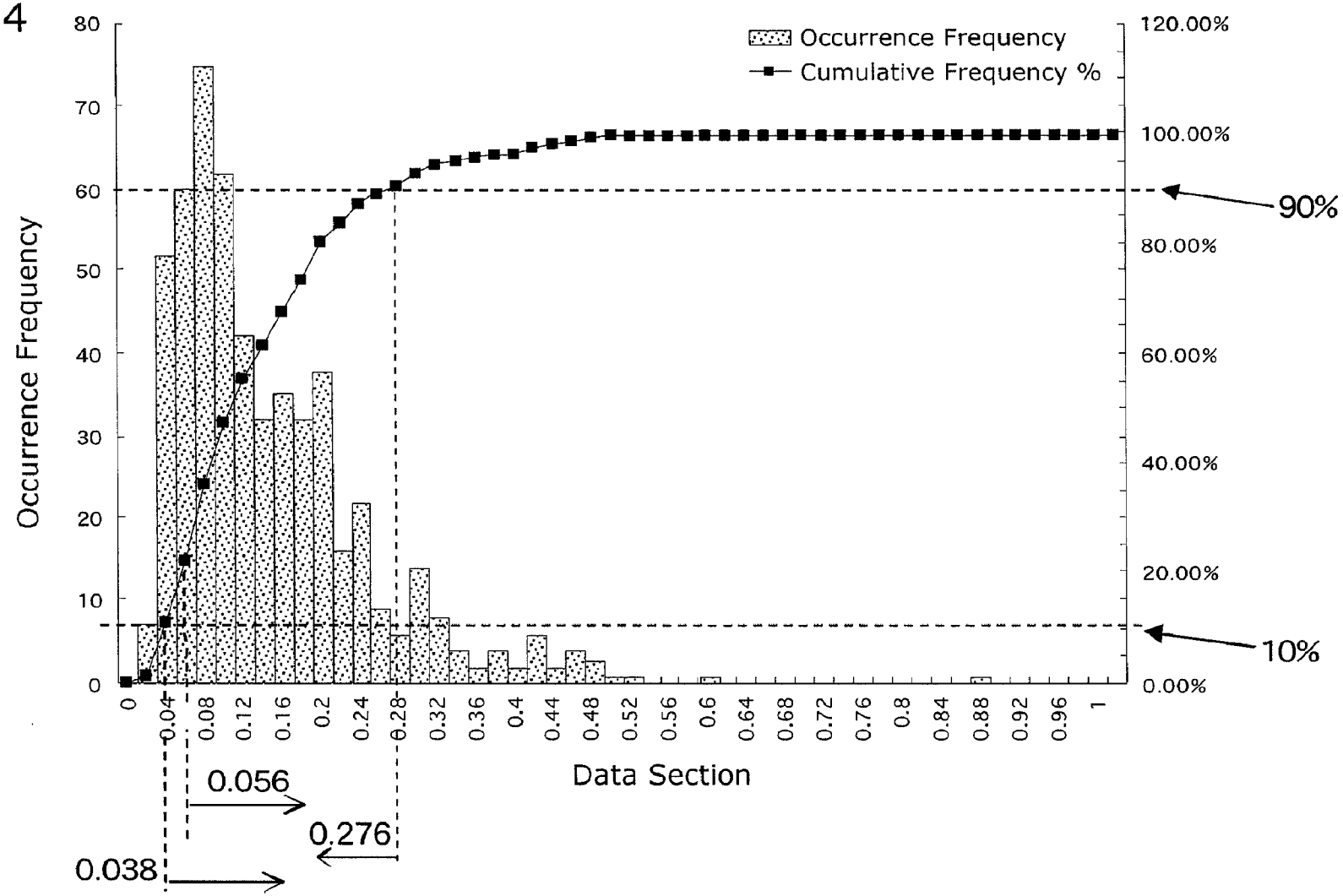
FIG. 4 shows a histogram and a cumulative frequency graph plotting distribution of modulation ratios of amplitude envelopes of moras uttered as strained rough voices observed in recorded speeches.

FIG. 4 shows a histogram and a cumulative frequency graph of modulation ratios calculated in the above-described manner. Table 2 shows occurrence frequency and cumulative frequency of the modulation ratios shown in FIG. 4.

TABLE 2

| Data Section | Occurrence Frequency | Cumulative Frequency (%) |
|---|---|---|
| 0 | 0 | 0.00% |
| 0.02 | 7 | 1.29% |
| 0.04 | 52 | 10.91% |
| 0.06 | 60 | 22.00% |
| 0.08 | 75 | 35.86% |
| 0.1 | 62 | 47.32% |
| 0.12 | 42 | 55.08% |
| 0.14 | 32 | 61.00% |
| 0.16 | 35 | 67.47% |
| 0.18 | 32 | 73.38% |
| 0.2 | 38 | 80.41% |
| 0.22 | 16 | 83.36% |
| 0.24 | 22 | 87.43% |
| 0.26 | 9 | 89.09% |
| 0.28 | 6 | 90.20% |
| 0.3 | 14 | 92.79% |
| 0.32 | 8 | 94.27% |
| 0.34 | 4 | 95.01% |
| 0.36 | 2 | 95.38% |
| 0.38 | 4 | 96.12% |
| 0.4 | 2 | 96.49% |
| 0.42 | 6 | 97.60% |
| 0.44 | 2 | 97.97% |

TABLE 2-continued

| Data Section | Occurrence Frequency | Cumulative Frequency (%) |
|---|---|---|
| 0.46 | 4 | 98.71% |
| 0.48 | 3 | 99.26% |
| 0.5 | 1 | 99.45% |
| 0.52 | 1 | 99.63% |
| 0.54 | 0 | 99.63% |
| 0.56 | 0 | 99.63% |
| 0.58 | 0 | 99.63% |
| 0.6 | 1 | 99.82% |
| 0.62 | 0 | 99.82% |
| 0.64 | 0 | 99.82% |
| 0.66 | 0 | 99.82% |
| 0.68 | 0 | 99.82% |
| 0.7 | 0 | 99.82% |
| 0.72 | 0 | 99.82% |
| 0.74 | 0 | 99.82% |
| 0.76 | 0 | 99.82% |
| 0.78 | 0 | 99.82% |
| 0.8 | 0 | 99.82% |
| 0.82 | 0 | 99.82% |
| 0.84 | 0 | 99.82% |
| 0.86 | 0 | 99.82% |
| 0.88 | 1 | 100.00% |
| 0.9 | 0 | 100.00% |
| 0.92 | 0 | 100.00% |
| 0.94 | 0 | 100.00% |
| 0.96 | 0 | 100.00% |
| 0.98 | 0 | 100.00% |
| 1 | 0 | 100.00% |
| Next Grade | 0 | 100.00% |

The histogram of FIG. 4 shows distribution of modulation ratios of amplitude fluctuation which are calculated from strained rough voices observed in speeches of a male speaker with emotion of "rage". Listeners can perceive amplitude fluctuation when a size of the amplitude fluctuation, namely a modulation ratio, is equal to or greater than a certain value. In the histogram of FIG. 4, occurrence frequency of modulation ratios of amplitude fluctuation is rapidly increased in a range of modulation ratios from 0.02 to 0.04. Therefore, it is reasonable to set a lower limit of a modulation ratio of amplitude fluctuation characterizing strained rough voices to around 0.02. According to the cumulative frequency, 90% of phonemes have modulation ratios equal to or greater than 0.038. Therefore, a lower limit of a modulation ratio may be set to 0.038. It is effective if the lower limit of a modulation ratio is set to 0.038 and the upper limit is set to 0.267, so that 80% of phonemes labeled as strained rough voices according to the cumulative frequency are included. From the above observation, as a reference used to detect strained rough voices, a frequency of periodic fluctuation of an amplitude envelope is set to be in a range of 40 Hz to 120 Hz, and a modulation ratio is set to be equal to or greater than 0.04.

Here, a listening experiment is executed to confirm that the above-described amplitude fluctuation sounds a "strained rough voice". Firstly, in the experiment, each of three normally uttered voices is previously applied with modulation including amplitude fluctuation fluctuating an amplitude frequency at fifteen stages from no amplitude fluctuation to 200 Hz, and then each of test subjects selects one of the following three categories for each of the modulated voices. Each of thirteen test subjects having normal hearing ability has selected one of the three categories for each voice sample. When the voice sample sounds like a normal voice, the test subject selects "Not Sound Strained". When the voice sample sounds a "strained rough" voice, the test subject selects "Sounds Strained". When amplitude fluctuation makes the voice sample heard voice sound with another sound, and the voice sample does not sound a "strained rough voice", the text subject selects "Sounds Noise". The selection is performed twice for each voice sample.

Figure 5:
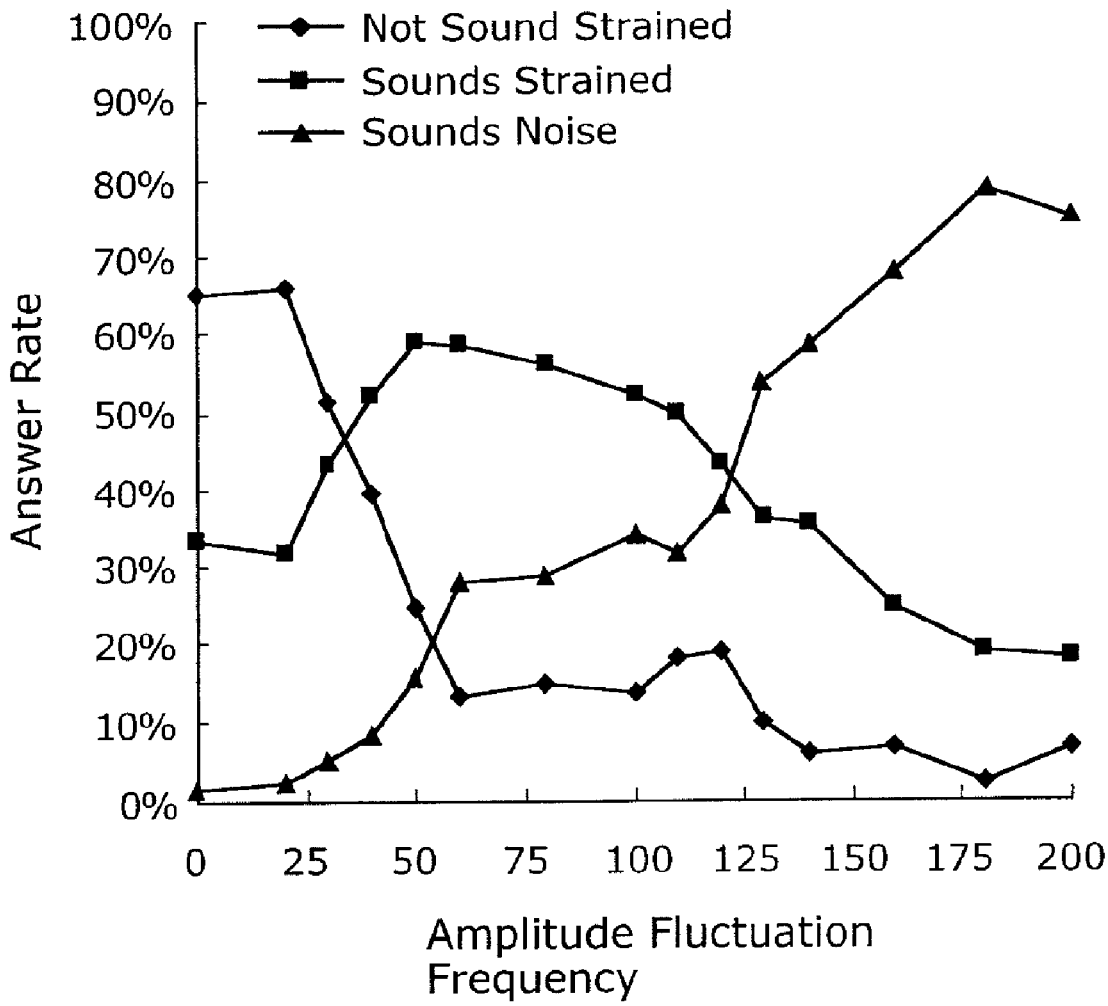
FIG. 5 is a graph plotting a range of amplitude fluctuation frequencies that are examined to be sound "strained rough" voices in a listening experiment.

The results of the experiment is as shown in FIG. 5. From no amplitude fluctuation to an amplitude fluctuation frequency of 30 Hz, most of answers is "Not Sound Strained". In a range of an amplitude fluctuation frequency of 40 Hz to 120 Hz, most of answers is "Sounds Strained". Regarding an amplitude fluctuation frequency of 130 Hz and more, most of answers is "Sounds Noise". The results show that a range of an amplitude fluctuation frequency with which a voice is likely to be perceived as a "strained rough" voice is from 40 Hz to 120 Hz that is similar to the distribution of an amplitude fluctuation frequency of real "strained rough" voices.

Figure 6:
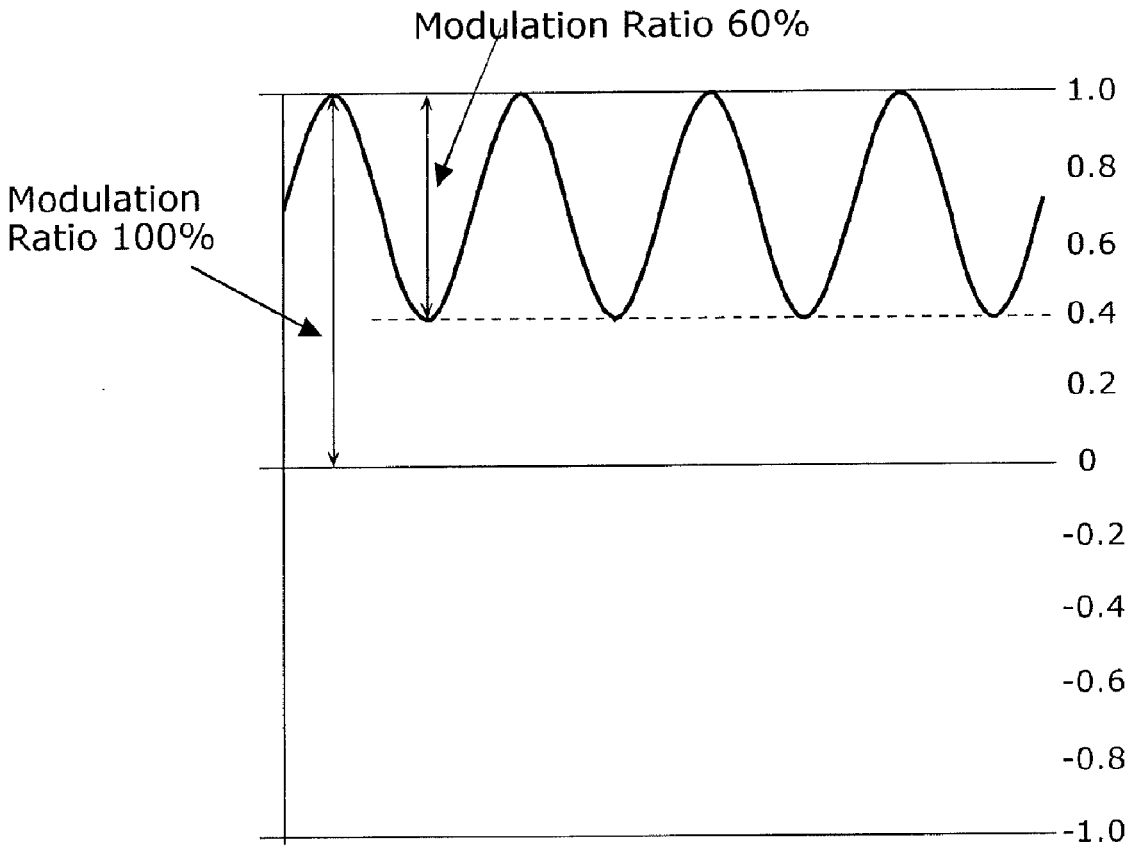
FIG. 6 is a graph showing an example of amplitude signals for explaining definition of a modulation ratio used to provide amplitude fluctuation.

In the meanwhile, in a speech waveform, an amplitude fluctuates smoothly for each phoneme. Therefore, a modulation ratio of the amplitude fluctuation is different from a modulation ratio of the commonly-known amplitude modulation of modulating a constant amplitude of carrier signals. However, it is assumed in this description that a speech waveform has modulation signals as shown in FIG. 6 applied with the amplitude modulation for carrier signals having a constant amplitude. Here, a modulation ratio is represented by a modulation range of modulation signals in percentage, assuming that the modulation ratio is 100% when an absolute value of an amplitude of signals to be modulated is modulated within a range from 100% (namely, no amplitude fluctuation) to 0% (namely, amplitude of zero). The modulation signals shown in FIG. 6 are generated by modulating the signals to be modulated from no amplitude fluctuation to 0.4 times. Thereby, a modulation range is from 1 to 0.4, in other words, 0.6. Therefore, a modulation ratio is expressed as 60%.

Figure 7:
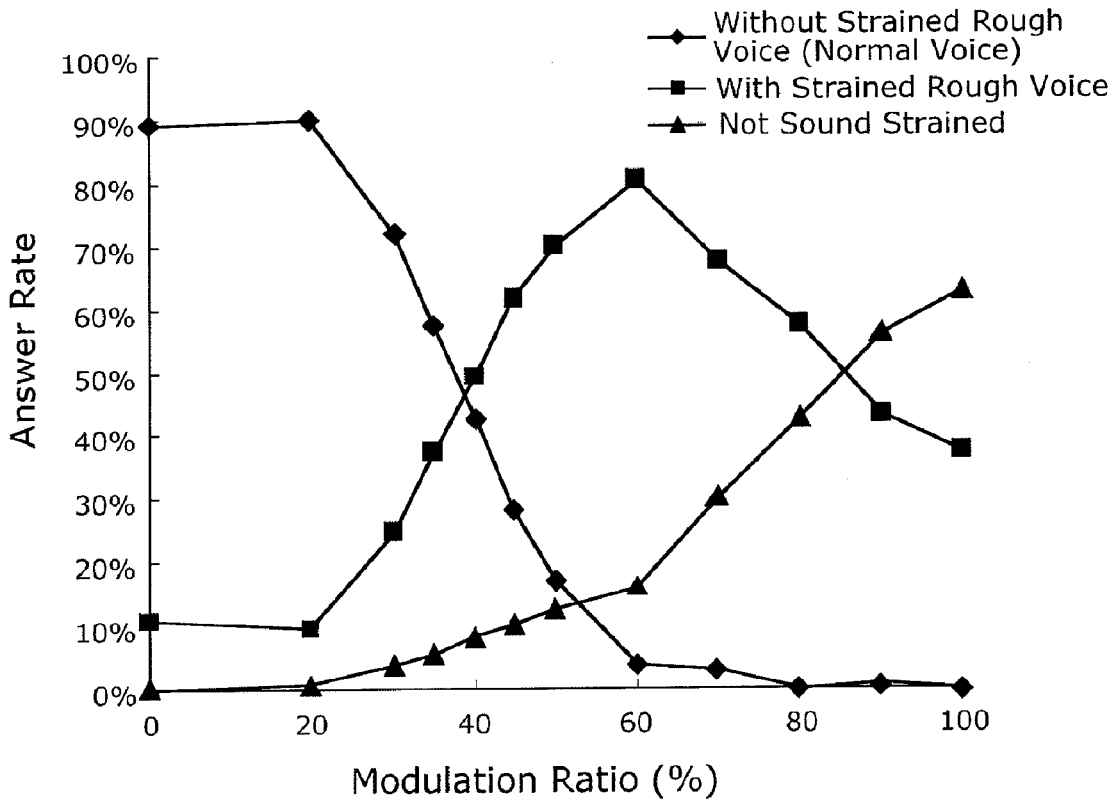
FIG. 7 is a graph plotting a range of amplitude modulation ratio that is examined to be sound "strained rough" voices in a listening experiment.

For the above-described modulation signals, another listening experiment is performed to examine a range of a modulation ratio at which a voice sounds a "strained rough" voice. Each of two normally uttered voices is previously applied with modulation including amplitude fluctuation fluctuating a modulation ratio from 0% (namely, no amplitude fluctuation) to 100% thereby generating voice samples of twelve stages. In the listening experiment, each of fifteen test subjects having normal hearing ability listens to each voice sample, and then from among three categories selects: "Without Strained Rough Voice" when the voice sample sounds like a normal voice; "With Strained Rough Voice" when the voice sample sounds a "strained rough" voice; and "Not Sound Strained" when the voice sample sounds an unnatural voice except a strained rough voice. The selection is performed five times for each voice sample. The results of the listening experiment are shown in FIG. 7. In a range of a modulation ratio up to 35%, most of answers is "Without Strained Rough Voice", and in a range of a modulation ratio from 40% to 80%, most of answers is "With Strained Rough Voice".

Further, at a modulation ratio of 90% and more, most of answers is that the voice sample sounds an unnatural voice except a strained rough voice. The results show that a voice is likely to be perceived as a "strained rough" voice, when a modulation ratio is in a range of 40% to 80%.

In singing, a duration of a vowel is often extended according to a melody. When a vowel having a long duration (for example, over 3 seconds) is applied with amplitude fluctuation at a fixed modulation frequency, sometimes an unnatural sound is generated. For example, buzz is heard with a voice. When a modulation frequency of amplitude fluctuation is changed at random, it is sometimes possible to reduce the impression of superimposed buzz or noise. In an experiment, fifteen test subjects perform five-grade evaluation of unnaturalness of (i) sound for which amplitude modulation is performed by changing at random a modulation frequency of amplitude fluctuation to be 80 Hz in average and 20 Hz in standard deviation and (ii) sound for which amplitude modulation is performed by fixing a modulation frequency of amplitude fluctuation to be 80 Hz. As a result, there is no significant difference in evaluation values of unnaturalness between the sound with the fixed modulation frequency and the sound with the randomly changing modulation frequency. However, regarding a specific voice sample, twelve of the fifteen test subjects determine that an evaluation value of unnaturalness is decreased more or not changed when a modulation frequency is changed at random than when a modulation frequency is fixed, as shown in FIG. 8. The results show that the random fluctuation of a modulation frequency sometimes would prevent generation of unnatural sound and thereby reduce unnatural ness in a speech. The above-mentioned specific voice sample is a speech of "Amari yoku nemurenakatta you desune (You seem not to have slept well)" in which sound applied with amplitude modulation over a duration over 100 millisecond (ms) is inserted to portions of "ma" and "you" and sound applied with amplitude modulation in a duration of 90 ms is inserted to a portion of "ka".

Figure 9:
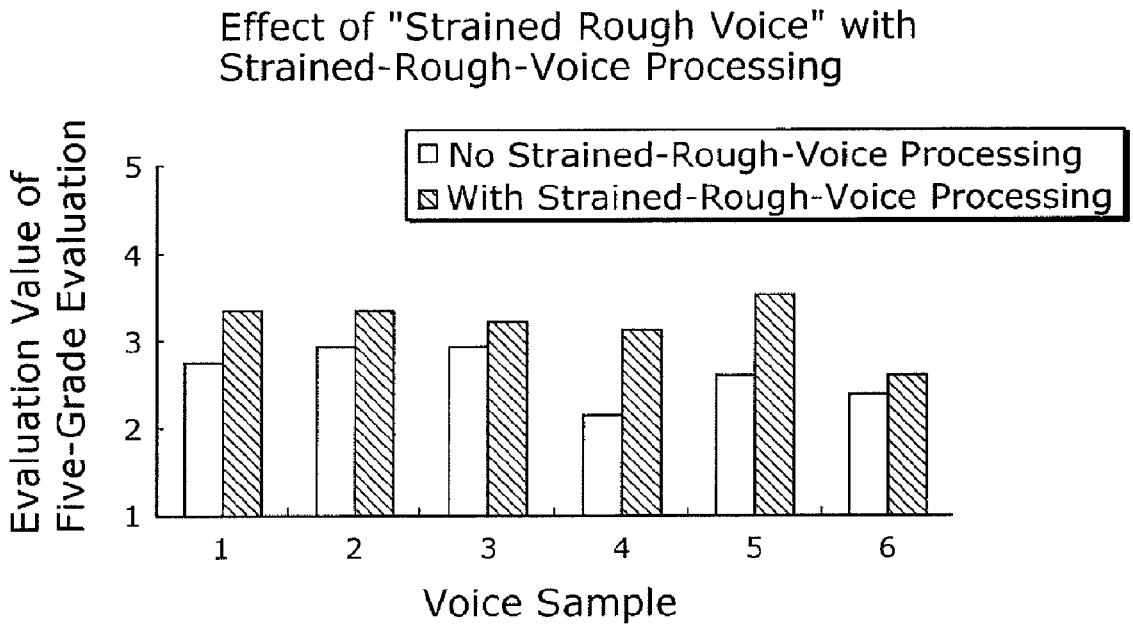
FIG. 9 is a graph showing a result of a listening experiment regarding singing voices applied with amplitude fluctuation.

For still another experiment, singing voice samples are previously applied with amplitude fluctuation changing at random a modulation frequency of 80 Hz in average and 20 Hz in standard deviation. In the hearing experiment, fifteen test subjects having normal hearing ability examines whether or not each of the modulated sample sounds "Singing Strained". As shown in FIG. 9, the results show that the singing voice samples with the amplitude modulation are evaluated as "Singing Strained" more than the singing voice samples without the amplitude modulation. This shows that a "strained rough voice" or "unari (growling or groaning voice)" as musical expression in singing voices can also be generated using the same modulation processing as used to generate a "strained rough voice" as an utterance with emotion.

The following describes embodiments of the present invention with reference to the drawings.

(First Embodiment)

Figure 10:
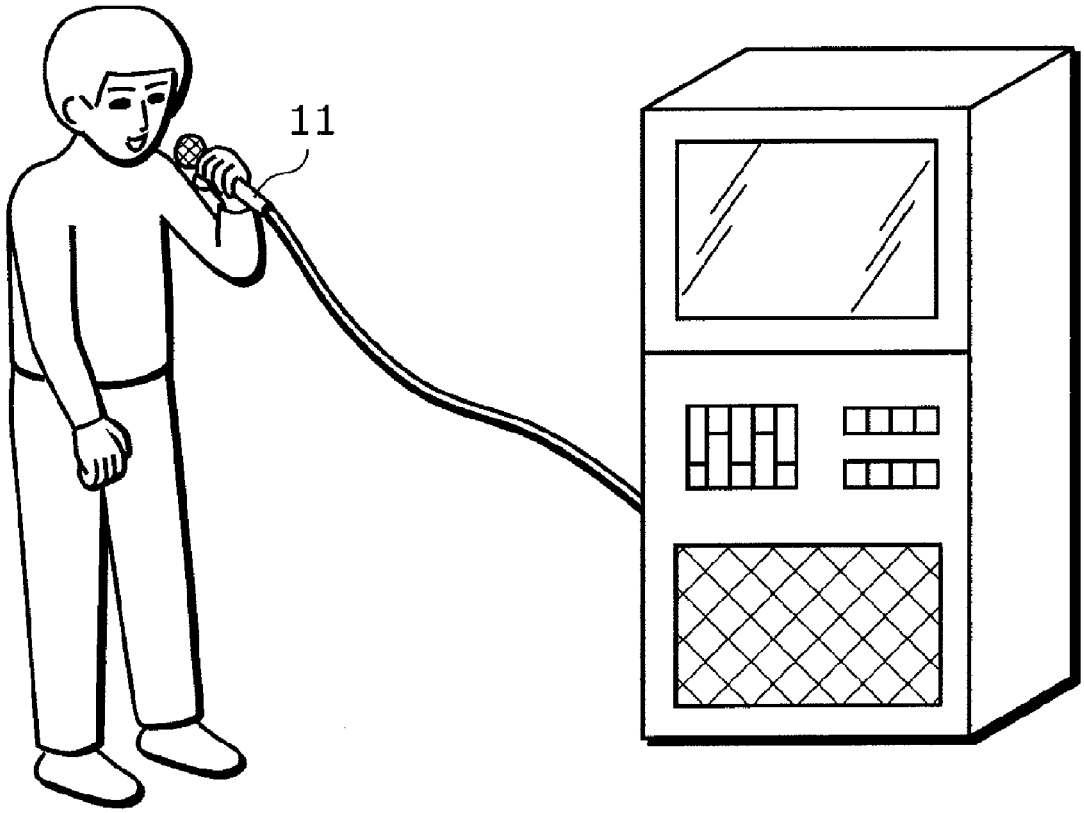
FIG. 10 is an external view of the voice emphasizing device according to a first embodiment of the present invention.

FIG. 10 is an external view of a voice emphasizing device according to a first embodiment of the present invention. An example of the voice emphasizing device is a karaoke machine.

Figure 11:
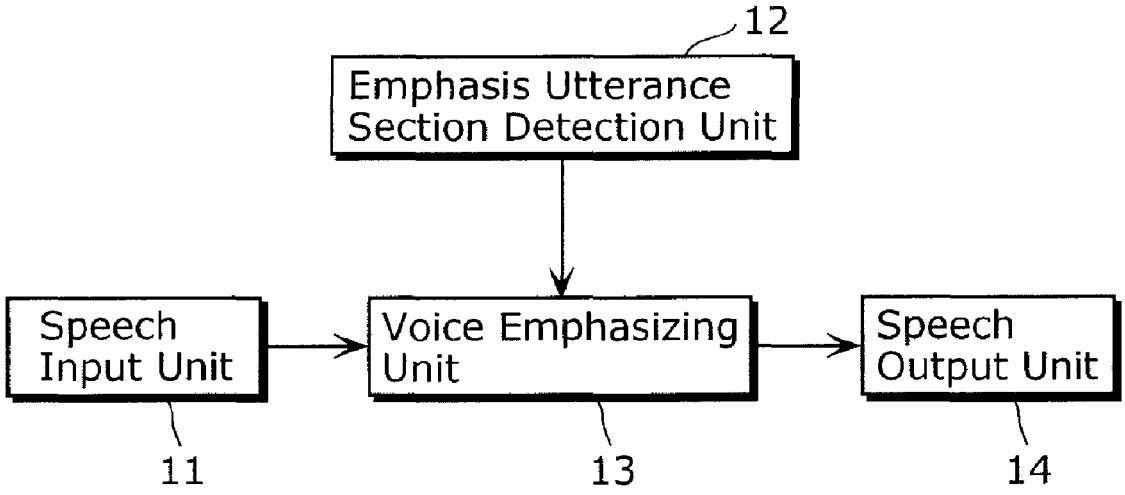
FIG. 11 is a functional block diagram showing a structure of the voice emphasizing device according to the first embodiment of the present invention.

FIG. 11 is a functional block diagram of the voice emphasizing device according to the first embodiment.

As shown in FIG. 11, the voice emphasizing device according to the first embodiment of the present invention is a device that emphasizes a strained rough voice in an input speech and then outputs the speech with the emphasized strained rough voice. The voice emphasizing device includes a speech input unit 11, an emphasis utterance section detection unit 12, a voice emphasizing unit 13, and a speech output unit 14.

The speech input unit 11 is a processing unit that receives a waveform of a speech (hereinafter, referred to as an "input speech waveform" or simply as "input speech") as an input. An example of the speech input unit 11 is a microphone.

The emphasis utterance section detection unit 12 is a processing unit that detects from the input speech waveform received by the speech input unit 11 a section to which a speaker or user has intended to provide emphasis or musical expression ("unari") by a "strained rough voice".

The voice emphasizing unit 13 is a processing unit that performs modulation including amplitude fluctuation on the above section detected by the emphasis utterance section detection unit 12 from among the input speech waveform received by the speech input unit 11.

The speech output unit 14 is a processing unit that outputs the speech waveform a part or all of which is applied with the modulation by the voice emphasizing unit 13. An example of the speech output unit 14 is a loudspeaker.

Figure 12:
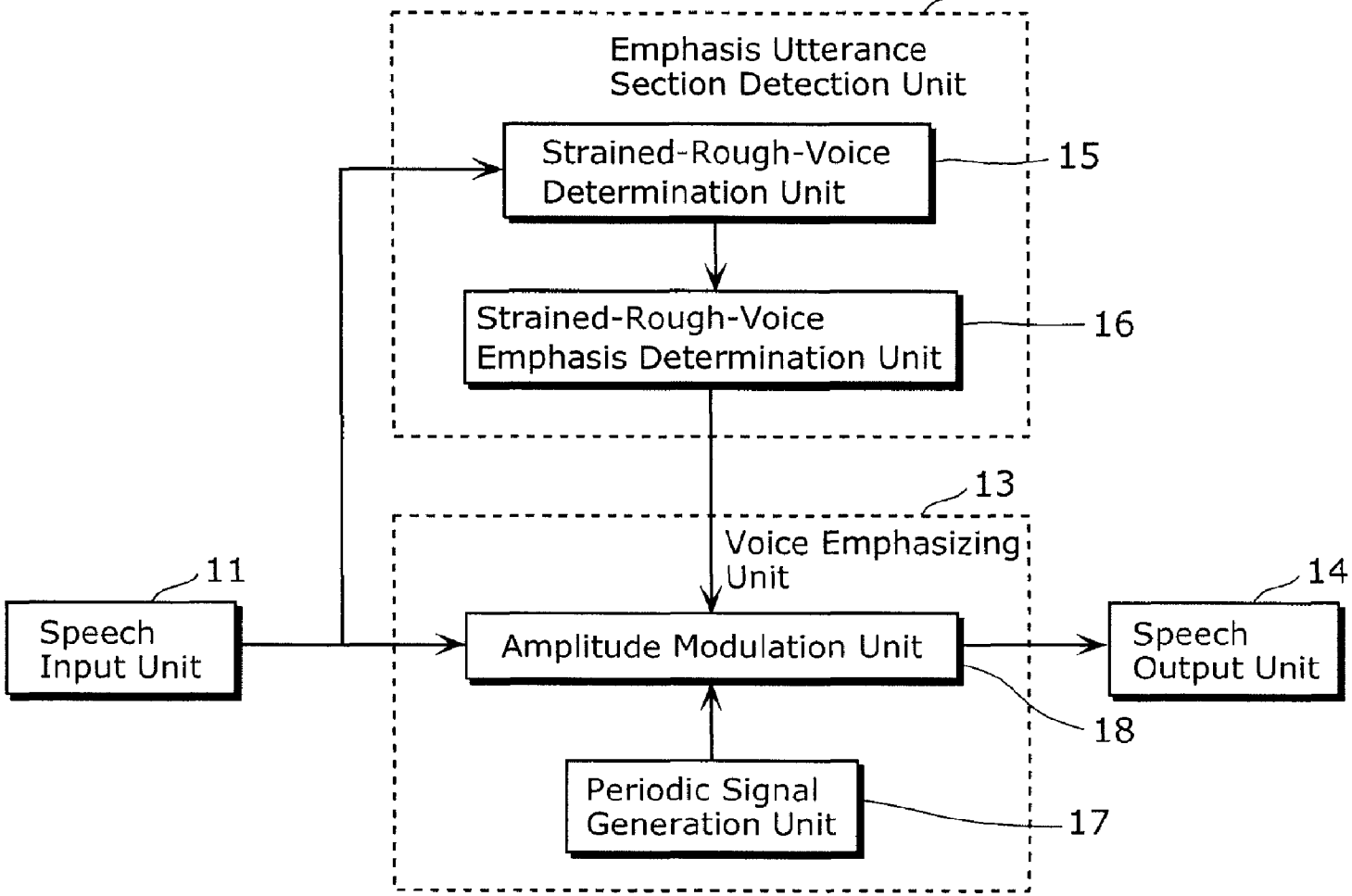
FIG. 12 is another functional block diagram showing a structure of the voice emphasizing device according to the first embodiment of the present invention.

FIG. 12 is another functional block diagram showing the structure of the voice emphasizing device of FIG. 11 in which structures of the emphasis utterance section detection unit 12 and the voice emphasizing unit 13 are shown in more detail.

As shown in FIG. 12, the emphasis utterance section detection unit 12 includes a strained-rough-voice determination unit 15 and a strained-rough-voice emphasis determination unit 16. The voice emphasizing unit 13 includes a periodic signal generation unit 17 and an amplitude modulation unit 18.

The strained-rough-voice determination unit 15 is a processing unit that receives the input speech waveform from the speech input unit 11, and determines whether or not a "strained rough voice" exists in the received waveform by detecting original amplitude fluctuation of a frequency within a predetermined range.

The strained-rough-voice emphasis determination unit 16 is a processing unit that determines, for a section determined to have a "strained rough voice" by the strained-rough-voice determination unit 15, whether or not a size of a modulation ratio of the original amplitude fluctuation is enough to be perceived by listeners as a "strained rough voice".

The periodic signal generation unit 17 is a processing unit that generates periodic signals to be used to perform modulation including amplitude fluctuation on the speech.

The amplitude modulation unit 18 is a processing unit that multiplies (i) a voice waveform of the section determined by the strained-rough-voice emphasis determination unit 16 to have an enough size of the modulation ratio from among voice the sections determined by the strained-rough-voice determination unit 15 to have "strained rough voices" by (ii) the periodic signals generated by the periodic signal generation unit 17. Thereby, the amplitude modulation unit 18 performs periodic modulation including amplitude fluctuation on the voice waveform.

Figure 13:
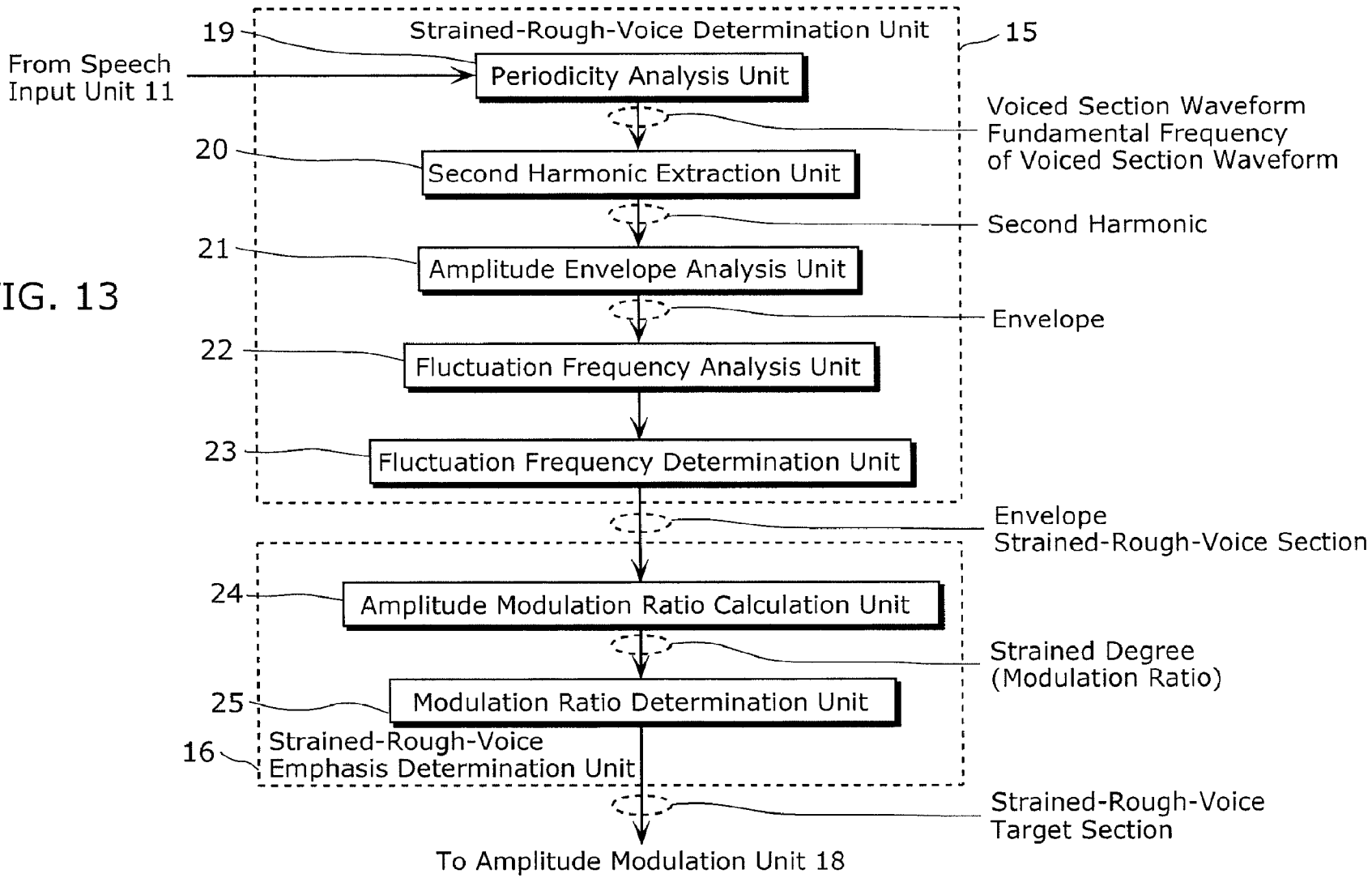
FIG. 13 is a functional block diagram showing a detailed structure of a strained-rough-voice determination unit and a strained-rough-voice emphasis determination unit.

FIG. 13 is a functional block diagram showing detailed structures of the strained-rough-voice determination unit 15 and the strained-rough-voice emphasis determination unit 16.

As shown in FIG. 13, the strained-rough-voice determination unit 15 includes a periodicity analysis unit 19, a second harmonic extraction unit 20, an amplitude envelope analysis unit 21, a fluctuation frequency analysis unit 22, and a fluctuation frequency determination unit 23. The strained-rough-voice emphasis determination unit 16 includes an amplitude modulation ratio calculation unit 24 and a modulation ratio determination unit 25.

The periodicity analysis unit 19 is a processing unit that analyzes periodicity of the input speech waveform received from the speech input unit 11, then detects from the input speech waveform a section having periodicity, and outputs (i) the detected section as a voiced section and (ii) a fundamental frequency of the input speech waveform.

The second harmonic extraction unit 20 is a processing unit that extracts signals of the second harmonic (second harmonic signals) from a voice waveform of the voiced section based on the fundamental frequency provided from the periodicity analysis unit 19.

The amplitude envelope analysis unit 21 is a processing unit that calculates an amplitude envelope of the second harmonic signals extracted by the second harmonic extraction unit 20.

The fluctuation frequency analysis unit 22 is a processing unit that calculates a fluctuation frequency of the amplitude envelope (envelope) calculated by the amplitude envelope analysis unit 21.

The fluctuation frequency determination unit 23 is a processing unit that determines whether or not a voice of the voiced section is a "strained rough voice" by determining whether or not the fluctuation frequency of the envelope calculated by the fluctuation frequency analysis unit 22 is within a predetermined range.

The amplitude modulation ratio calculation unit 24 is a processing unit that calculates a ratio of amplitude modulation (amplitude modulation ratio) of the envelope of the section determined as a "strained rough voice" by the fluctuation frequency determination unit 23.

The modulation ratio determination unit 25 is a processing unit that decides the section as a section on which strained rough voice processing is to be performed (hereinafter, referred to as a "strained-rough-voice target section") if the amplitude modulation ratio calculated by the amplitude modulation ratio calculation unit 24 is equal to or smaller than a predetermined value.

Figure 14:
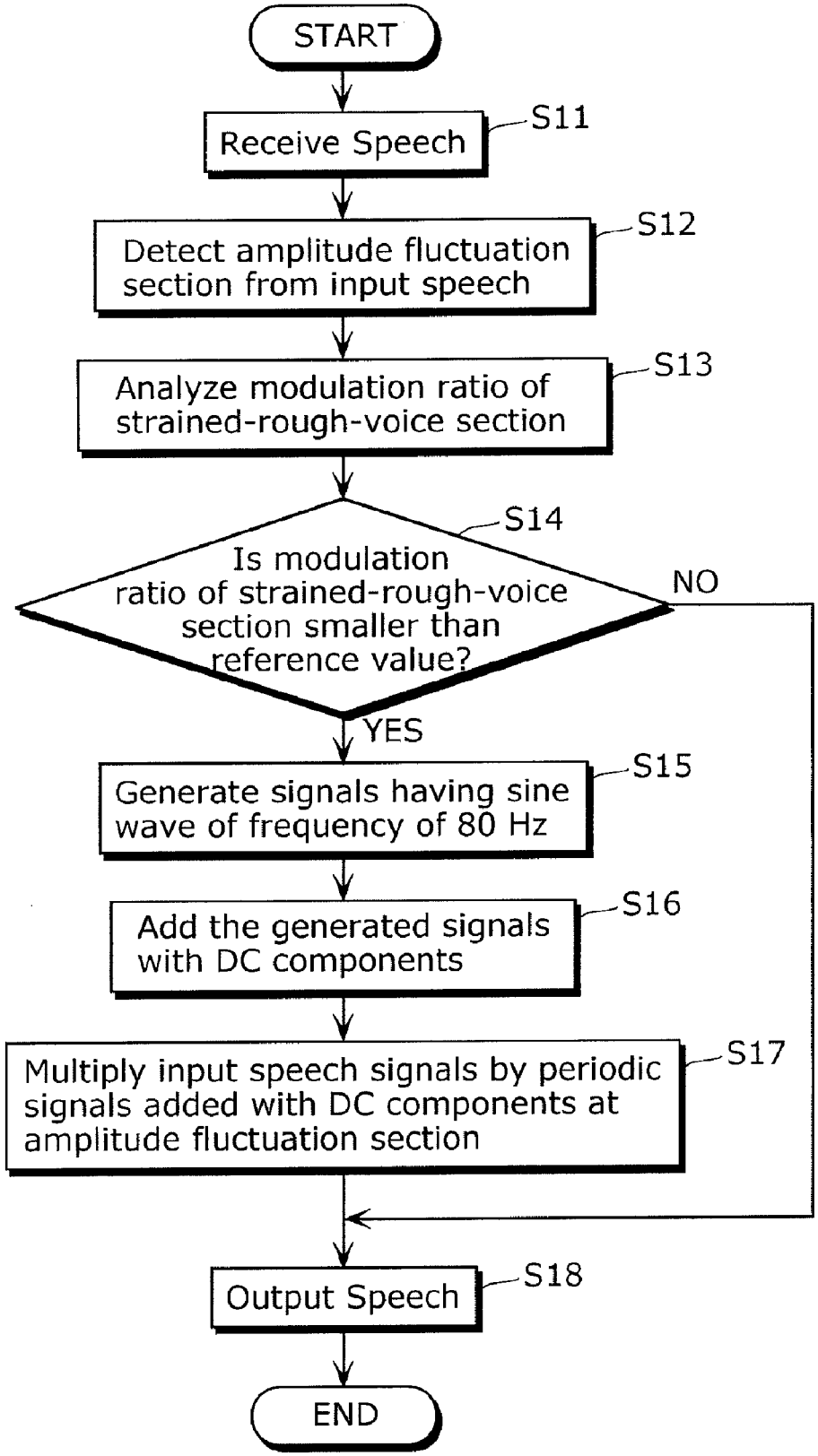
FIG. 14 is a flowchart of processing performed by the voice emphasizing device according to the first embodiment of the present invention.

Next, the processing performed by the voice emphasizing device having the above-described structure is described with reference to FIGS. 14 to 16. FIG. 14 is a flowchart of the processing performed by the voice emphasizing device.

Firstly, the speech input unit 11 receives an input speech waveform (Step S11). The input speech waveform received by the speech input unit 11 is provided to the strained-rough-voice determination unit 15 in the emphasis utterance section detection unit 12. From the input speech waveform, the strained-rough-voice determination unit 15 detects a section having amplitude fluctuation (Step S12).

Figure 15:
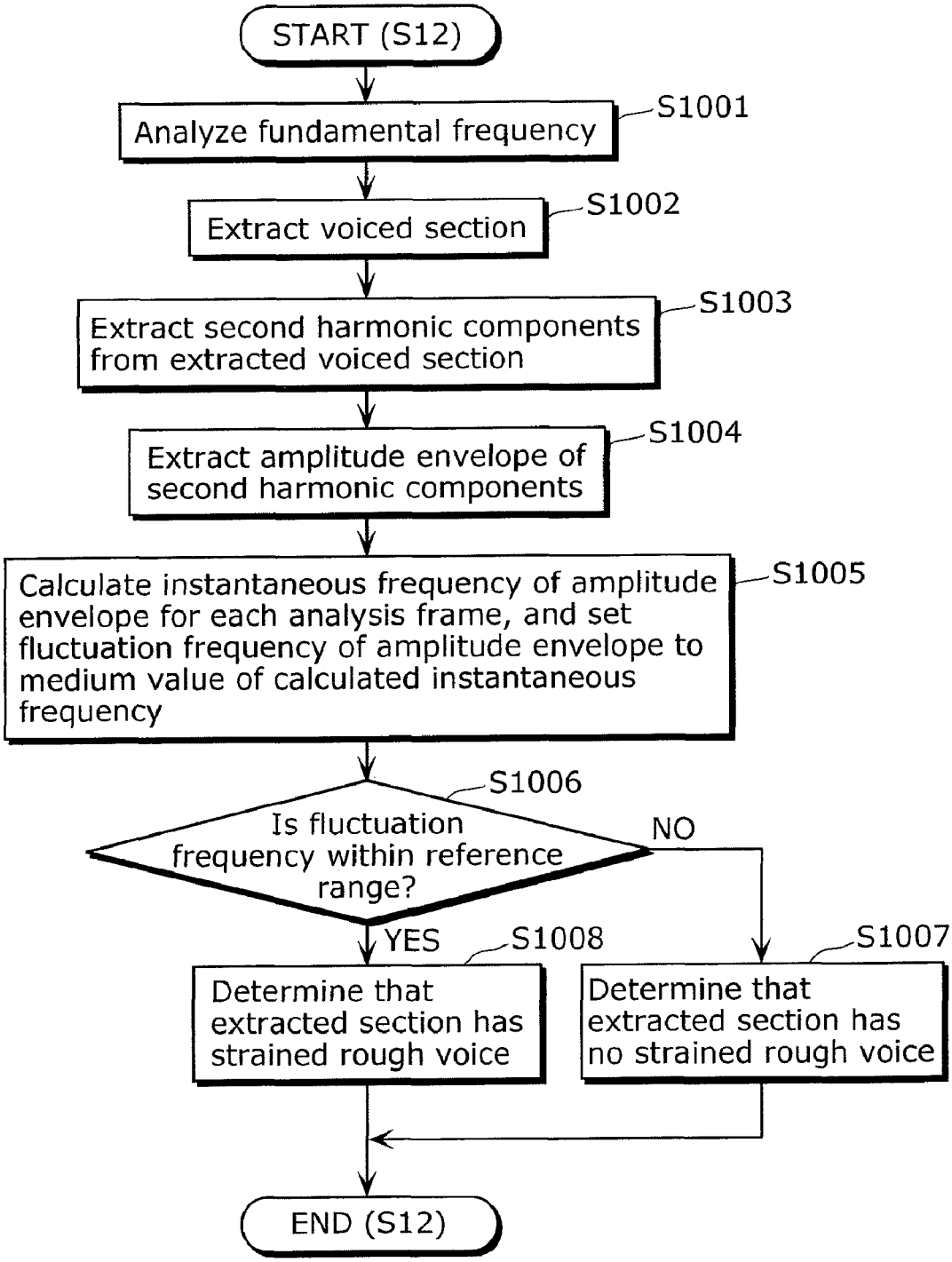
FIG. 15 is a flowchart of a part of the processing performed by the voice emphasizing device according to the first to embodiment of the present invention.

FIG. 15 is a flowchart of details of the processing for detecting amplitude fluctuation (amplitude fluctuation section detection) (Step S12).

In more detail, the periodicity analysis unit 19 receives the input speech waveform from the speech input unit 11 and analyzes whether or not the input speech waveform has periodicity, and if there is periodicity then calculates a frequency of a portion having the periodicity in the input speech waveform (Step S1001). An example of methods of analyzing periodicity and frequency is as the following. Auto-correlation coefficients of the input speech (input speech waveform) are calculated. Then, a portion where the auto-correction coefficient is equal to or greater than a predetermined value with periodicity equivalent to a frequency of 50 Hz to 500 Hz is detected as a portion having periodicity, namely, a voiced section. In addition, a fundamental frequency is set to a frequency corresponding to periodicity having a maximum value of the auto-correction coefficient.

Furthermore, the periodicity analysis unit 19 extracts the section determined at Step S1001 as a voiced section from the input speech waveform (Step S1002).

The second harmonic extraction unit 20 sets a band-pass filter having a center frequency that is double of the fundamental frequency of the voiced section determined at Step S1001, and filters a voice waveform of the voiced section using the band-pass filter to extract components of the second harmonic (second harmonic components) (Step S1003).

The amplitude envelope analysis unit 21 extracts an amplitude envelope of the second harmonic components extracted at Step S1003 (Step S1004). The amplitude envelope is extracted by a method of performing full-wave rectification and smoothing peak values of the result, or by a method of performing Hilbert transformation to calculate an absolute value of the result.

The fluctuation frequency analysis unit 22 calculates an instantaneous frequency of each of analysis target frames in the amplitude envelope extracted at Step S1004. The analysis target frame has a duration of 5 ms, for example. It should be noted that the analysis target frame may have a duration of 10 ms or more. The fluctuation frequency analysis unit 22 calculates a medium value of the instantaneous frequency calculated for the voiced section, and sets the calculated medium value as a fluctuation frequency (Step S1005).

The fluctuation frequency determination unit 23 determines whether or not the fluctuation frequency calculated at Step S1005 is within a predetermined reference range (Step S1006). The reference range may be set to be from 10 Hz to lower than 170 Hz, based on the histogram of FIG. 2. Preferably, the reference range is from 40 Hz to lower than 120 Hz. If the determination is made that the fluctuation frequency is beyond the reference range (No at Step S1006), then the fluctuation frequency determination unit 23 determines that the voiced section is not a strained rough voice, namely, the voiced section is a normal voice (Step S1007). On the other hand, if the determination is made that the fluctuation frequency is within the reference range (Yes at Step S1006), then the fluctuation frequency determination unit 23 determines that the voiced section is a strained rough voice (Step S1008), and provides the section and the envelope of second harmonic to the strained-rough-voice emphasis determination unit 16.

Next, the strained-rough-voice emphasis determination unit 16 analyzes a modulation ratio of amplitude fluctuation of the received section (strained-rough-voice section) (Step S13).

Figure 16:
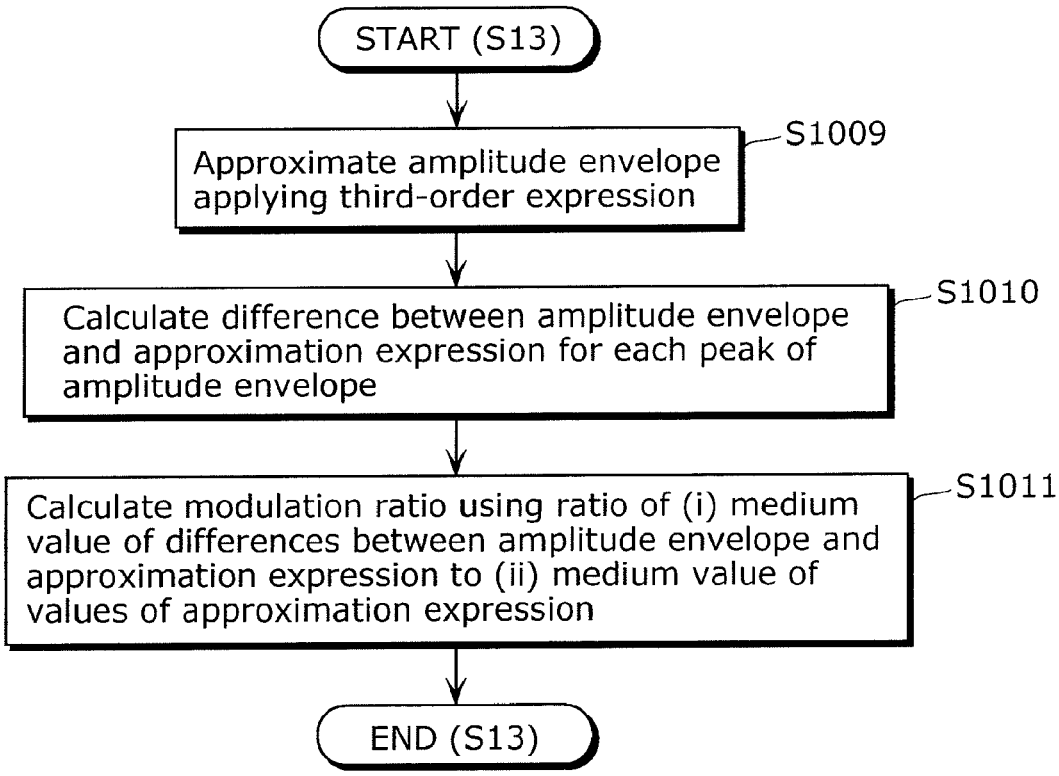
FIG. 16 is a flowchart of another part of the processing performed by the voice emphasizing device according to the first embodiment of the present invention.

FIG. 16 is a flowchart of details of the processing for analyzing the modulation ratio (modulation ratio analysis) (Step S13).

The strained-rough-voice section and the envelope (amplitude envelope) of second harmonic received by the strained-rough-voice emphasis determination unit 16 are provided to the amplitude modulation ratio calculation unit 24. The amplitude modulation ratio calculation unit 24 approximates the received amplitude envelope of second harmonic of the strained-rough-voice section applying a third-order expression, thereby estimating an envelope of the strained-rough-voice section before being applied with amplitude modulation of the amplitude modulation unit 18.

For each peak in the amplitude envelope, the amplitude modulation ratio calculation unit 24 calculates a difference between a value of the amplitude envelope and a value of the approximation applying the third-order expression at Step S1009 (Step S1010).

The amplitude modulation ratio calculation unit 24 calculates a modulation ratio of the strained-rough-voice section according to a ratio of (i) a medium value of the differences among all peaks of the amplitude envelope in the strained-rough-voice section to (ii) a medium value of the values of the approximation expression in the strained-rough-voice section (Step S1011). The definition of the modulation ratio can be different from the above. For example, the modulation ratio is defined as a ratio of (i) an average value or a medium value of peak values of convex portions of the amplitude envelope to (ii) an average value or a medium value of peak values of convex portions of the amplitude envelope. If the definition of the modulation ratio is different from that used in the description, the reference value of the modulation ratio needs to be set based on the definition.

The modulation ratio determination unit 25 determines whether or not the modulation ratio calculated at Step S1011 is equal to or smaller than a predetermined reference value that is, for example, 0.04 (Step S14). As shown in the histogram of FIG. 4, since occurrence frequency of strained rough voices is rapidly increased in a range of a modulation ratio of 0.02 to 0.04, the reference value is set to 0.04 in this description. If the determination is made that the modulation ratio is equal to or greater than the reference value (No at Step S14), the modulation ratio determination unit 25 determines that the amplitude modulation ratio of the strained-rough-voice section is enough to be perceived as a "strained rough voice", then does not set the section to be a strained-rough-voice target section, and provides information of the strained-rough-voice section (section information) to the amplitude modulation unit 18. The amplitude modulation unit 18 does not perform amplitude modulation on the voice waveform of the strained-rough-voice section which is not determined as a strained-rough-voice target section, and provides the voice waveform to the speech output unit 14. The speech output unit 14 outputs the voice waveform of the strained-rough-voice section which is not determined as a strained-rough-voice target section (Step S18).

On the other hand, if the determination is made that the modulation ratio is smaller than the reference value (Yes at Step S14), then the periodic signal generation unit 17 generates signals of a sine wave having a frequency of 80 Hz (Step S15), and then adds the generated signals with direct current (DC) components to generate signals (Step S16). For the determined strained-rough-voice target section in the input speech waveform, the amplitude modulation unit 18 performs amplitude modulation by multiplying signals of the strained-rough-voice target section in the input speech waveform by the periodic signals generated by the periodic signal generation unit 17 to vibrate with a frequency of 80 Hz (Step S17), in order to convert a voice of the strained-rough-voice target section to a "strained rough voice" including the periodic fluctuation of amplitude. The speech output unit 14 outputs a voice waveform for which the strained-rough-voice target section is converted to the "strained rough voice" (Step S18).

The above described processing (Steps S11 to S18) is repeated, for example, at predetermined time intervals.

With the above structure, the voice emphasizing device according to the first embodiment can detect a section having amplitude fluctuation from an input speech, and if a modulation ratio of the amplitude fluctuation is enough, then does not perform any processing on the section, and if the modulation ratio is not enough, then performs modulation including amplitude fluctuation on a voice waveform of the section in order to compensate for the original amplitude fluctuation inadequate to express the voice of the section. Thereby, in an input speech, a "strained rough voice" expression at a portion where a speaker intends to emphasize or provide musical expression of a "strained rough voice" or "unari (growling or groaning voice)" or at a portion uttered forcefully is emphasized to adequately convey the expression to listeners. On the other hand, a portion originally having enough emphasis or expression in the input speech is not changed to keep its natural expression of the voice. As a result, the voice emphasizing device according to the first embodiment can expressiveness of the input speech.

The voice emphasizing device according to the first embodiment compensates for amplitude fluctuation only when a modulation ratio of the amplitude fluctuation is inadequate in an input speech. Thereby, it is possible to prevent the compensation from negating original amplitude fluctuation having an enough modulation ratio in the input speech or changing a fluctuation frequency of the original amplitude fluctuation. Therefore, original emphasis expression in the input speech is not weakened or distorted. While preventing the above problems, the voice emphasizing device according to the first embodiment can enhance expressiveness of the input speech.

In addition, with the above structure, the voice emphasizing device according to the first embodiment does not need to store a great amount of voice waveforms having features supporting any desired voices by which a target voice waveform can be replaced. Without storing such great amount of voice waveforms, the voice emphasizing device according to the first embodiment can generate a speech with rich vocal expression. Furthermore, the expression can be achieved only by performing modulation including amplitude fluctuation on the input speech. Therefore, such simple processing can provide the input speech with (i) a voice waveform having expression conveying emphasis or tension or (ii) musical expression, while keeping original features of the input speech.

A "strained rough voice" or "unari (growling or groaning voice)" is voice expression having a feature different from that of normal utterances. The "strained rough voice" or "unari (growling or groaning voice)" occurs in a hoarse voice, a rough voice, or a harsh voice that is produced when a human yells, speaks forcefully with emphasis, speaks excitedly or nervously, or the like. Other examples of the "strained rough voice" expression are "kobushi (tremolo or vibrato)" and "unari (growling or groaning voice)" that are produced in singing Enka (Japanese ballad) and the like. Still further example is "shout" produced in singing blues, rock, and the like. The "strained rough voice" or "unari (growling or groaning voice)" conveys with reality how a phonatory organ of a speaker is tensed or strained, thereby providing listeners with strong impression as a speech having rich expression. However, mastering the above-mentioned expression is difficult for most people except those having utterance training such as actors/actresses, voice actors/actresses, and narrators and those having singing training such as singers. In addition, daring to utter such expression would damage a throat. When the voice stressing device according to the present invention is used in a loudspeaker or a Karaoke machine, even a user who does not have special training can create rich voice expression like actors/actresses, voice actors/actresses, narrators, or singers, by uttering or singing with force in a body or a throat at a portion where the user desires to provide the expression. Therefore, if the present invention is used in a Karaoke machine, it is possible to enhance entertainment of singing songs like professional singers. Furthermore, if the present invention is used in a loudspeaker, the user can utter a portion to be emphasized in a lecture or speech using a "strained rough voice", thereby impressing content of the portion.

It should be noted that it has been described in the first embodiment that at Step S15 the periodic signal generation unit 17 outputs signals of a sine wave having a frequency of 80 Hz, but the present invention is not limited to the above. For example, the frequency may be any frequency in a range of 40 Hz to 120 Hz depending on distribution of a fluctuation frequency of an amplitude envelope, and the periodic signal generation unit 17 may output periodic signals not having a sine wave.

(Modification of First Embodiment)

Figure 17:
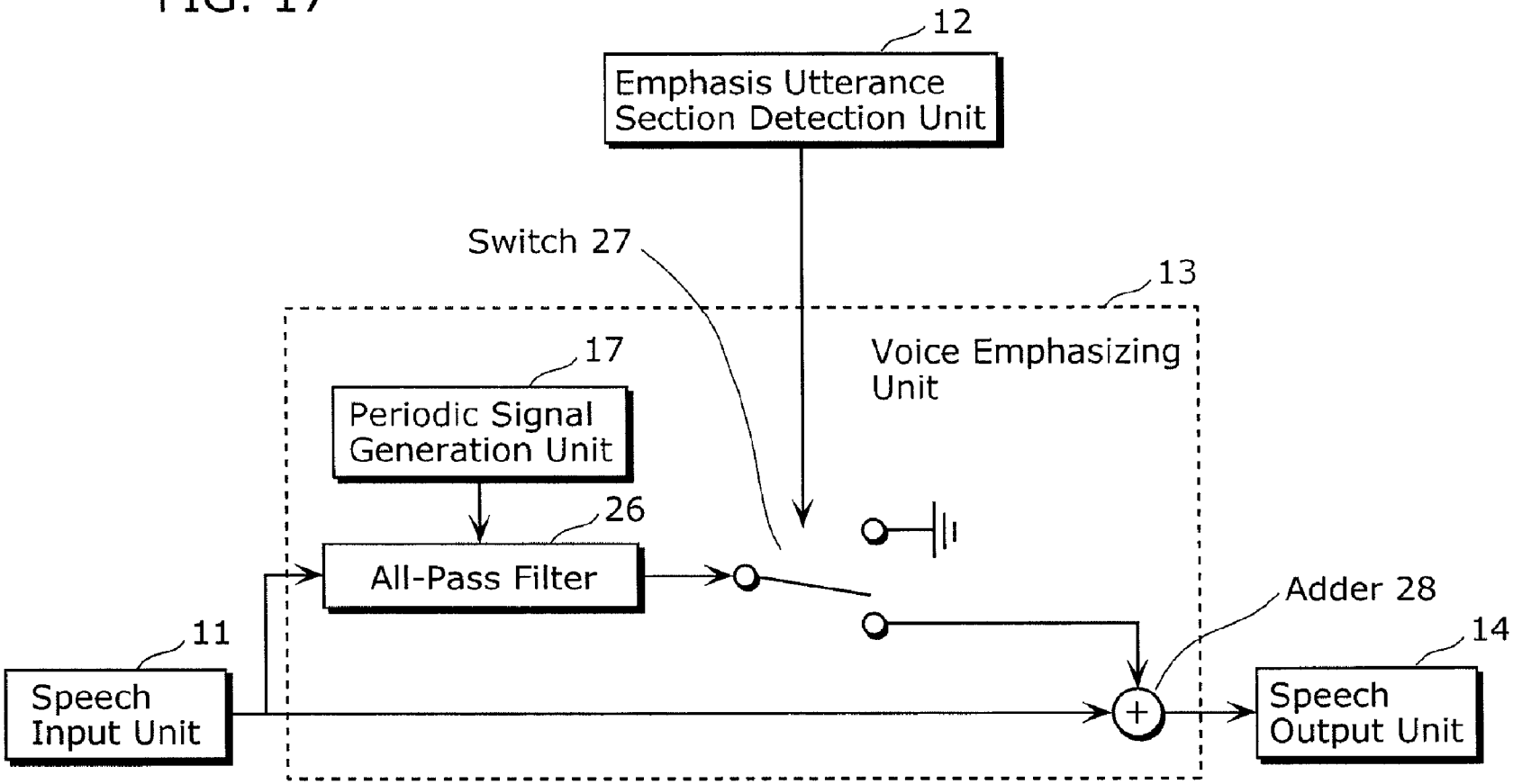
FIG. 17 is a functional block diagram showing a structure of a voice emphasizing device according to a modification of the first embodiment of the present invention.
Figure 18:
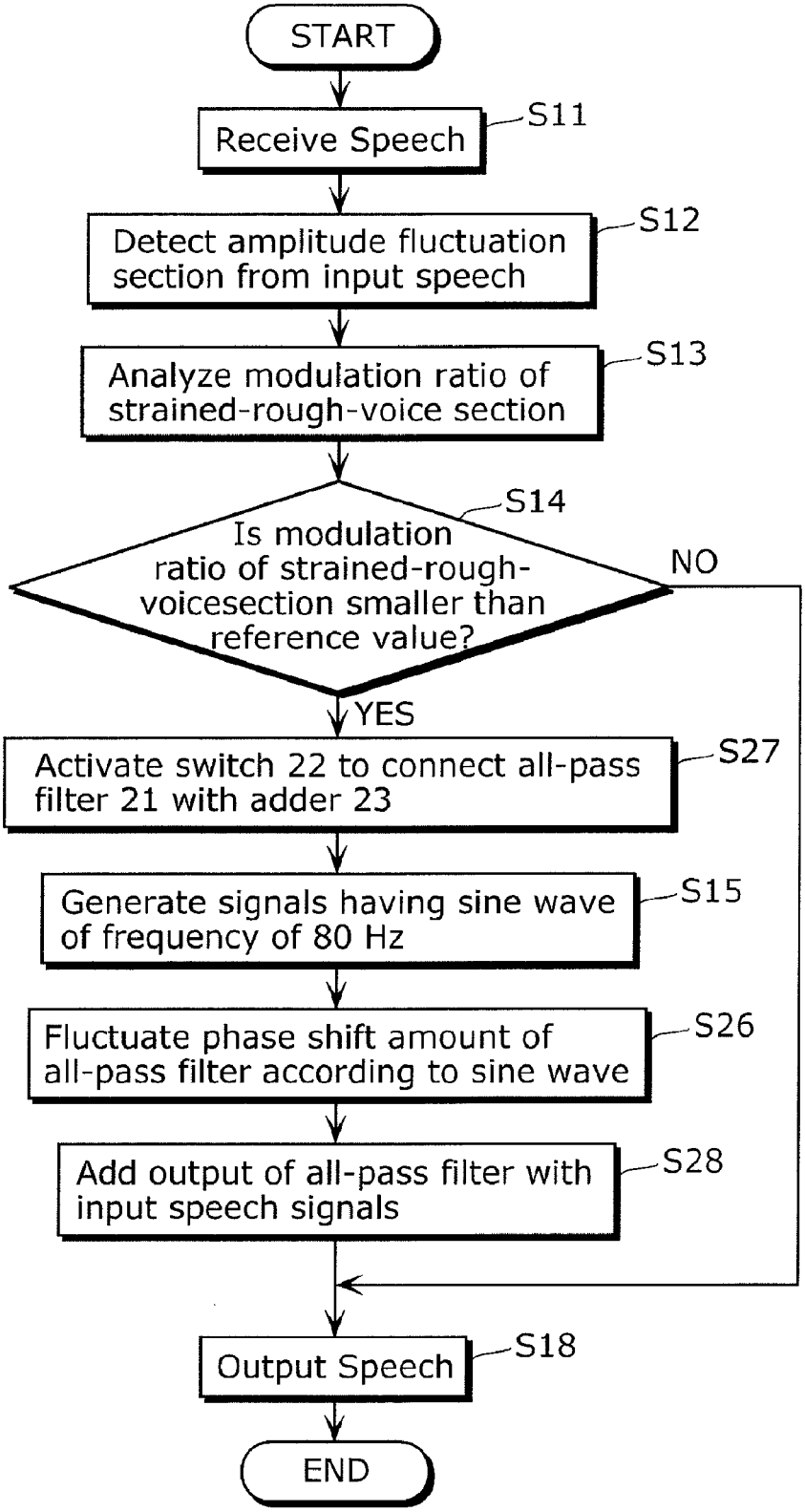
FIG. 18 is a flowchart of processing performed by the voice emphasizing device according to the modification of the first embodiment of the present invention.

FIG. 17 is a functional block diagram of a voice emphasizing device according to a modification of the first embodiment of the present invention. FIG. 18 is a flowchart of a part of processing performed by the voice emphasizing device according to the modification. Here, the same reference numerals of FIGS. 12 and 14 are assigned to the identical units and steps of FIGS. 17 and 18, so that the identical units and steps are not explained again below.

As shown in FIG. 17, the structure of the voice emphasizing device according to the modification differs from the structure of the voice emphasizing device according to the first embodiment of FIG. 11 in an internal structure of the voice emphasizing unit 13. More specifically, while the voice emphasizing unit 13 according to the first embodiment includes the periodic signal generation unit 17 and the amplitude modulation unit 18, the voice emphasizing unit 13 according to the modification includes the periodic signal generation unit 17, an all-pass filter 26, a switch 27, and an adder 28.

The periodic signal generation unit 17 is a processing unit that generates periodic fluctuation signals in the same manner as described for the periodic signal generation unit 17 according to the first embodiment.

The all-pass filter 26 is a filter having an amplitude response that is constant and a phase response that varies depending on a frequency. In the fields of the electric communication, all-pass filters are used to compensate for delay characteristics of a transmission path. In the fields of electronic musical instruments, all-pass filters are used in effectors (devices changing or providing effects to sound tone) called phasors or phase shifters (Non-Patent Document: "Konpyuta Ongaku—Rekishi, Tekunorogi, Ato (The Computer Music Tutorial)", Curtis Roads, translated and edited by Aoyagi Tatsuya et al., Tokyo Denki University Press, page 353). The all-pass filter 26 according to the modification is characterized in that a shift amount of phase (phase shift amount) is variable.

According to an input from the emphasis utterance section detection unit, the switch 27 switches whether or not an output of the all-pass filter 26 is provided to the adder 28.

The adder 28 is a processing unit that adds the output signals of the all-pass filter 26 to the signals of the input speech (input speech waveform).

The processing performed by the voice emphasizing device having the above-described structure is described with reference to FIG. 18.

Firstly, the speech input unit 11 receives an input speech waveform (Step S11), and provides the received waveform to the emphasis utterance section detection unit 12.

The emphasis utterance section detection unit 12 specifies a strained-rough-voice section by detecting a section having amplitude fluctuation in the input speech waveform, in the same manner as described in the first embodiment (Step S12).

The strained-rough-voice emphasis determination unit 16 calculates a modulation ratio of the original amplitude fluctuation in the strained-rough-voice section (Step S13), and determines whether or not the modulation ratio is smaller than a predetermined reference value (Step S14). If the modulation ratio of the original amplitude fluctuation is smaller than the reference value (Yes at Step S14), then the strained-rough-voice emphasis determination unit 16 provides the switch 27 with switch signals indicating the strained-rough-voice section is a strained-rough-voice target section.

If voice signals provided to the voice emphasizing unit 13 are included in the strained-rough-voice target section determined by the emphasis utterance section detection unit 12, the switch 27 connects the all-pass filter 26 to the adder 28 (Step S27).

The periodic signal generation unit 17 generates signals of a sine wave having a frequency of 80 Hz (Step S15), and provides the generated signals to the all-pass filter 26. The all-pass filter 26 controls a shift amount of phase according to the signals of the sine wave having a frequency of 80 Hz provided from the periodic signal generation unit 17 (Step S26).

The adder 28 adds the output of the all-pass filter 26 to signals of a voice waveform of the strained-rough-voice target section (Step S28). The speech output unit 14 outputs the voice waveform added with the output of the all-pass filter 26 (Step S18).

The voice signals outputted from the all-pass filter 26 is phase-shifted. Therefore, harmonic components with antiphase and the input voice signals which are not converted negate each other. The all-pass filter 26 periodically fluctuates a shift amount of phase according to the signals having the sine wave having a frequency of 80 Hz provided from the periodic signal generation unit 17. Therefore, by adding the output of the all-pass filter 26 to the voice signals of the voice waveform, an amount which the signals negate each other is periodically fluctuated at a frequency of 80 Hz. As a result, signals resulting from the addition has an amplitude periodically fluctuated at a frequency of 80 Hz.

On the other hand, if the modulation ratio is equal to or greater than the reference value (No at Step S14), then the switch 27 disconnects the all-pass filter 26 from the adder 28. Thereby, the voice signals are provided to the speech output unit 14 without being applied with any processing. The speech output unit 14 outputs the voice waveform (Step S18).

The above described processing (Steps S11 to S18) is repeated, for example, at predetermined time intervals.

With the above structure, the voice emphasizing device according to the modification detects a section having amplitude fluctuation from the input speech waveform, like the first embodiment. If a modulation ratio of the amplitude fluctuation in the detected section is large enough, any processing is not performed on a voice waveform of the section. If the modulation ratio is not large enough, then modulation including amplitude fluctuation is performed on the voice waveform of the section in order to compensate for the original amplitude fluctuation that is inadequate to express the voice of the section. Thereby, in an input speech, a "strained rough voice" expression at a portion where a speaker intends to emphasize, a portion where the speaker intends to provide musical expression of a "strained rough voice" or "unari (growling or groaning voice)", or at a portion uttered forcefully is emphasized to adequately convey the expression to listeners. As a result, the voice emphasizing device according to the modification can enhance expressiveness of the input speech.

Furthermore, signals with a phase shift amount periodically fluctuated by the all-pass filter are added to the original waveform to perform amplitude fluctuation. Thereby, the resulting amplitude fluctuation can be perceived as more natural voice. This means that the phase fluctuation generated by the all-pass filter is not uniform to frequency. Thereby, in various frequency components included in the speech, there are components having values to be increased and components having values to be decreased. While in the first embodiment all frequency components have uniform amplitude fluctuation, in the present modification the amplitude is fluctuated differently depending on frequency components. Thereby, in the modification, more complicated amplitude fluctuation can be achieved thereby providing advantages that damage on naturalness in listening can be prevented.

It should be noted that it has been described in the modification that at Step S15 the periodic signal generation unit 17 generates signals of a sine wave having a frequency of 80 Hz, but the present invention is not limited to the above. For example, like the first embodiment, the frequency may be any frequency in a range of 40 Hz to 120 Hz depending on distribution of a fluctuation frequency of an amplitude envelope, and the periodic signal generation unit 17 may generate periodic signals not having a sine wave.

(Second Embodiment)

The second embodiment differs from the first embodiment in emphasizing original amplitude fluctuation of a portion which does not adequately express musical expression of a "strained rough voice" or "unari (growling or groaning voice)" in an input speech.

Figure 19:
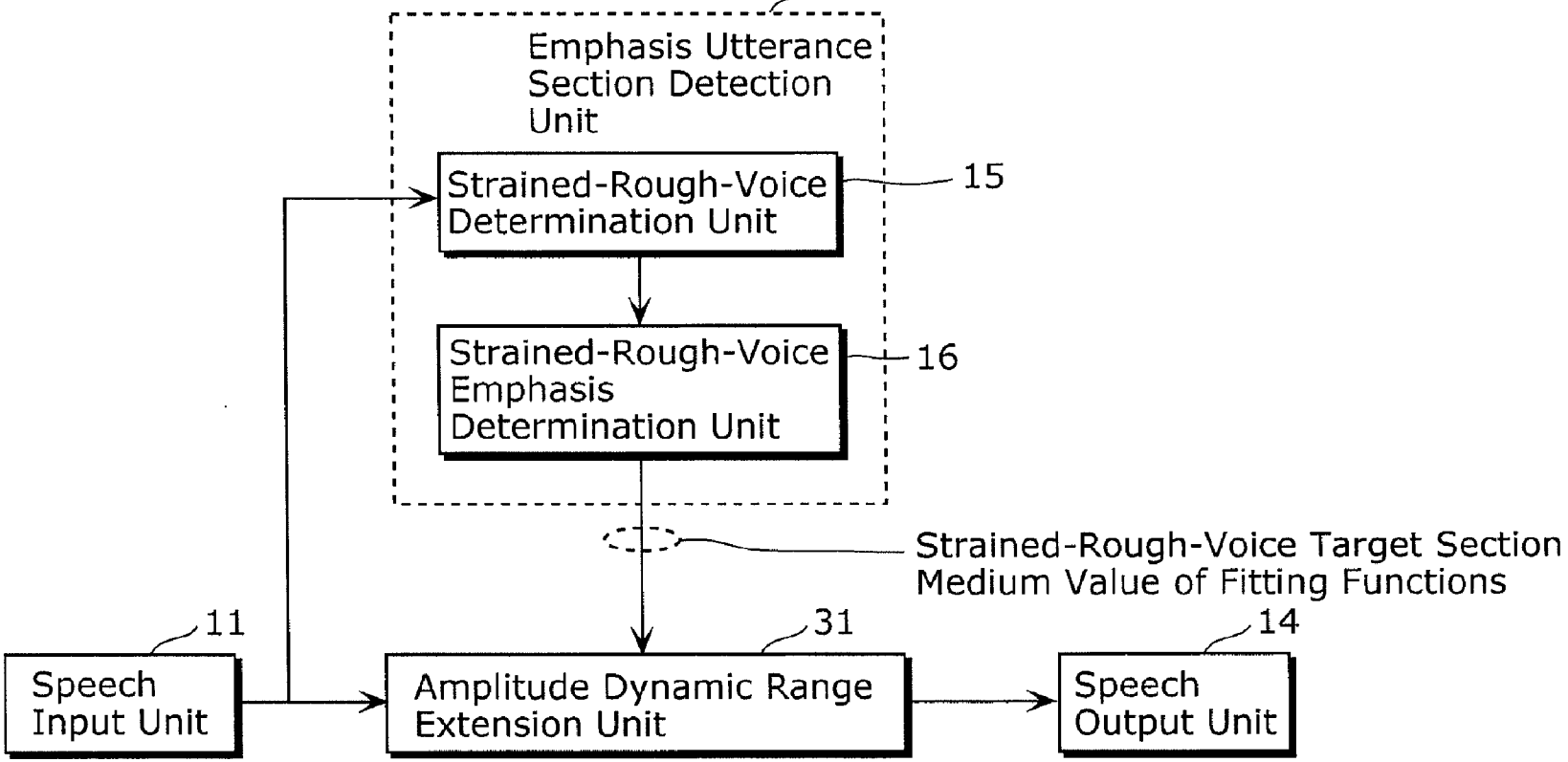
FIG. 19 is a functional block diagram showing a structure of a voice emphasizing device according to a second embodiment of the present invention.
Figure 20:
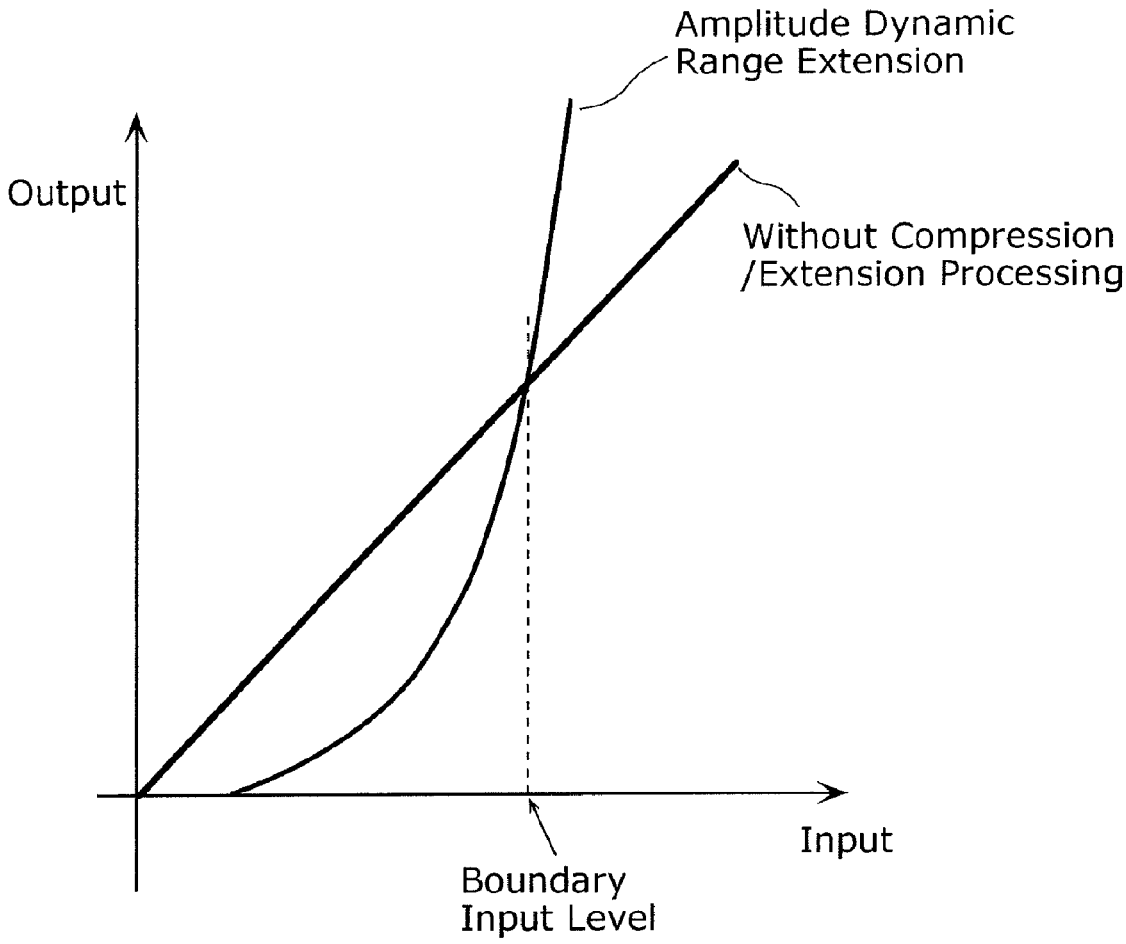
FIG. 20 is graph showing an example of input-output characteristics of an amplitude dynamic range extension unit 31 of the voice emphasizing device according to the second embodiment of the present invention.
Figure 21:
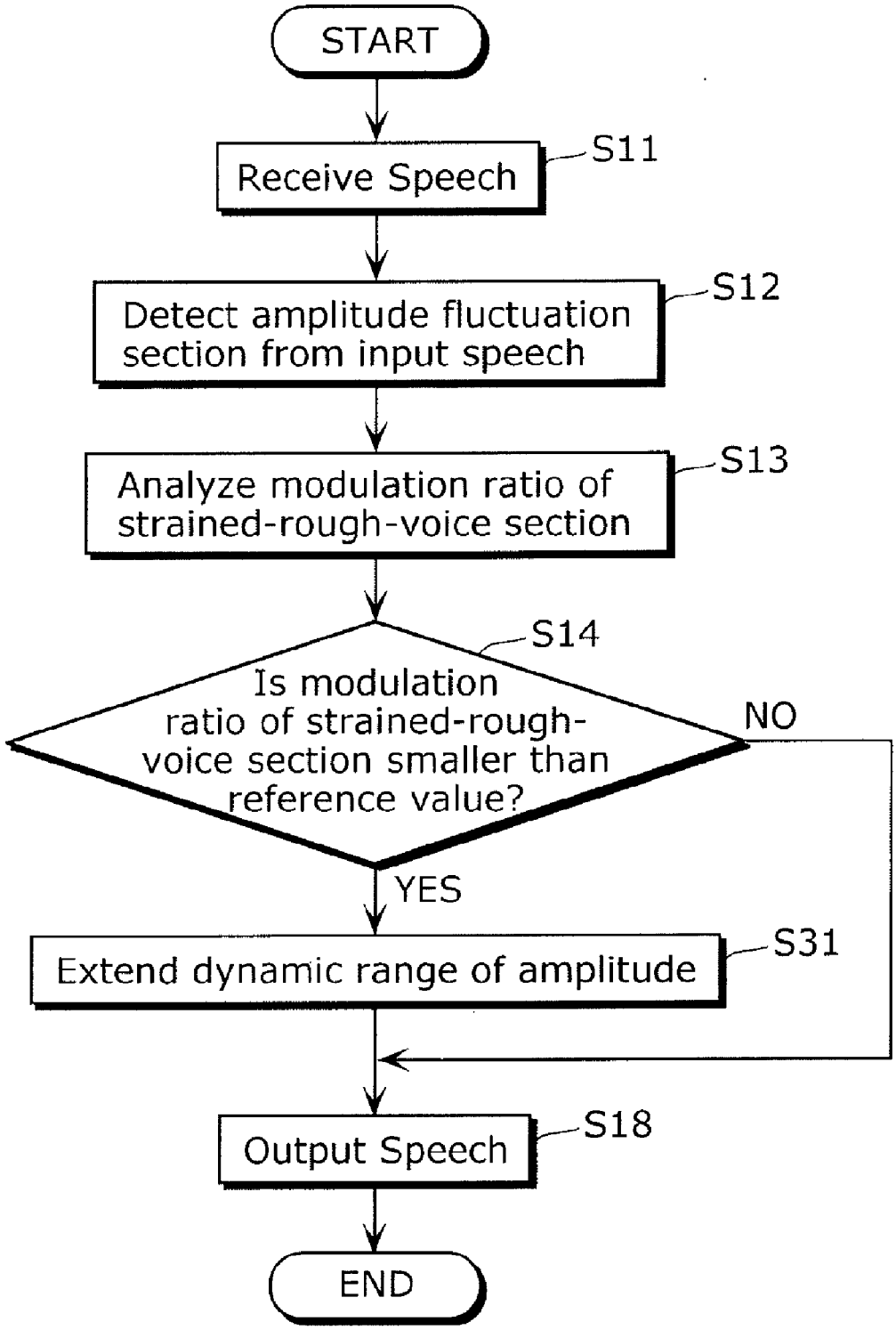
FIG. 21 is a flowchart of processing performed by the voice emphasizing device according to the second embodiment of the present invention.

FIG. 19 is a functional block diagram of a voice emphasizing device according to the second embodiment of the present invention. FIG. 20 is a graph schematically plotting input-output characteristics of an amplitude dynamic range extension unit 31 according to the second embodiment. FIG. 21 is a flowchart of processing performed by the voice emphasizing device according to the second embodiment. Here, the same reference numerals of FIGS. 12 and 14 are assigned to the identical units and steps of FIGS. 19 and 21, so that the identical units and steps are not explained again below As shown in FIG. 19, the voice emphasizing device according to the second embodiment includes the speech input unit 11, the emphasis utterance section detection unit 12, an amplitude dynamic range extension unit 31, and the speech output unit 14. The voice emphasizing device according to the second embodiment has a structure similar to the structure of the voice emphasizing device according to the first embodiment of FIG. 12. The voice emphasizing device according to the second embodiment differs from the voice emphasizing device according to the first embodiment only in that the voice emphasizing unit 13 is replaced by the amplitude dynamic range extension unit 31. Therefore, the description of the speech input unit 11, the emphasis utterance section detection unit 12, and the speech output unit 14 is not given again below.

The amplitude dynamic range extension unit 31 is a processing unit that receives an input speech waveform received by the speech input unit 11, and compresses and amplifies an amplitude of the input speech waveform according to information of a strained-rough-voice target section (strained-rough-voice target section information) and information of an amplitude modulation ratio (amplitude modulation ratio information) which are provided from the emphasis utterance section detection unit 12 in order to extend an amplitude dynamic range of the input speech waveform.

As shown in FIG. 20, the amplitude dynamic range extension unit 31 compresses an amplitude of a voice waveform of a target section when the amplitude is smaller than a boundary input level that is determined based on the amplitude modulation ratio information provided from the emphasis utterance section detection unit 12, and amplifies the amplitude when the amplitude is equal to or greater than the boundary input level. Thereby, the amplitude dynamic range extension unit 31 emphasizes the original fluctuation of the amplitude.

Next, the processing performed by the voice emphasizing device having the above-described structure is described with reference to FIG. 21.

Firstly, the speech input unit 11 receives an input speech waveform (Step S11), and provides the received waveform to the emphasis utterance section detection unit 12.

The strained-rough-voice determination unit 15 in the emphasis utterance section detection unit 12 specifies a strained-rough-voice section by detecting a section having amplitude fluctuation in the input speech waveform in the same manner as described in the first embodiment (Step S12).

Next, the strained-rough-voice emphasis determination unit 16 calculates a modulation ratio of the original amplitude fluctuation of the strained-rough-voice section (Step S13). The strained-rough-voice emphasis determination unit 16 determines whether or not the calculated modulation ratio is smaller than a predetermined reference value (Step S14).

If the determination is made that the modulation ratio is smaller than the reference value (YES at Step S14), then the strained-rough-voice emphasis determination unit 16 determines that the modulation ratio of the original amplitude fluctuation of the strained-rough-voice section is not enough. The strained-rough-voice emphasis determination unit 16 determines the strained-rough-voice section as a strained-rough-voice target section. In addition, the strained-rough-voice emphasis determination unit 16 provides the amplitude dynamic range extension unit 31 with information of the determined section (section information) and a medium value of values of the polynomial expression fitted at Step S13. For the section determined as a strained-rough-voice target section in the input speech waveform, the amplitude dynamic range extension unit 31 determines a boundary input level based on the medium value of the polynomial expression calculated by the strained-rough-voice emphasis determination unit 16 in order to set input-output characteristics as shown in FIG. 20. The amplitude dynamic range extension unit 31 compresses and amplifies amplitudes of the strained-rough-voice target section using the input-output characteristics thereby extending the amplitude dynamic range of a voice waveform of the strained-rough-voice target section (Step S31), so that the modulation ratio of the "strained rough voice" having periodic fluctuation of amplitude is increased to be enough to express the "strained rough voice". The speech output unit 14 outputs the voice waveform with the emphasized amplitude (Step S18).

On the other hand, if the determination is made that the modulation ratio is equal to or greater than the reference value (NO at Step S14), then the amplitude dynamic range extension unit 31 sets input-output characteristics by which the amplitude of the strained-rough-voice section is not compressed and amplified, then does not transform the amplitude and provides a voice waveform of the section to the speech output unit 14. The speech output unit 14 outputs the received voice waveform (Step S18).

The above described processing (Steps S11 to S18) is repeated, for example, at predetermined time intervals.

At Step S31, the amplitude dynamic range extension unit 31 uses the observation that an amplitude of the second harmonic is approximately one tenth of an amplitude of a voice waveform. More specifically, the amplitude dynamic range extension unit 31 calculates the boundary input level of FIG. 20 by multiplying, by 10, a medium value of a fitting function of an amplitude envelope of the second harmonic provided from the strained-rough-voice emphasis determination unit 16, namely, a medium value of values of the fitting of FIG. 3A. Thereby, basically, the boundary input level is set so that when the amplitude fluctuation shown by a curve in FIG. 3B is positive, the amplitude is amplified, and when the amplitude fluctuation is negative, the amplitude is compressed.

Figure 22:
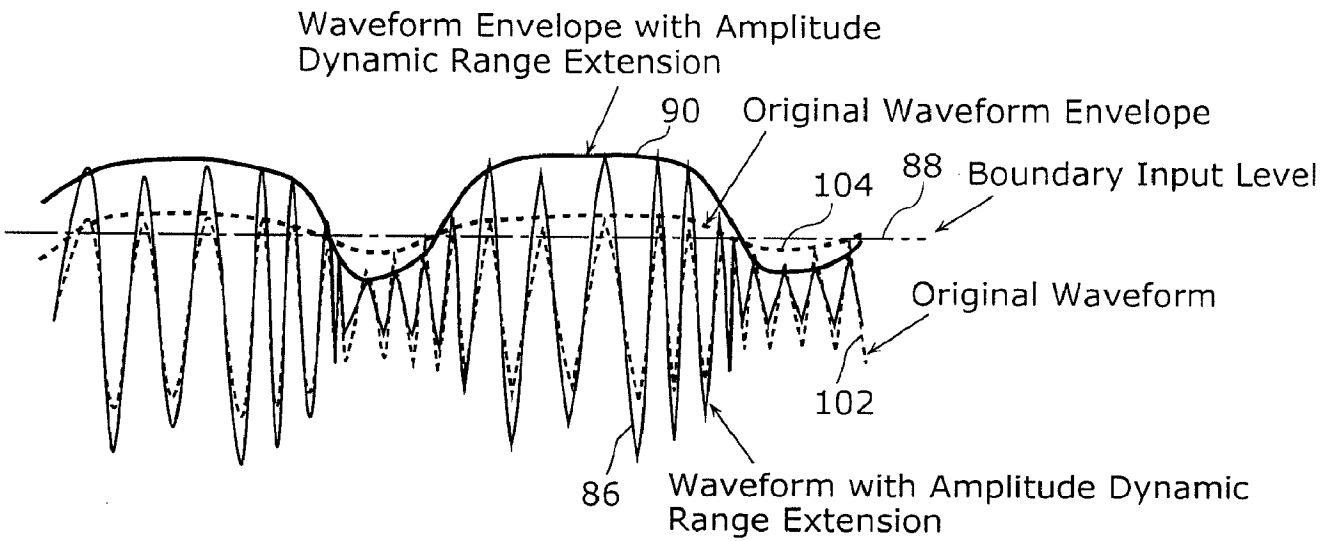
FIG. 22 is a graph for explaining in detail how the amplitude dynamic range extension unit sets a boundary level.

FIG. 22 is a graph for explaining in more detail how the amplitude dynamic range extension unit 31 sets the boundary level. In FIG. 22, a voice waveform 102 provided to the amplitude dynamic range extension unit 31 is shown by a dashed line. In addition, an amplitude envelope 104 of the second harmonic of the voice waveform 102 is shown by a dotted line. A boundary input level 88 is assumed to have a value of ten times as much as a medium value of the amplitude envelope 104, and is shown by a dash-dotted line. Here, when a value of the amplitude envelope 104 is compared with the boundary input level 88, at time where the value of the amplitude envelope 104 is equal to or smaller than the boundary input level 88, the amplitude dynamic range extension unit 31 compresses the amplitude of the voice waveform 102. On the other hand, at time where the value of the amplitude envelope 104 is greater than the boundary input level 88, the amplitude dynamic range extension unit 31 amplifies the amplitude of the voice waveform 102. The compression and amplification of the amplitude of the voice waveform 102 by the amplitude dynamic range extension unit 31 generates a voice waveform 86. When the voice waveform is compared with the voice waveform 102, at a portion where a value of the amplitude envelope 104 is equal to or smaller than the boundary input level 88, the amplitude of the voice waveform 86 is smaller than the amplitude of the voice waveform 102. On the other hand, at a portion where a value of the amplitude envelope 104 is greater than the boundary input level 88, the amplitude of the voice waveform 86 is larger than the amplitude of the voice waveform 102. Therefore, in the voice waveform 86, a difference of amplitude (namely, dynamic range) between a portion having the largest amplitude and a portion having the smallest amplitude is greater than a dynamic range of the voice waveform 102. This is proved by comparing an amplitude envelope 90 of the voice waveform 86 to the amplitude envelope 104 of the voice waveform 102. Moreover, the amplitude dynamic range extension unit 31 performs not merely amplification of the amplitude of the voice waveform 102. At a portion with small amplitude in the voice waveform 102, the amplitude dynamic range extension unit 31 compresses the amplitude of the portion. Therefore, the amplitude dynamic range extension unit 31 can generate the voice waveform 86 to have a greater difference (dynamic range) between a maximum value of the amplitude and a minimum value of the amplitude, than the situation where the amplitude of the voice waveform 102 is merely amplified.

Figure 23:
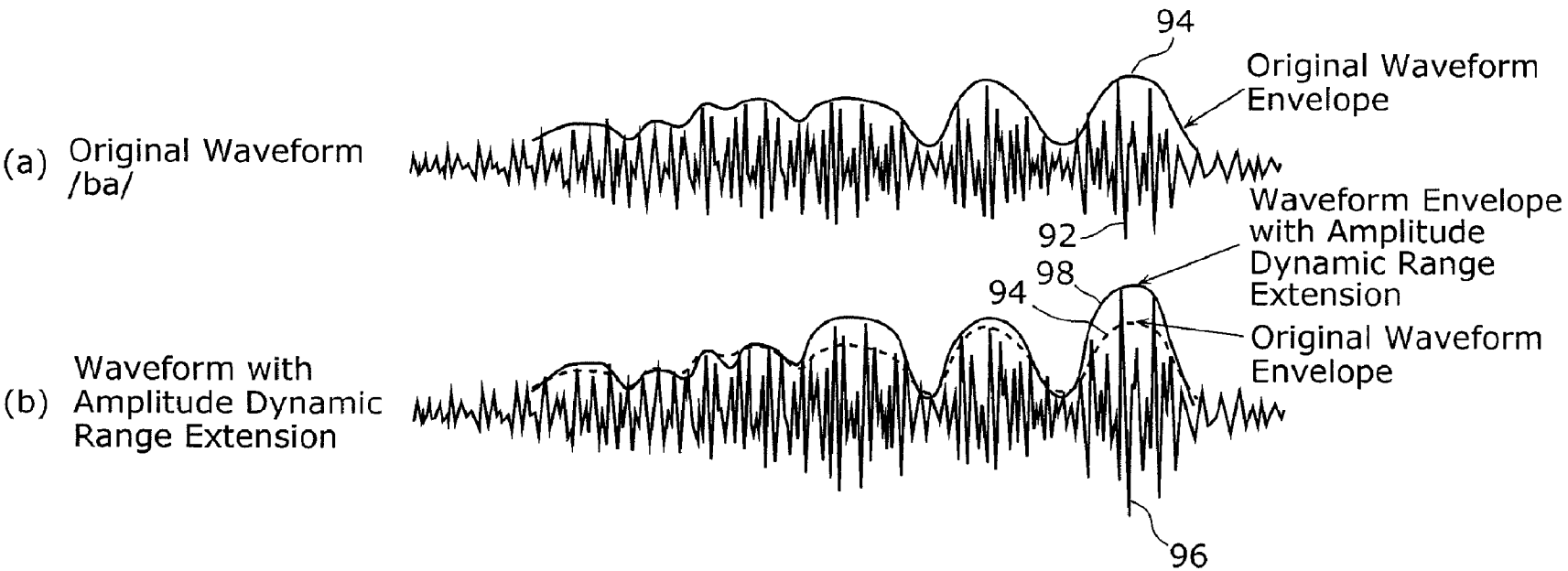
FIG. 23 is diagrams for explaining results of extending a dynamic range of an amplitude of an actual voice waveform by the amplitude dynamic range extension unit.

FIG. 23 is diagrams for explaining results of extending a dynamic range of an amplitude of an actual voice waveform by the amplitude dynamic range extension unit 31. FIG. 23 (*a*) is a diagram showing a voice waveform 92 of an utterance /ba/ and an envelope 94 of the voice waveform 92. FIG. 23 (*b*) is a diagram showing a voice waveform 96 generated by extending a dynamic range of an amplitude of the voice waveform 92 shown in FIG. 23 (*a*) in the amplitude dynamic range extension unit 31, and an envelope 98 of the voice waveform 96. As shown in comparison of the envelope 94 to the envelope 98, the voice waveform 96 has an amplitude dynamic range extended more than that of the voice waveform 92.

With the above structure, the voice emphasizing device according to the second embodiment can detect a section having amplitude fluctuation from an input speech, and if a modulation ratio of the amplitude fluctuation is large enough, then does not perform any processing on the section, and if the modulation ratio is not large enough, then performs amplitude fluctuation on a voice waveform of the section. Thereby, the original amplitude fluctuation inadequate to express the voice of the section is emphasized enough to express the voice. As a result, the voice emphasizing device according to the second embodiment can enhance or emphasize expression at a portion where a speaker intends to emphasize or provide musical expression of a "strained rough voice" or "unari (growling or groaning voice)", or expression of a "strained rough voice" at a portion uttered forcefully, so that the expression of the portion can be adequately conveyed to listeners. In addition, as strained-rough-voice processing, the voice emphasizing device according to the second embodiment emphasizes original amplitude fluctuation of a voice waveform of a speaker. Thereby, it is possible to enhance expressiveness of the input speech while keeping individual characteristics of the speaker. As a result, the resulting speech can be perceived as more natural speech. In other words, such simple processing can provide the input speech with a voice waveform or musical expression having expression conveying emphasis or tension using original characteristics of the input speech.

It should be noted that it has been described in the second embodiment that at Step S31 the amplitude dynamic range extension unit 31 changes input-output characteristics to compress and amplify an amplitude of a target section to extend an amplitude dynamic range if a modulation ratio of the section is smaller than the reference value at Step S14. It has also been described in the second embodiment that the amplitude dynamic range extension unit 31 does not change the input-output characteristics to compress and amplify the amplitude if the modulation ratio is equal to or greater than the reference value at Step S14. However, it is also possible to provide a route in the voice emphasizing device according to the second embodiment so that the speech input unit 11 is connected directly to the speech output unit 14 without passing the amplitude dynamic range extension unit 31. In the above structure, a switch may be provided to switch whether an voice waveform of a target section is provided to the amplitude dynamic range extension unit 31 or directly to the speech output unit 14. If at Step S14 the modulation ratio is smaller than the reference value, then the switch connects the speech input unit 11 to the amplitude dynamic range extension unit 31 in order to extend an amplitude dynamic range of the voice waveform. On the other hand, if at Step S14 the modulation ratio is equal to or greater than the reference value, then the switch connects the speech input unit 11 directly to the speech output unit 14 without passing the amplitude dynamic range extension unit 31, so that the voice waveform is outputted without being applied with any processing. In the above case, the input-output characteristics of the amplitude dynamic range extension unit 31 may be fixed as the input-output characteristics shown in FIG. 20.

It should also be noted that it has been described in the second embodiment that at Step S31 the amplitude dynamic range extension unit 31 determines the boundary input level based on a medium value of values of a fitting function corresponding to an amplitude envelope of the second harmonic, but the present invention is not limited to the above. For example, if the strained-rough-voice determination unit 15 uses a sound source waveform or a fundamental wave to analyze an amplitude fluctuation frequency, the amplitude dynamic range extension unit 31 may determine the boundary input level using values of a fitting function corresponding an amplitude envelope of the sound source waveform or the fundamental wave. Furthermore, if an amplitude envelope of a voice waveform is determined using full-wave rectification of the voice waveform, the amplitude dynamic range extension unit 31 may determine a boundary input level using any value that can divide the amplitude envelope into up and down, such as values of a fitting function corresponding to results of the full-wave rectification or an average value of the results of the full-wave rectification.

(Third Embodiment)

In the third embodiment, a portion of a "strained rough voice" or "unari (growling or groaning voice)" in a speech is detected using a pressure sensor.

Figure 24:
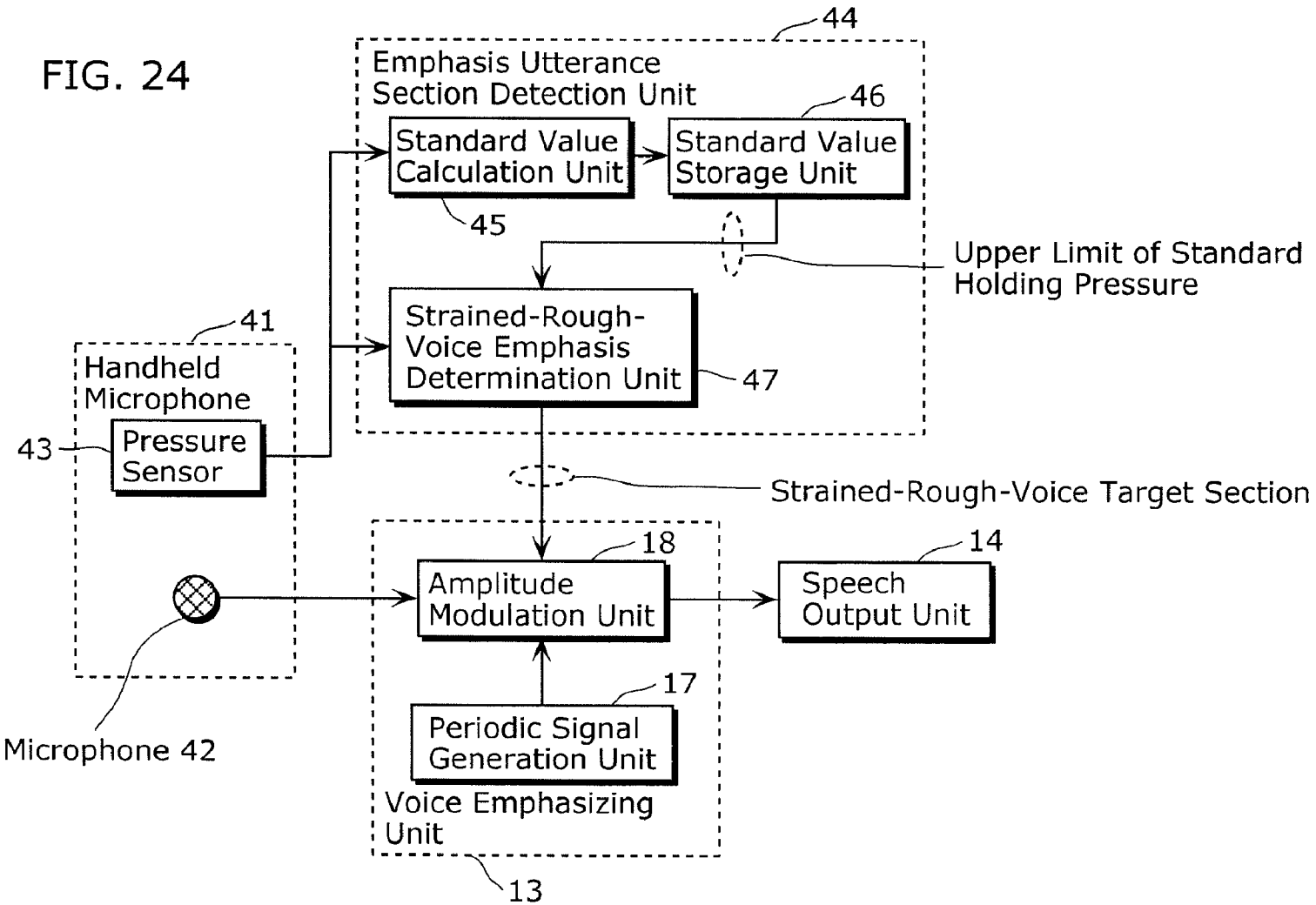
FIG. 24 is a functional block diagram showing a structure of a voice emphasizing device according to a third embodiment of the present invention.
Figure 25:
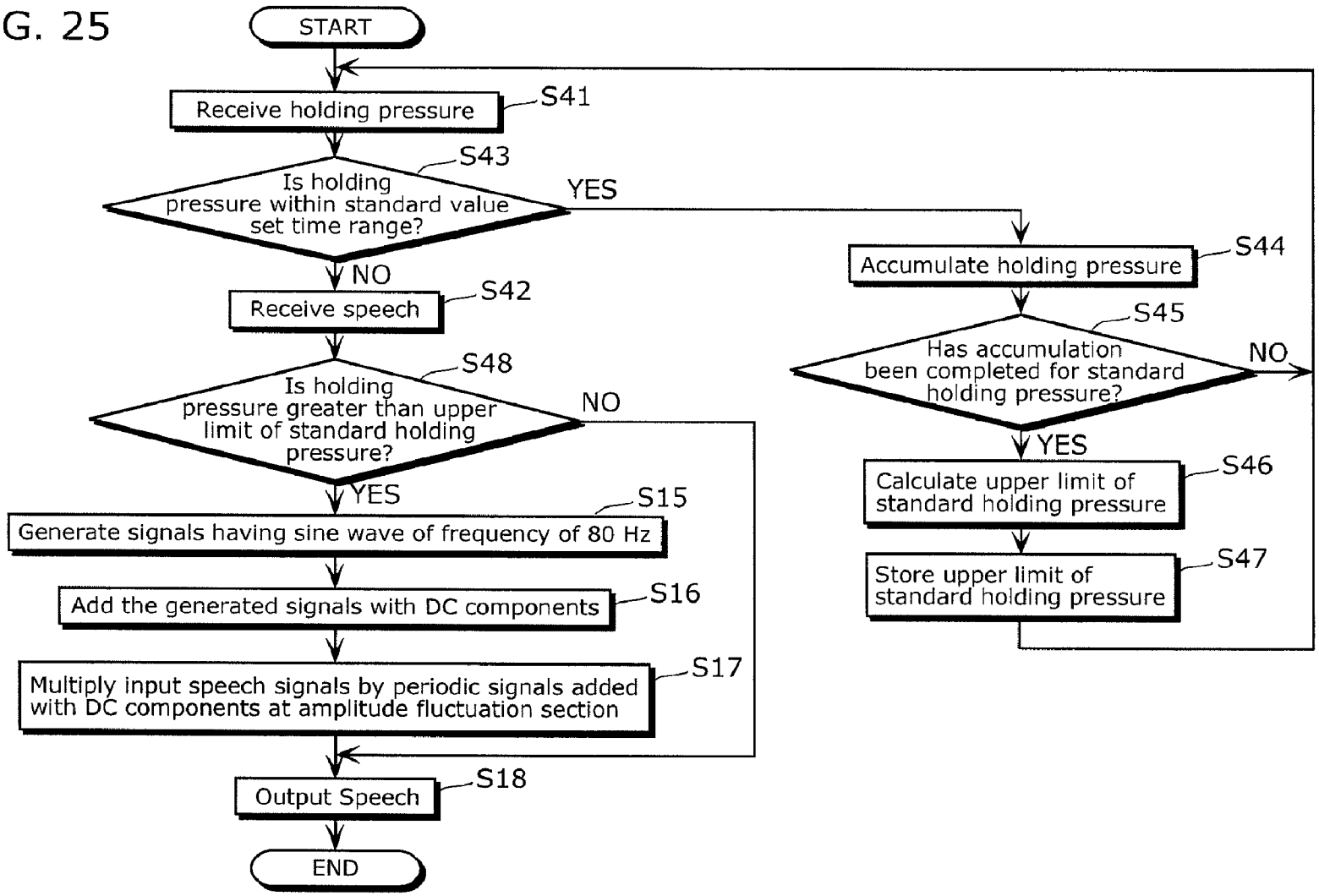
FIG. 25 is a flowchart of processing performed by the voice emphasizing device according to the third embodiment of the present invention.

FIG. 24 is a functional block diagram of a voice emphasizing device according to the third embodiment of the present invention. FIG. 25 is a flowchart of processing performed by the voice emphasizing device according to the third embodiment. Here, the same reference numerals of FIGS. 12 and 14 are assigned to the identical units and steps of FIGS. 24 and 25, so that the identical units and steps are not explained again below.

As shown in FIG. 24, the voice emphasizing device according to the third embodiment includes a handheld microphone 41, an emphasis utterance section detection unit 44, the voice emphasizing unit 13, and the speech output unit 14.

The voice emphasizing unit 13 and the speech output unit 14 according to the third embodiment are identical to the voice emphasizing unit 13 and the speech output unit 14 according to the first embodiment, so that the description of these units are not given again below.

The handheld microphone 41 includes a pressure sensor 43 and a microphone 42. The pressure sensor 43 detects a pressure of holding the handheld microphone 41 by a user. The microphone 42 receives a speech (voice) of the user as an input.

The emphasis utterance section detection unit 44 includes a standard value calculation unit 45, a standard value storage unit 46, and a strained-rough-voice emphasis determination unit 47.

The standard value calculation unit 45 is a processing unit that receives a value of user's holding pressure (hereinafter, referred to as "holding pressure" or "holding pressure information") from the pressure sensor 43, calculates a standard range of the holding pressure (hereinafter, referred to as "standard holding pressure"), and determines an upper limit of the standard holding pressure.

The standard value storage unit 46 is a storage device in which the upper limit of the standard holding pressure determined by the standard value calculation unit 45 is stored. Examples of the standard value storage unit 46 are a memory, a hard disk, and the like.

The strained-rough-voice emphasis determination unit 47 is a processing unit that receives an output of the pressure sensor 43, compares a value of holding pressure measured by the pressure sensor 43 to the upper limit of the standard holding pressure stored in the standard value storage unit 46, and then determines whether or not a voice of a target section corresponding to the measured value is to be applied with strained-rough-voice processing.

Next, the processing performed by the voice emphasizing device having the above-described structure is described with reference to FIG. 25.

Firstly, when a user holds the handheld microphone, the pressure sensor 43 measures a pressure of the user's holding (Step S41).

Here, a predetermined time period prior to uttering a speech and a predetermined time period immediately after uttering the speech, and a prelude section prior to playing music, a prelude section prior to singing a song, and an interlude section are defined as standard value set time ranges. If a target section is within the standard value set time range (YES at Step S43), then the holding pressure information measured by the pressure sensor 43 is provided to the standard value calculation unit 45 to be accumulated (Step S44).

If pieces of the holding pressure information enough to calculate a standard holding pressure have already been accumulated (YES at Step S45), then the standard value calculation unit 45 calculates an upper limit of the standard holding pressure (Step S46). The upper limit of the standard holding pressure is, for example, a value generated by adding a standard difference to an average value of values of holding pressure within the standard value set time range. For example, the upper limit of the standard holding pressure is set to a value of 90% of a maximum value of the holding pressure within the standard value set time range. The standard value calculation unit 45 stores the upper limit of the standard holding pressure calculated at Step S46 to the standard value storage unit 46 (Step S47). On the other hand, if at Step S45 pieces of the holding pressure information have not yet been accumulated enough to calculate the standard holding pressure (NO at Step S45), then the processing returns to Step S41 to receive a next input from the pressure sensor 43. When the standard holding pressure is calculated using pieces of holding pressure information regarding a prelude section and an interlude section, the standard value calculation unit 45 specifies the prelude section and the interlude section with reference to music information in a Karaoke system, then sets them as standard value set time ranges to calculate a standard holding pressure.

If time of a target section is not within the standard value set time range (NO at Step S43), then the corresponding holding pressure information measured by the pressure sensor 43 is provided to the strained-rough-voice emphasis determination unit 47.

The microphone 42 obtains a speech uttered by the user (Step S42), and then provides the speech as an input speech waveform to the amplitude modulation unit 18.

The strained-rough-voice emphasis determination unit 47 compares the upper limit of the standard holding pressure stored in the standard value storage unit 46 to the value of the holding pressure measured by the pressure sensor 43 (Step S48). If the value of the holding pressure is greater than the upper limit of the standard holding pressure (YES at Step S48), then the strained-rough-voice emphasis determination unit 47 provides a section synchronized with (corresponding to) the measured holding pressure to the amplitude modulation unit 18 as a strained-rough-voice target section.

The periodic signal generation unit 17 generates signals having a sine wave having a frequency of 80 Hz (Step S15), and then adds the generated signals with direct current (DC) components to generate signals (Step S16). For the section determined as a strained-rough-voice target section since the holding pressure information (the measured holding pressure) synchronized with (corresponding to) a voice waveform of the section is greater than the upper limit of the standard holding pressure at Step 548, the amplitude modulation unit 18 performs amplitude modulation by multiplying signals of the section in the input speech waveform by the periodic signals generated by the periodic signal generation unit 17 to vibrate with a frequency of 80 Hz (Step S17), in order to convert a voice of the section to a "strained rough voice" including the periodic fluctuation of amplitude. The speech output unit 14 outputs the converted voice waveform (Step S18).

If the value of the holding pressure is equal to or less than the upper limit of the standard holding pressure (NO at Step S48), then the amplitude modulation unit 18 does not perform any processing on a voice waveform of a section synchronized with (corresponding to) the holding pressure, and provides the voice waveform to the speech output unit 14. The speech output unit 14 outputs the received voice waveform (Step S18).

Since pieces of holding pressures are standardized for each user, initialization of holding pressure information is necessary when a user is changed to another. This can be achieved by receiving an input indicating change in users, by detecting a movement of the microphone 42 to initialize holding pressure information when the movement is still over a predetermined time period, or by initializing holding pressure information in Karaoke when music starts, for example.

The above described processing (Steps S41 to 518) is repeated, for example, at predetermined time intervals.

With the above structure, the voice emphasizing device according to the third embodiment detects a time period where a holding pressure of the user holding a handheld microphone is higher than a standard state and performs modulation including amplitude fluctuation on a voice waveform corresponding to the time period, thereby providing the voice waveform with emphasis of a "strained rough voice" or musical expression of a "unari (growling or groaning voice)". Thereby, it is possible to provide the expression of a "strained rough voice" or "unari (growling or groaning voice)" at a portion suitable for the emphasis or musical expression where the user utters or sings forcefully. As a result, the voice emphasizing device according to the third embodiment can provide emphasis or musical expression to user's forceful utterance or singing at a natural timing, thereby enhancing expressiveness of the user's voice.

It should be noted that it has been described in the third embodiment that at Step S15 the periodic signal generation unit 17 generates signals of a sine wave having a frequency of 80 Hz, but the present invention is not limited to the above. For example, the frequency may be any frequency in a range of 40 Hz to 120 Hz depending on distribution of a fluctuation frequency of an amplitude envelope, and the periodic signal generation unit 17 may generate periodic signals not having a sine wave. It should also be noted that the amplitude fluctuation is performed using an all-pass filter in the same manner as described in the modification of the first embodiment.

It should also be noted that it has been described in the third embodiment that the pressure sensor 43 is provided to the handheld microphone 41, but the present invention is not limited to the above. For example, instead of the handheld microphone 41, the pressure sensor is provided to a singing stage, a shoe, the bottom of a user's foot, or the like, in order to detect a pressure of stepping or stamping of the use's foot. It is also possible that the pressure sensor is provided to a belt wearing on an upper arm of a user to detect a pressure of closing underarm.

It should also be noted that it has been described in the third embodiment that an input speech waveform is inputted in synchronized with holding pressure information by the handheld microphone 41, but it is also possible to receive the input speech waveform and recorded holding pressure information separately if the recorded holding pressure information generated by the pressure sensor is recorded in synchronized with the input speech waveform.

(Fourth Embodiment)

In the fourth embodiment, a portion of a "strained rough voice" or "unari (growling or groaning voice)" in a speech is detected using a sensor detecting a movement of a larynx.

Figure 26:
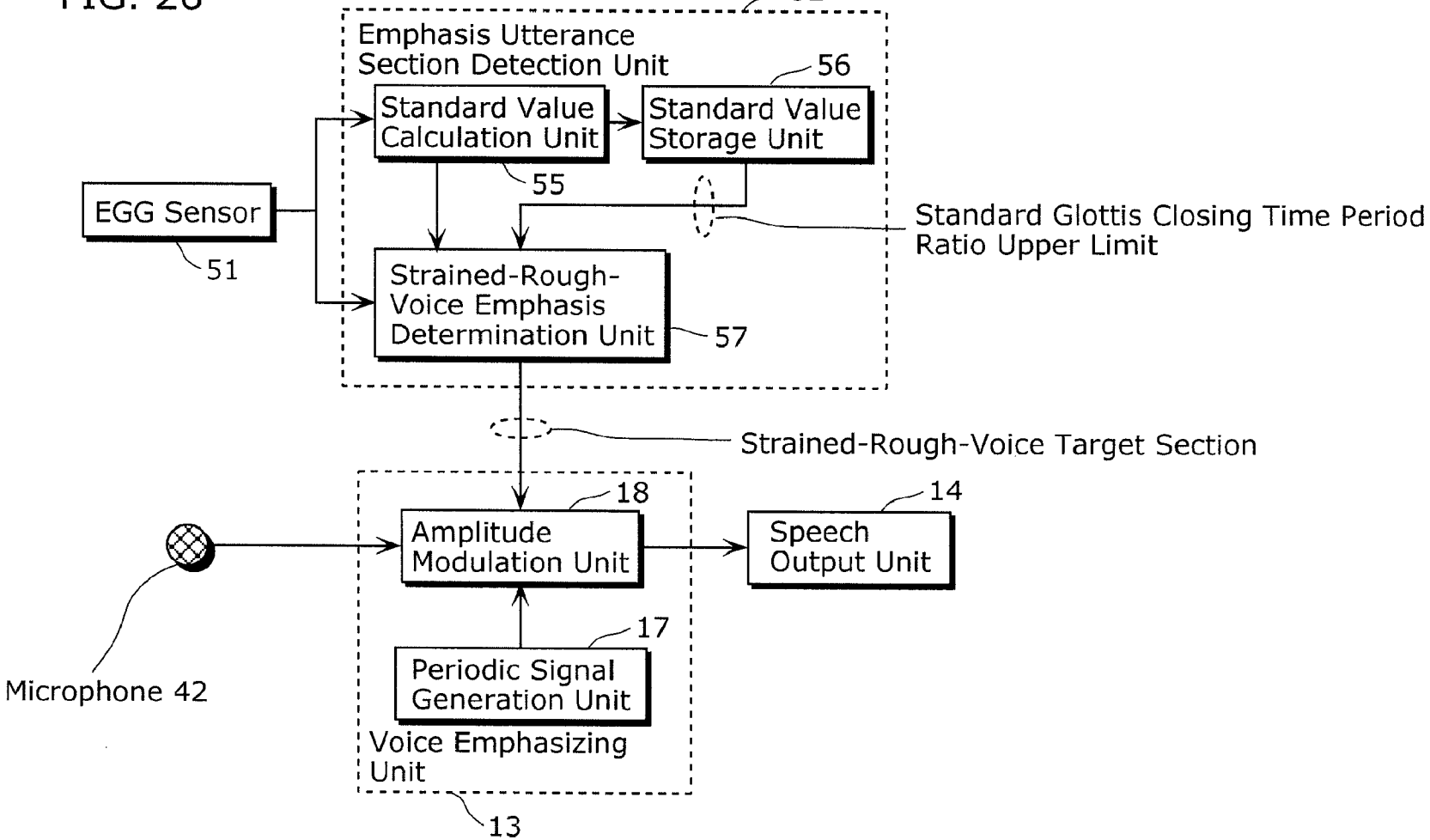
FIG. 26 is a functional block diagram showing a structure of a voice emphasizing device according to a fourth embodiment of the present invention.
Figure 27:
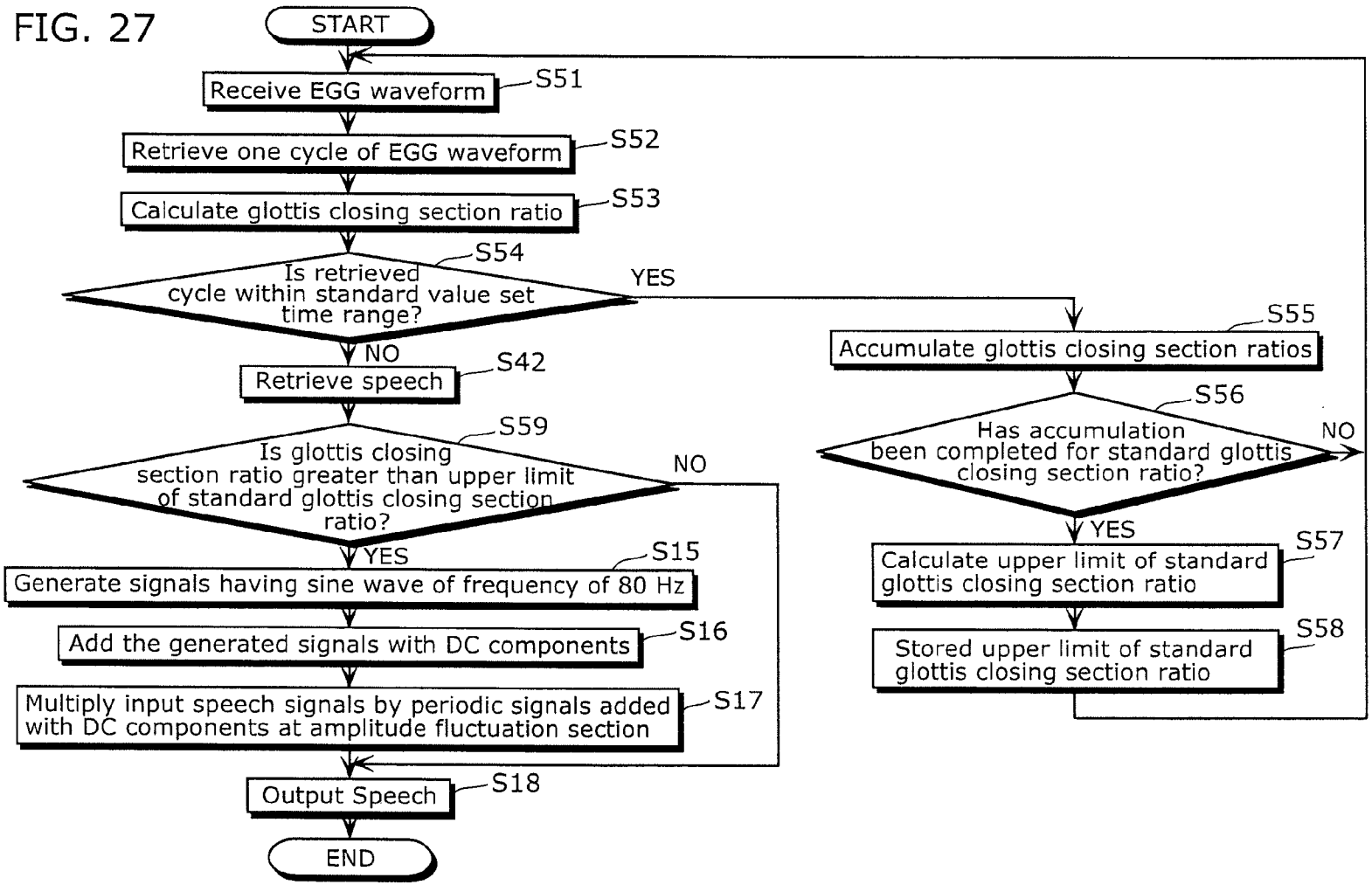
FIG. 27 is a flowchart of processing performed by the voice emphasizing device according to the fourth embodiment of the present invention.

FIG. 26 is a functional block diagram of a voice emphasizing device according to the fourth embodiment of the present invention. FIG. 27 is a flowchart of processing performed by the voice emphasizing device according to the fourth embodiment. Here, the same reference numerals of FIGS. 24 and 25 are assigned to the identical units and steps of FIGS. 26 and 27, so that the identical units and steps are not explained again below.

As shown in FIG. 26, the voice emphasizing device according to the fourth embodiment includes an Electroglottograph (EGG) sensor 51, a microphone 42, an emphasis utterance section detection unit 52, the voice emphasizing unit 13, and the speech output unit 14. The voice emphasizing unit 13 and the speech output unit 14 according to the fourth embodiment are the same as the voice emphasizing unit 13 and the speech output unit 14 according to the first embodiment, so that the description of these units are not given again below.

The EGG sensor 51 is a sensor that contacts on a skin of a user's neck to detect a movement of a larynx. The microphone 42 receives a speech of a user in the same manner as described in the third embodiment.

The emphasis utterance section detection unit 52 includes a standard value calculation unit 55, a standard value storage unit 56, and a strained-rough-voice emphasis determination unit 57.

The standard value calculation unit 55 receives an output of the EGG sensor 51, calculates a glottis closing section ratio in voiced utterance using an EGG waveform, and determines a lower limit of the ratio in standard utterance (hereinafter, referred to as a "standard glottis closing section ratio").

The standard value storage unit 56 is a storage device in which the lower limit of the standard glottis closing section ratio calculated by the standard value calculation unit 55 is stored. Examples of the standard value storage unit 56 are a memory, a hard disk, and the like.

The strained-rough-voice emphasis determination unit 57 is a processing unit that receives an output of the EGG sensor 51, compares a value of the output of the EGG sensor 51 to the lower limit of the standard glottis closing section ratio stored in the standard value storage unit 56, and then determines whether or not a voice of a section corresponding to the output of the EGG sensor 51 is to be applied with strained-rough-voice processing.

Next, the processing performed by the voice emphasizing device having the above-described structure is described with reference to the flowchart of FIG. 27.

Firstly, when a user utters a speech, the EGG sensor 51 generates an EGG waveform indicating movements of a larynx of the user (Step S51).

Figure 28:
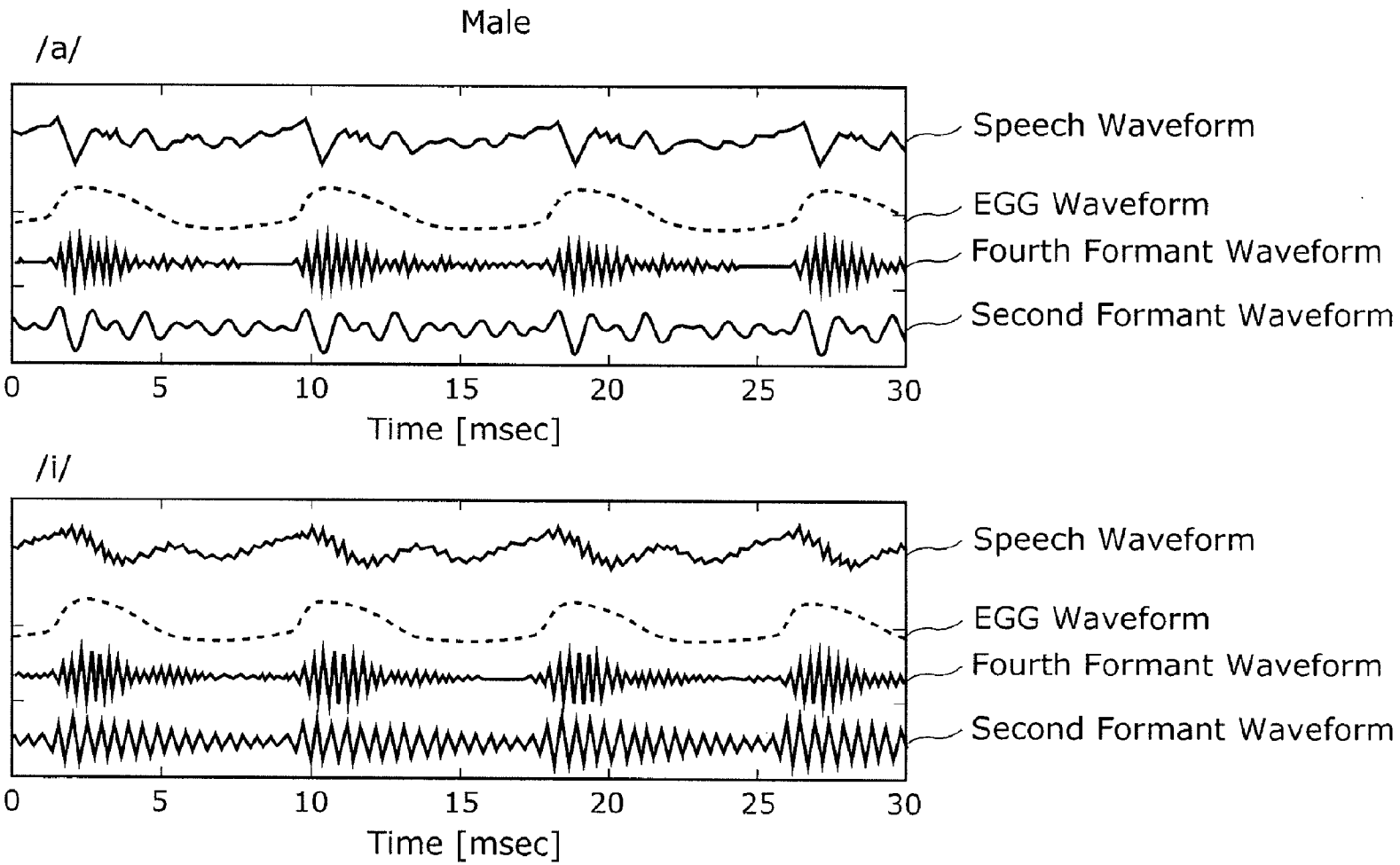
FIG. 28 shows graphs plotting examples of a sound waveform, an EGG waveform, and the fourth formant waveform regarding a male speaker shown in FIG. 5 of Japanese Unexamined Patent Application Publication No. 2007-68847.
Figure 29:
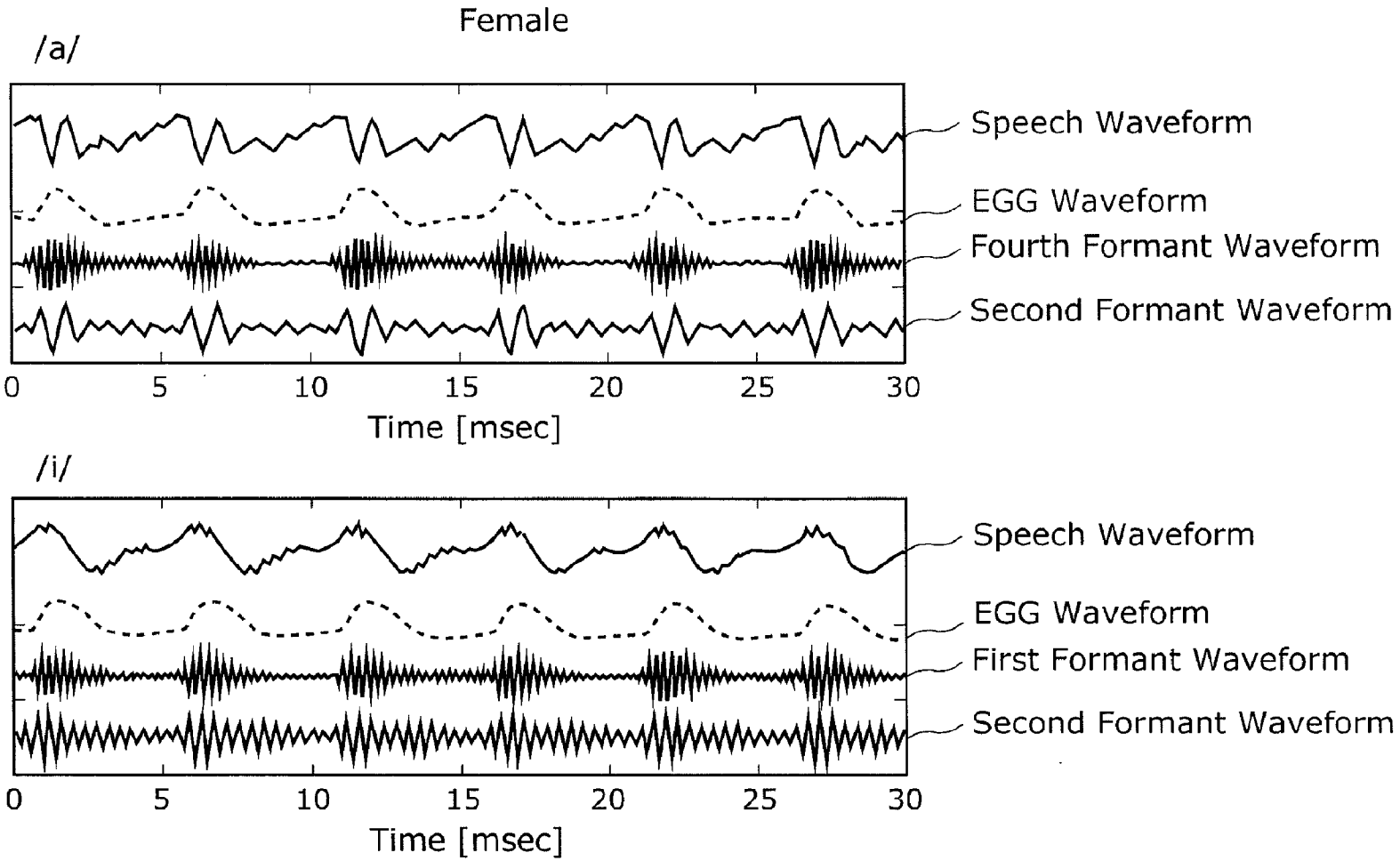
FIG. 29 shows graphs plotting examples of a sound waveform, an EGG waveform, and the fourth formant waveform regarding a female speaker shown in FIG. 6 of Japanese Unexamined Patent Application Publication No. 2007-68847.

The standard value calculation unit 55 receives the EGG waveform from the EGG sensor 51, and retrieves an EGG waveform of one cycle (period) of a fundamental period of a waveform of the input speech (input speech waveform). As disclosed in Patent Reference of Japan Unexamined Patent Application Publication No. 2007-68847, FIGS. 5 and 6, one cycle of an EGG waveform has a crest and a portion without any change as shown in FIGS. 28 and 29. One cycle is from the beginning of rising a crest to the beginning of rising a next crest. This crest portion is a period where a glottis is open (glottis open time period), and the portion without change is a period where the glottis is closed (glottis closing time period).

As a glottis closing section ratio, the standard value calculation unit 55 calculates a ratio of (i) a time period of a portion without any change in a single cycle to (ii) a time period of the single cycle. Setting a standard value set time range to a predetermined time period immediately after starting utterance or singing, for example five seconds, if time of retrieving the data of the EGG waveform is within the standard value set time range (YES at Step S54), then the glottis closing section ratio calculated at Step S53 is accumulated in the standard value calculation unit 55 (Step S55). It should be noted that the predetermined time period may be not five seconds, but eight seconds or more.

If the glottis closing section ratios have already been accumulated enough to calculate the standard glottis closing section ratio (YES at Step S56), then the standard value calculation unit 55 calculates an upper limit of the standard glottis closing section ratio (Step S57). The upper limit of the standard glottis closing section ratio has a value calculated, for example, by adding (i) a standard difference to (ii) an average value of the glottis closing section ratios within the standard value set time range. The standard value calculation unit 55 stores the upper limit of the standard glottis closing section ratio calculated at Step S57 to the standard value storage unit 56 (Step S58).

On the other hand, if the glottis closing section ratios have not yet been accumulated enough to calculate the standard glottis closing section ratio (NO at Step S56), then the processing returns to Step S51 and the standard value calculation unit 55 receives a next input from the EGG sensor 51.

On the other hand, if the time of retrieving the data of the EGG waveform is not within the standard value set time range (NO at Step S54), then the microphone 42 obtains a voice waveform uttered by the user and corresponding to the time and provides the obtained waveform to the amplitude modulation unit 18 as an input voice waveform (Step S42). Moreover, the glottis closing section ratio calculated at Step S53 is provided to the strained-rough-voice emphasis determination unit 57. The strained-rough-voice emphasis determination unit 57 compares (i) the upper limit of the standard glottis closing section ratio stored in the standard value storage unit 56 to (ii) the glottis closing section ratio calculated by the standard value calculation unit 55 (Step S59).

If the glottis closing section ratio is greater than the upper limit of the standard glottis closing section ratio (YES at Step S59), then the strained-rough-voice emphasis determination unit 57 provides the determined section as a strained-rough-voice target section to the amplitude modulation unit 18. It is known that a glottis is closed in a longer period if a larynx is strained (For example, Non-Patent Reference of "Acoustic analysis of pressed phonation using EGG", Carlos Toshinori ISHII, Hiroshi ISHIGURO, and Norihiro HAGITA, lecture papers of The Acoustical Society of Japan, 2007, spring, pp. 221-222, 2007). The situation where the glottis closing section ratio is greater than the upper limit of the standard glottis closing section ratio shows that the glottis is strained more than in the standard state.

The periodic signal generation unit 17 generates signals having a sine wave having a frequency of 80 Hz (Step S15), and then adds the generated signals with direct current (DC) components to generate signals (Step S16). For the section determined as a strained-rough-voice target section since the glottis closing section ratio of the EGG waveform synthesized with (corresponding to) a voice waveform of the determined section is greater than the standard glottis closing section ratio at Step S59, the amplitude modulation unit 18 multiplies the signals of the section by the periodic signals generated by the periodic signal generation unit 17 to vibrate with a frequency of 80 Hz (Step S17). Thereby, the amplitude modulation unit 18 performs amplitude fluctuation to convert a voice of the strained-rough-voice target section to a "strained rough voice" including the periodic fluctuation of amplitude. The speech output unit 14 outputs the converted voice waveform (Step S18).

If the glottis closing section ratio is equal to or smaller than the upper limit of the standard glottis closing section ratio (NO at Step S59), then the amplitude modulation unit 18 does not perform any processing on a voice waveform of a section synchronized with (corresponding to) the detected glottis closing time period, and outputs the voice waveform to the speech output unit 14 (Step S18).

The above described processing (Steps S51 to S18) is repeated, for example, at predetermined time intervals.

With the above structure, the voice emphasizing device according to the fourth embodiment detects a time period during which a glottis closing section ratio of the user uttering and singing is higher than a standard state and performs modulation including amplitude fluctuation on a voice waveform corresponding to the time period. Thereby, the voice emphasizing device according to the fourth embodiment provides the voice waveform with emphasis of a "strained rough voice" or musical expression of a "unari (growling or groaning voice)". As a result, it is possible to provide expression of a "strained rough voice" or "unari (growling or groaning voice)" to a portion where the user strains a larynx to emphasize or provide musical expression. As a result, the voice emphasizing device according to the fourth embodiment can provide emphasis or musical expression to a user's voice during a time period in which the user utters or sings forcefully. Furthermore, even if change in a voice waveform of a user's utterance is not enough to make listeners perceive the state where the user strains the utterance forcefully, the voice emphasizing device according to the fourth embodiment can enhance expressiveness of the utterance.

It should be noted that it has been described in the fourth embodiment that the standard value set time range of the glottis closing time ratio is set to five seconds after starting uttering or singing. However, if the voice emphasizing device according to the fourth embodiment is used in Karaoke systems, it is also possible to set a time period determined by specifying a singing section except a main theme in a music with reference to music data in the same manner as described in the third embodiment, and then set a standard value of the glottis closing time ratio according to singing sections except the section of the main theme. Thereby, musical expression in the main theme can be easily emphasized, thereby emphasizing highlight of the music.

It should also be noted that it has been described in the fourth embodiment that the glottis closing section ratio is calculated from the EGG waveform generated by the EGG sensor 51. However, as disclosed in the Patent Reference of Japan Unexamined Patent Application Publication No. 2007-68847, a glottis closing section ratio may be calculated in the following manner. A glottis closing section is set to a section where an amplitude of a waveform, which is generated by extracting a band of the fourth formants from a voice waveform, is lower than a predetermined amplitude. A glottis open section is set to a section where the amplitude of the waveform is higher than the predetermined amplitude. Then, a pair of one glottis opening section and one glottis closing section which are adjacent each other is regarded as one cycle.

It should also be noted that it has been described in the fourth embodiment that at Step S15 the periodic signal generation unit 17 generates signals of a sine wave having a frequency of 80 Hz, but the present invention is not limited to the above. For example, the frequency may be any frequency in a range of 40 Hz to 120 Hz depending on distribution of a fluctuation frequency of an amplitude envelope, and the periodic signal generation unit 17 may generate periodic signals not having a sine wave. It should also be noted that the amplitude fluctuation is performed using an all-pass filter in the same manner as described in the modification of the first embodiment.

(Fifth Embodiment)

Figure 30:
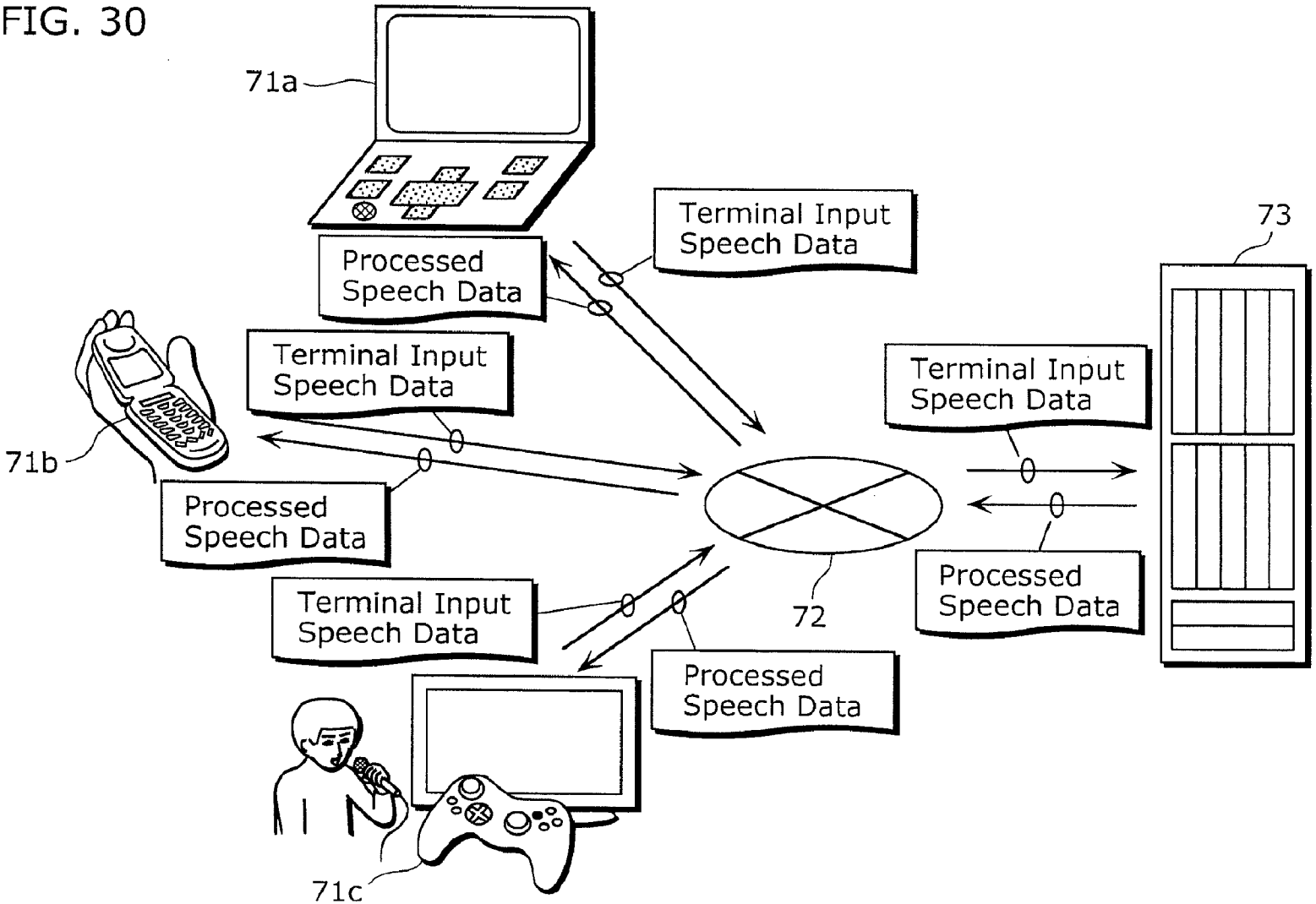
FIG. 30 is a diagram showing a configuration of a voice emphasizing system according to a fifth embodiment of the present invention.

FIG. 30 is a diagram showing a configuration of a voice emphasizing system according to a fifth embodiment of the present invention. The voice emphasizing system provides services, for example, for voice of incoming alert (incoming alert music, incoming alert voice) used in a mobile telephone 71*b*, voice of voice mail used in a portable personal computer 71*a*, voice of game characters or avatars used in a network game device 71*c*, and the like. The voice emphasizing system according to the fifth embodiment includes terminals such as the portable personal computer 71*a*, the mobile telephone 71*b*, and the network game device 71*c*, and a speech processing server 37. Each of the terminals transmits received speech data to the speech processing server 73. The speech processing server 73 receives the speech data, then emphasizes a portion of a strained rough voice in the speech data, and returns the resulting speech data to the terminal from which the speech data has been transmitted.

Figure 31:
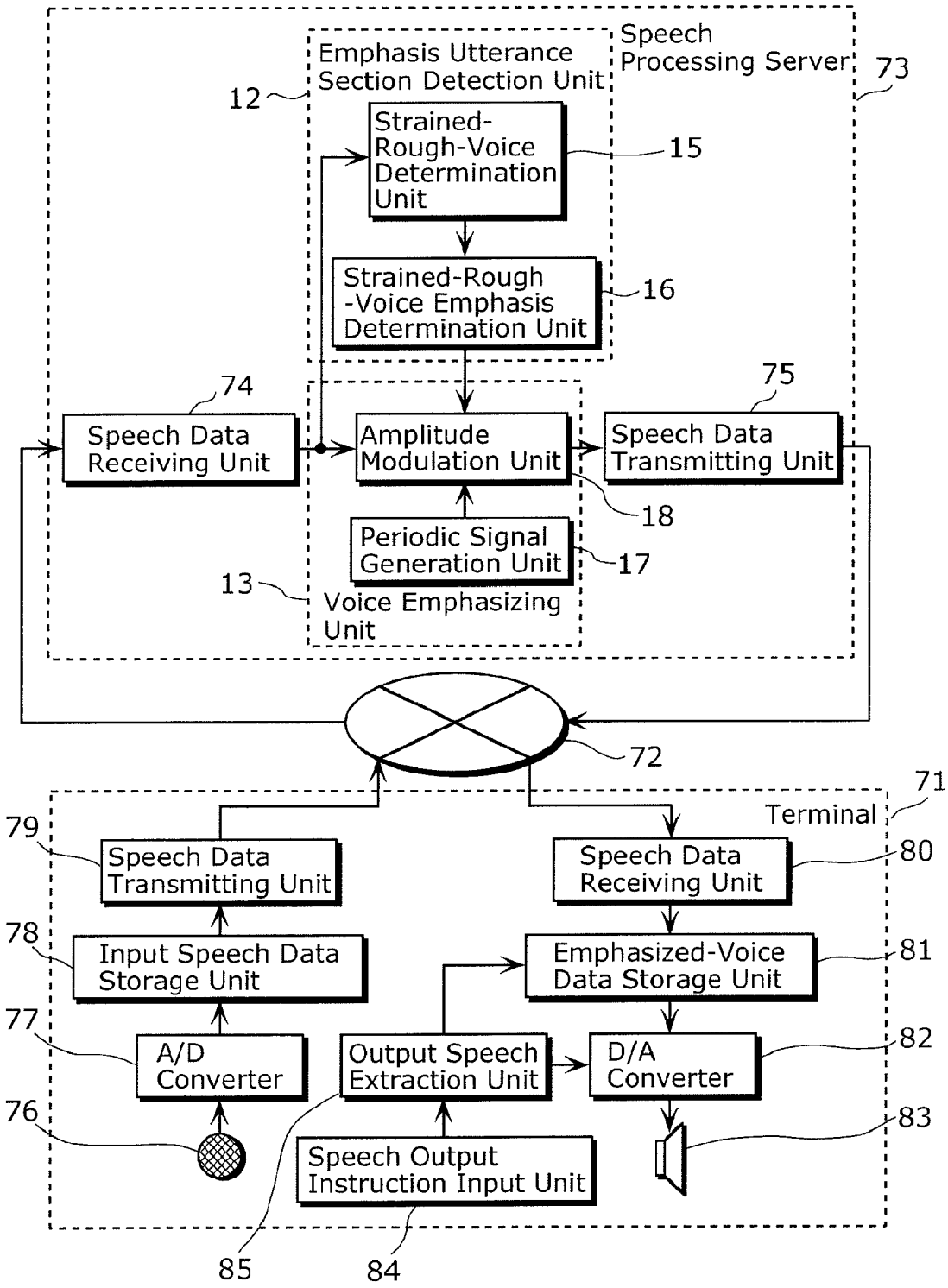
FIG. 31 is a functional block diagram showing a configuration of the voice emphasizing system according to the fifth embodiment of the present invention.
Figure 32:
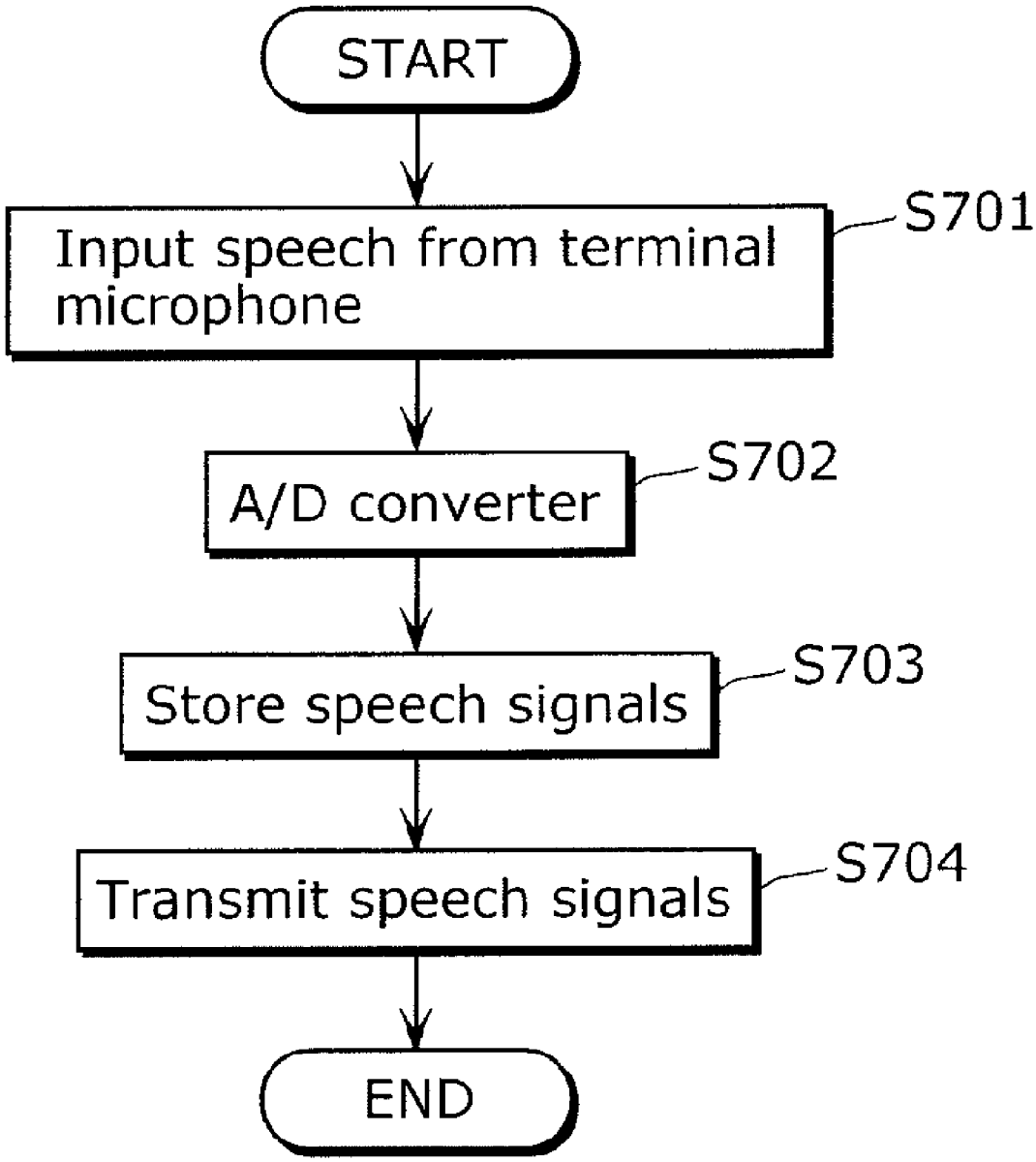
FIG. 32 is a flowchart of processing performed by a terminal 71 for obtaining and transmitting speech signals according to the fifth embodiment of the present invention.
Figure 33:
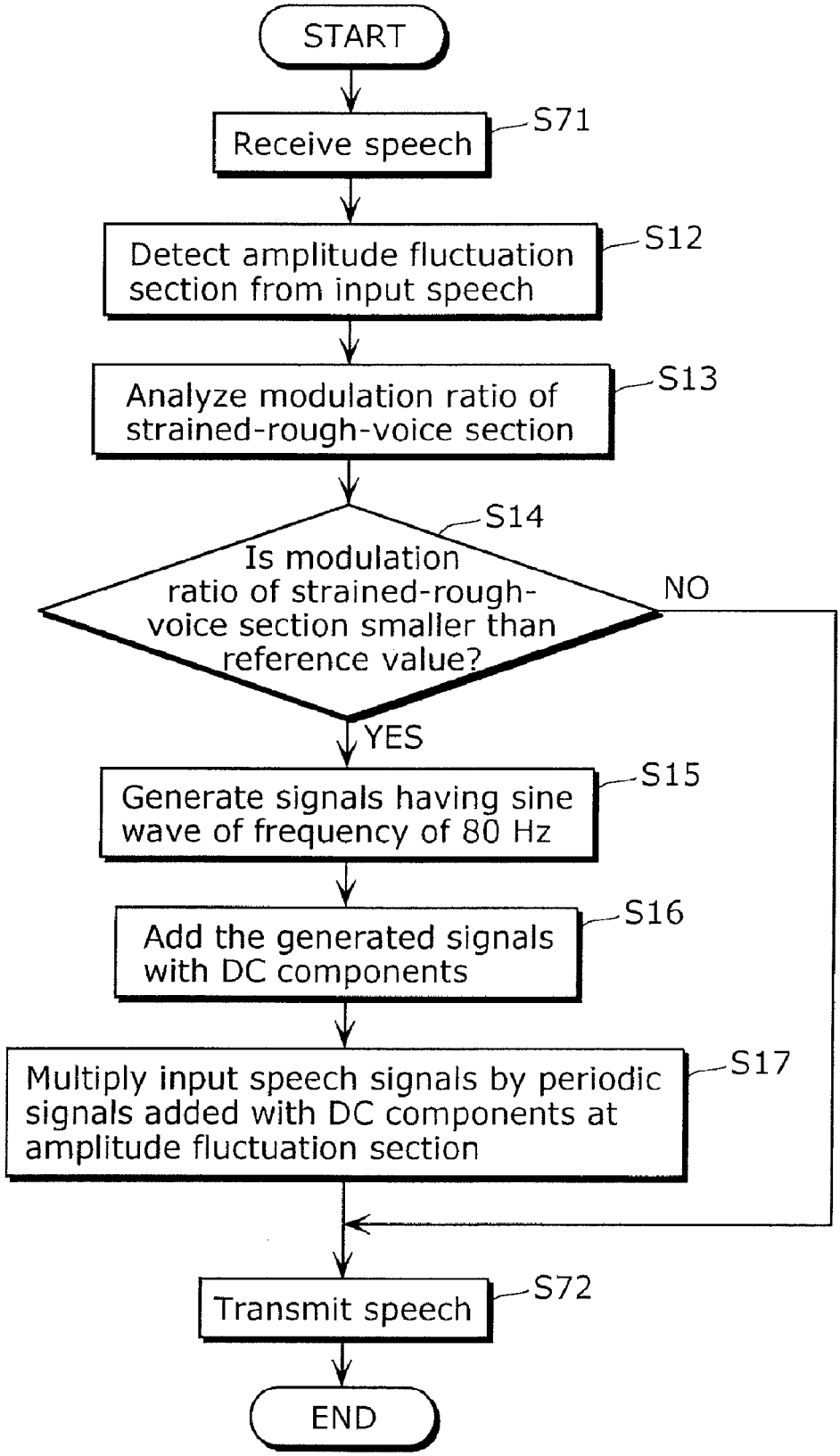
FIG. 33 is a flowchart of processing performed by a speech processing server 73 according to the fifth embodiment of the present invention.

FIG. 31 is a functional block diagram showing a configuration of the voice emphasizing system according to the fifth embodiment. FIG. 32 is a flowchart of processing performed by the terminal 71 in the voice emphasizing system according to the fifth embodiment. FIG. 33 is a flowchart of processing performed by the speech processing server 73 in the voice emphasizing system according to the fifth embodiment.

As shown in FIG. 31, in the voice emphasizing system according to the fifth embodiment, a microphone in the terminal receives a speech, then the terminal transmits the received speech to the server via a network, then the server emphasizes a strained rough voice in the received speech and returns the resulting speech to the terminal, and eventually the terminal outputs the received speech. The voice emphasizing system includes a terminal 71, a network 72, and the speech processing server 73.

As shown in FIG. 30, the terminal 71 represents the portable personal computer 71*a*, the mobile telephone 71*b*, the network game device 71*c*, or the like. It should be noted that the terminal 71 may be a portable information terminal.

As shown in FIG. 31, the terminal 71 includes a microphone 76, an analog-to-digital (A/D) converter 77, an input speech data storage unit 78, a speech data transmitting unit 79, a speech data receiving unit 80, an emphasized-voice data storage unit 81, a digital-to-analog (D/A) converter 82, an electroacoustic converter 83, a speech output instruction input unit 84, and an output speech extraction unit 85.

The A/D converter 77 is a processing unit that converts analog signals of a speech (input speech data) received by the microphone 76 to digital signals. The input speech data storage unit 78 is a storage unit in which the digital signals of the input speech data generated by the A/D converter 77 are stored. The speech data transmitting unit 79 is a processing unit that transmits (i) the digital signals of the input speech data and (ii) an identifier of the terminal 71 (hereinafter, referred to as an "terminal identifier") to the speech processing server 73 via the network 72.

The speech data receiving unit 80 is a processing unit that receives, from the speech processing server 73 via the network 72, speech data generated by performing emphasis processing on the digital signals of the input speech data to emphasize strained rough voices. The emphasized-voice data storage unit 81 is a storage unit in which the speech data that is applied with the emphasis processing and that is received by the speech data receiving unit 80 is stored. The D/A converter 82 is a processing unit that converts the digital signals of the speech data received by the speech data receiving unit 80 to analog electrical signals. The electroacoustic converter 83 is a processing unit that converts the analog electrical signals to acoustic signals. An example of the electroacoustic converter 83 is a loudspeaker.

The speech output instruction input unit 84 is an input processing device by which a user instructs to output an speech. An example of the speech output instruction input unit 84 is a touch panel displaying buttons, switches, or a list of selection items. The output speech extraction unit 85 is a processing unit that extracts the speech data applied with emphasis processing from the emphasized-voice data storage unit 81 and then provides the extracted speech data to the D/A converter 82, according to the instruction of the user (speech output instruction) provided from the speech output instruction input unit 84.

On the other hand, as shown in FIG. 31, the speech processing server 73 includes a speech data receiving unit 74, a speech data transmitting unit 75, the emphasis utterance section detection unit 12, and the voice emphasizing unit 13.

The speech data receiving unit 74 is a processing unit that receives the input speech data from the speech data transmitting unit 79 of the terminal 71. The speech data transmitting unit 75 is a processing unit that transmits speech data applied with emphasis processing to emphasize strained-rough-voices, to the speech data receiving unit 80 of the terminal 71.

The emphasis utterance section detection unit 12 includes the strained-rough-voice determination unit 15 and the strained-rough-voice emphasis determination unit 16. The voice emphasizing unit 13 includes the amplitude modulation unit 18 and the periodic signal generation unit 17. The emphasis utterance section detection unit 12 and the voice emphasizing unit 13 are identical to the emphasis utterance section detection unit 12 and the voice emphasizing unit 13 in FIG. 12, so that so that the description of these units are not given again below.

Figure 34:
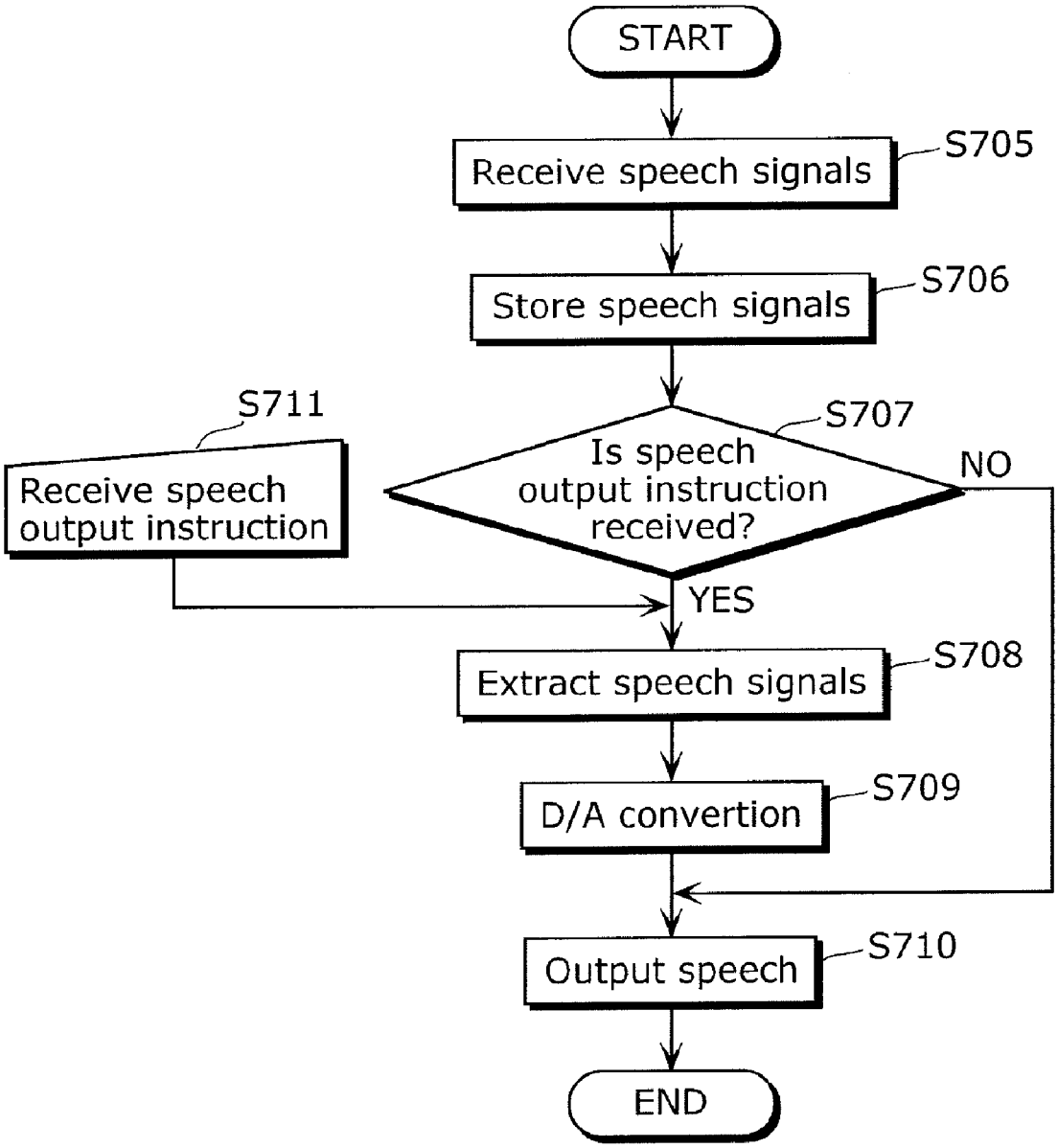
FIG. 34 is a flowchart of processing performed by the terminal 71 for receiving and transmitting speech signals according to the fifth embodiment of the present invention.

Next, the processing performed by the terminal 71 in the voice emphasizing system having the above-described structure is described with reference to a flowchart of FIG. 34, and the processing performed by the speech processing server 73 in the voice emphasizing system is described with reference to a flowchart of FIG. 33. Here, the same reference numerals of FIG. 12 of the processing performed by the voice emphasizing device according to the first embodiment are assigned to the identical steps of the flowchart of FIG. 33. The identical steps are not explained again below.

Firstly, the processing of obtaining and transmitting speech signals by the terminal 71 is described with reference to FIG. 32.

The microphone 76 obtains a speech as analog electrical signals when a user produces and inputs the speech (Step S701). The A/D converter 77 samples the analog electrical signals provided from the microphone 76 at a predetermined sampling frequency to convert the analog electrical signals to digital signals (Step S702). The sampling frequency is 22050 Hz, for example. It should be noted that the sampling frequency is not limited as far as the sampling frequency is adequate to reproduce the speech accurately and process the signals accurately. The A/D converter 77 stores the digital signals generated at Step S702 to the input speech data storage unit 78 (Step S703). The speech data transmitting unit 79 transmits (i) the speech signals as the digital signals generated at Step S702 and (ii) a terminal identifier of the terminal 71 or a terminal identifier of another terminal to which a speech generated from the speech signals is to be eventually transmitted, to the speech processing server 73 via the network 72 (Step S704).

Next, the processing performed by the speech processing server 73 is described with reference to FIG. 33.

The speech data receiving unit 74 receives the terminal identifier and the speech signals from the terminal 71 via the network 72 (Step S71). The speech signals received by the speech data receiving unit 74, namely a speech waveform of the input speech, are provided to the strained-rough-voice determination unit 15 in the emphasis utterance section detection unit 12. The strained-rough-voice determination unit 15 detects a section having amplitude fluctuation from the speech waveform (Step S12). Next, the strained-rough-voice emphasis determination unit 16 analyzes a modulation ratio of the amplitude fluctuation of the detected section (strained-rough-voice section) (Step S13). The modulation ratio determination unit 25 determines whether or not the modulation ratio analyzed at Step S13 is equal to or smaller than a predetermined reference value (Step S14). If the determination is made that the modulation ratio is equal to or greater than the reference value (No at Step S14), the modulation ratio determination unit 25 determines that the modulation ratio of the strained-rough-voice section is enough to be perceived as a "strained rough voice", then does not regard the section as a strained-rough-voice target section, and provides information of the strained-rough-voice section (section information) to the amplitude modulation unit 18. The amplitude modulation unit 18 does not perform amplitude modulation on a voice waveform of the strained-rough-voice section, and provides the voice waveform to the speech data transmitting unit 75. The speech data transmitting unit 75 transmits the speech waveform provided from the amplitude modulation unit 18, to a terminal corresponding to the terminal identifier received at Step S71 via the network 72.

On the other hand, if the determination is made that the modulation ratio is smaller than the reference value (Yes at Step S14), then the periodic signal generation unit 17 generates signals of a sine wave having a frequency of 80 Hz (Step S15), and then adds the generated signals with DC components to generate signals (Step 516). For the determined strained-rough-voice target section in the input speech waveform, the amplitude modulation unit 18 performs amplitude modulation by multiplying voice signals by the periodic signals generated by the periodic signal generation unit 17 to vibrate with a frequency of 80 Hz. Thereby, the amplitude modulation unit 18 converts a voice of the strained-rough-voice target section to a "strained rough voice" including the periodic fluctuation of amplitude (Step S17). The amplitude modulation unit 18 provides a resulting speech waveform including the converted voice waveform to the speech data transmitting unit 75. The speech data transmitting unit 75 transmits the resulting speech waveform provided from the amplitude modulation unit 18, to a terminal corresponding to the terminal identifier received at Step S71 via the network 72 (Step S72).

Next, the processing performed by the terminal 71 for receiving and outputting speech signals is described with reference to FIG. 34.

The speech data receiving unit 80 receives a speech waveform from the speech processing server 73 via the network (Step S705). The speech data receiving unit 80 stores the received speech waveform to the emphasized-voice data storage unit 81 (Step S706). If a speech output instruction is received from application software or the like when the speech waveform is received (YES at Step S707), then the output speech extraction unit 85 extracts a target speech waveform from pieces of speech data stored in the emphasized-voice data storage unit 81 and provides the extracted speech waveform to the D/A converter 82 (Step S708). The D/A converter 82 converts digital signals of the speech waveform to analog electrical signals, with the same frequency as the sampling frequency used at Step 5702 by the A/D converter 77 (Step S709). The analog electrical signals provided from the D/A converter 82 at Step 5709 are outputted as a speech via the electroacoustic converter 83 (Step S710). On the other hand, if a speech output instruction is not received (NO at Step S707), the processing is completed.

If the speech output instruction input unit 84 receives a speech output instruction from the user (Step S711), then the output speech extraction unit 85 extracts a target speech waveform from pieces of voice data stored in the emphasized-voice data storage unit 81 according to the speech output instruction provided to the speech output instruction input unit 84, and provides the extracted speech waveform to the D/A converter 82 (Step S708). The D/A converter 82 converts the digital signals to analog electrical signals (Step S709). The analog electrical signals are outputted as a speech via the electroacoustic converter 83 (Step S710).

With the above structure, in the voice emphasizing system according to the fifth embodiment, the terminal 71 obtains a speech from a user or speaker and transmits the obtained speech to the speech processing server 73. The speech processing server 73 detects sections having amplitude fluctuation from the speech, then compensates for portions of the original amplitude fluctuation having modulation ratios inadequate to express a voice, and transmits the resulting speech to the terminal. The receiving terminal can use the speech applied with the emphasis processing. Thereby, the voice emphasizing system according to the fifth embodiment can emphasize a "strained rough voice" uttered with emphasis or forcefully or music expression of "unari (growling or groaning voice)", in order to adequately convey the expression of the voice to listeners. As a result, expressiveness of the input speech can be enhanced. In addition, the voice emphasizing system according to the fifth embodiment can generate a speech having more naturalness and higher expressiveness, by using original amplitude fluctuation having an enough modulation ratio of the input speech. As a voice for incoming voice, voice mail, or an avatar, the voice emphasizing system according to the fifth embodiment can provide a general speaker or user without special training with a speech having too high expressiveness for the speaker or user to produce. The speech can be provided not only to the user of the original speech, but also to a different user by transmitting the speech to a terminal of the different user, so that the user can send a message with richer expression to the different user. Furthermore, in the voice emphasizing system according to the fifth embodiment, the terminal does not need to perform processing requiring a large amount of calculation, such as speech analysis and signal processing. Therefore, even a terminal with low calculation ability can use a speech having high expressiveness.

It should be noted that it has been described in the fifth embodiment that in the terminal 71 the sampling frequency used by the A/D converter 77 is the same as the sampling frequency used by the D/A converter 82 and that the sampling frequency for input speech signals is fixed in the speech processing server 73. However, if a sampling frequency differs depending on terminals, a terminal may transmits a sampling frequency as well as speech signals to the speech processing server 73. Thereby, the speech processing server 73 processes received speech signals using the received sampling frequency. Or, the speech processing server 73 performs re-sampling to convert the sampling frequency to a sampling frequency for signal processing. Moreover, when a terminal transmitting a speech that has not yet been applied with emphasis processing is different from a terminal receiving a speech applied with the emphasis processing, or when a sampling frequency of speech signals provided from the speech processing server 73 is different from a sampling frequency of a receiving terminal, the speech processing server 73 transmits the sampling frequency as well as a speech waveform applied with emphasis processing to the terminal, and the D/A converter 82 generates analog electrical signals based on the received sampling frequency.

It should also be noted that it has been described in the fifth embodiment that the terminal 71 transmits sampled waveform data to the speech processing server 73 without performing other processing, but it is of course possible to transmit via the network 72 data that is compressed by a waveform compression coding device according to a MPEG Audio Layer-3 (MP3) or a Code-Excited Linear Prediction (CELP). Likewise, the speech processing server 73 may transmit compressed data of the speech data to the terminal 71.

It should also be noted that it has been described in the fifth embodiment that the input speech data storage unit 78 and the emphasized-voice data storage unit 81 are separate independent units, but both input speech data and emphasized-voice data may be stored in a single storage unit. In this case, information specifying the input speech data and the emphasized-voice data is stored in association with the speech signals. It should also be noted that it has been described in the fifth embodiment that in the input speech data storage unit 78 and the emphasized-voice data storage unit 81, digital signals are stored, but it is also possible to store, (i) input speech signals as analog electrical signals that have been received by the microphone 76 and have not yet been converted by the A/D converter 77 to digital signals and (ii) emphasized-voice signals as analog electrical signals that have already been converted by the D/A converter 82 from digital signals. In this case, the analog electrical signals are recorded in an analog medium such as a tape or a gramophone record.

It should also be noted that it has been described in the fifth embodiment that the terminal 71 performs A/D conversion and D/A conversion to transmit or receive digital signals via the network 72, but the A/D conversion and the D/A conversion may be performed by the speech processing server 73. In this case, the network is implemented as analog lines having switching equipments.

It should also be noted that it has been described in the fifth embodiment that the voice emphasizing unit 13 in the speech processing server 73 performs amplitude modulation by multiplying signals of a voice waveform by periodic signals using the periodic signal generation unit 17 and the amplitude modulation unit 18 in the same manner as described in the first embodiment, but the present invention is not limited to the above. For example, an all-pass filter may be used in the same manner as described in the modification of the first embodiment. Or, amplitude modulation may be emphasized by extending a dynamic range of amplitude fluctuation of an original waveform in the same manner as described in the second embodiment. Here, analog lines may be used to extend the dynamic range in the same manner as described in the second embodiment.

Thus, the present invention has been described with reference to the first to fifth embodiments, but the present invention is not limited to them.

For example, it has been described in the third and fourth embodiments that a strained-rough-voice target section is detected using a holding pressure measured by the pressure sensor 43 and a glottis closing section ratio calculated from an EGG waveform generated by the EGG sensor 51, respectively. However, the method of determining a strained-rough-voice target section is limited to the above. For instance, a sensor, such as a gyroscope, capable of measuring an acceleration or a movement is embedded in a handheld microphone or provided at a top of a handheld microphone. If a speed of a movement of a speaker or singer or a distance of the movement is equal to or greater than a predetermined value, a section of a speech corresponding to the movement may be determined as a strained-rough-voice target section.

Figure 35:
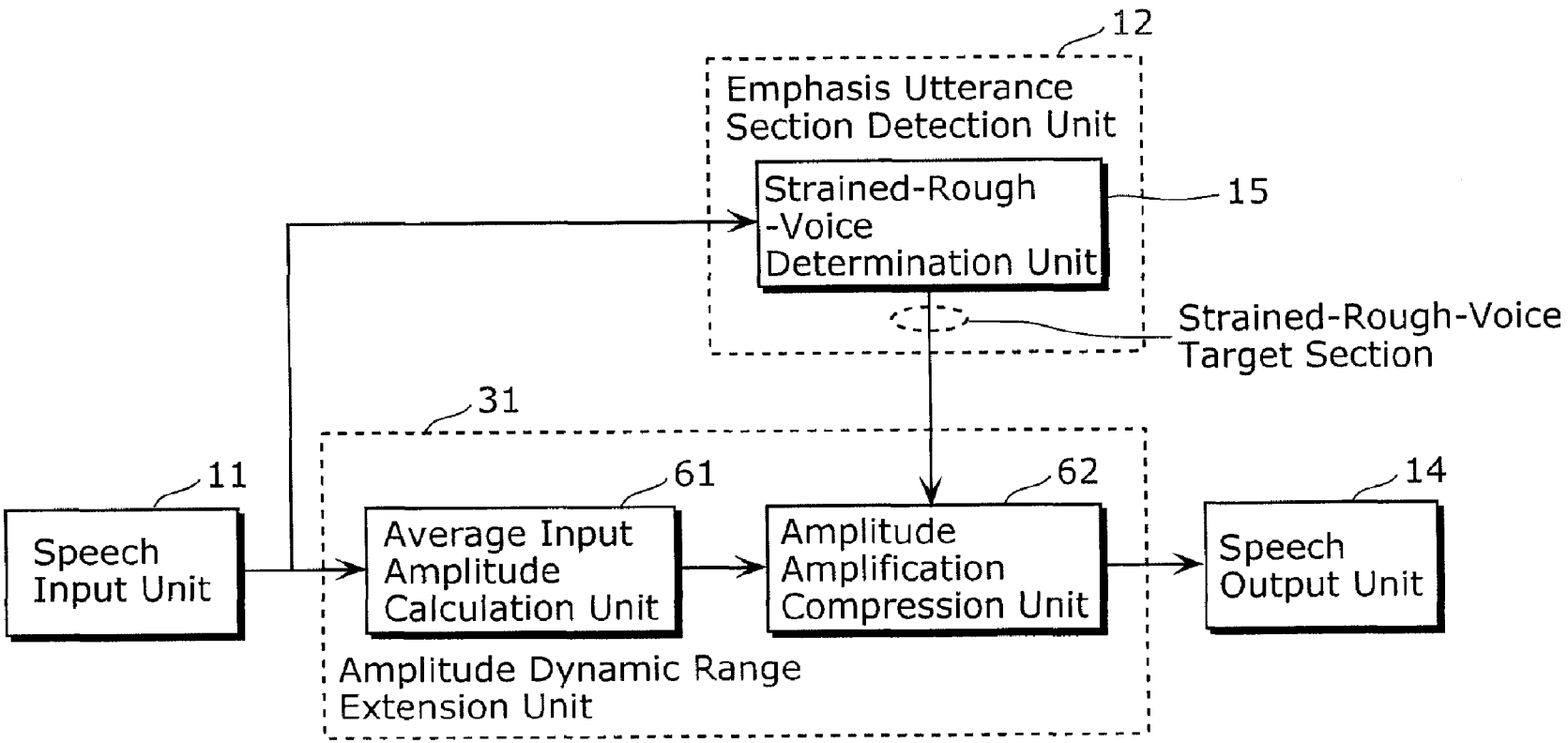
FIG. 35 is a functional block diagram of a structure of a voice emphasizing device according to a modification of the second embodiment of the present invention.

It should also be noted that it has described in the first and second embodiments that a modulation ratio of amplitude fluctuation is analyzed for sections in an input speech and emphasis processing is performed on a section having inadequate modulation ratio. However, the emphasis processing can be performed on all sections having amplitude fluctuation, regardless of their modulation ratios. Thereby, the processing of analyzing a modulation ratio is not necessary, thereby preventing delay due to polynomial approximation and the like. In addition, a delay time can be reduced. Therefore, the above case is advantageous in the situation where the present invention is used in a system requiring real-time processing, such as a Karaoke or a loudspeaker. Here, the amplitude dynamic range extension unit 31 in the second embodiment includes an average input amplitude calculation unit 61 and an amplitude amplification compression unit 62 as shown in FIG. 35. The average input amplitude calculation unit 61 calculates an average of amplitude of input voice at least for a duration equivalent to one fluctuation cycle of an amplitude envelope of a strained rough voice. For example, an average value of amplitude of input voice is calculated for a duration of one fortieth seconds, namely 25 ms, assuming that amplitude envelope fluctuation has a frequency of 40 Hz or more. The amplitude amplification compression unit 62 sets the average value calculated by the average input amplitude calculation unit 61 as the boundary input level of FIG. 20. The amplitude amplification compression unit 62 amplifies an input greater than the average value, namely a portion having a large amplitude in a fluctuation cycle of an amplitude envelope, in order to increase the amplitude. On the other hand, the amplitude amplification compression unit 62 compresses an input smaller than the average value, namely a portion having a small amplitude in the fluctuation cycle of the amplitude envelope, in order to reduce the amplitude. Thereby, the amplitude fluctuation of the input voice can be emphasized. A duration for the amplitude average value calculation is not limited to 25 ms, but may be shortened up to 8.3 ms equivalent to a frequency of the amplitude envelope fluctuation of 120 Hz. The above technique is used by some guitar amplifiers to distort sound. With the above structure, simple processing with less delay can emphasize amplitude fluctuation of an input voice. In addition, rich vocal expression such as a "strained rough voice" or "unari (growling or groaning voice)" can be provided to the input speech, while keeping original features of the input speech.

It should also be noted that it has described in the third and fourth embodiments that periodic amplitude fluctuation is provided to a voice in order to provide expression of a "strained rough voice" or "unari (growling or groaning voice)" to the voice in the same manner as described in the first embodiment. However, it is also possible to provide expression of a "strained rough voice" or "unari (growling or groaning voice)" to a voice by extending an amplitude dynamic range of the voice in the same manner as described in the second embodiment. Here, when an amplitude dynamic range of an input voice is extended, it is necessary to determine whether or not the voice has amplitude fluctuation within a fluctuation frequency range enough to produce a "strained rough voice" or "unari (growling or groaning voice)" as Step S12 as described in the first or second embodiment.

It should also be noted that it has described in the first, third, and fourth embodiments that the periodic signal generation unit 17 generates periodic signals with a frequency of 80 Hz. However, the periodic signal generation unit 17 may generate signals having random periodic fluctuation in a range of a frequency of 40 Hz to 120 Hz in which the fluctuation can be perceived as a "strained rough voice". The random fluctuation of modulation frequency produces more natural amplitude fluctuation, thereby generating a natural voice.

It should also be noted that a state where a speaker or singer utters forcefully is detected to determine a strained-rough-voice target section, using amplitude fluctuation of a voice waveform of the section in the first and second embodiments, using a holding pressure of a handheld microphone in the third embodiment, or using a glottis closing section ratio calculated from an EGG waveform in the fourth embodiment. However, a strained-rough-voice target section may be determined using combinations of these pieces of information.

It should also be noted that each of the above-described voice emphasizing devices may be implemented as a computer system having a microprocessor, a Read Only Memory (ROM), a Random Access Memory (RAM), a hard disk drive, a display unit, a keyboard, a mouth, and the like. In the RAM or the hard disk drive, a computer program is recorded. When the microprocessor operates according to the computer program, the above-described voice emphasizing device performs its functions. Here, the computer program has combinations of instruction codes each indicating an instruction to the computer system in order to perform a predetermined function.

It should also be noted that a part or all of the elements include in each of the above-described voice emphasizing devices may be implemented into a single chip of a Large Scale Integration (LSI). The system LSI is a super multi-function LSI manufactured by integrating a plurality of elements into a single chip. An example of the system LSI is a computer system including a microprocessor, a ROM, a RAM, and the like. In the RAM, a computer program is recorded. When the microprocessor operates according to the computer program, the system LSI performs its functions.

It should also be noted that a part or all of the elements included in each of the above-described voice emphasizing devices may be implemented into an integrated circuit (IC) card or a single module which is removable from the corresponding voice emphasizing device. The IC card or module is a computer system including a microprocessor, a ROM, a RAM, and the like. The IC card or module may include the above-described super multi-function LSI. When the microprocessor operates according to a computer program, the IC card or module performs its functions. The IC card or module may have tamper resistance.

It should also be noted that the present invention may be one of the above-described methods. Or, the present invention may be a computer program causing a computer to execute the above method, or digital signals implementing the computer program.

The present invention may be a computer-readable recording medium on which the above-mentioned computer program or digital signals are recorded. Examples of the computer-readable recording medium are a flexible disk, a hard disk, a Compact Disc—Read Only Memory (CD-ROM), a Magnetooptic Disc (MO), a Digital Versatile Disc (DVD), a DVD-ROM, a DVD-RAM, a Blu-ray Disc™ (BD), and a semiconductor memory. Or, the present invention may be the digital signals recorded on such a recording medium.

The present invention as the above-mentioned computer program or digital signals may be transmitted via telecommunications line, wireless or cable communications line, a network represented by the Internet, data broadcasting, or the like.

It is also possible that the present invention is a computer system including a microprocessor and a memory, the memory stores the above-described computer program, and the microprocessor operates according to the computer program.

Furthermore, the above-mentioned program or digital signals may be transported being recorded on the above-mentioned recording medium or via the above-mentioned network or the like, in order to be executed by a different independent computer system.

The above-described embodiments and modification may be combined.

The above-described embodiments and modification are merely examples of the present invention and do not limit the present invention. The scope of the present invention is defined not by the above description but by the aspects claimed later, and many modifications are possible without materially departing from the teachings and advantages of the aspects of the present invention.

Industrial Applicability

The voice emphasizing device according to the present invention can detect, from a speech or singing voice, a portion where a speaker or singer speaks or sings forcefully, specifies the portion where the speaker or singer intends to express strong vocal expression, converts a voice waveform of the portion, and eventually provides expression of a "strained rough voice" or "unari (growling or groaning voice)" to a voice of the portion. Therefore, the present invention can be used in a Karaoke machine, a loudspeaker, or the like which has a function of emphasizing a strained rough voice. Furthermore, the present invention can be used in a game device, a communication device, a mobile telephone, and the like. In more detail, the present invention can customize voice of characters in a game device or a communication device, voice of avatars, voice of voice mail, incoming alert music or incoming alert voice in a mobile telephone, voice of narration in creating a movie content in a home video or the like.

The invention claimed is:

1. A voice emphasizing device comprising:

a processor;

an emphasis utterance section detection unit configured to detect an emphasis section from an input speech waveform, the emphasis section being a time duration having a waveform intended by a speaker of the input speech waveform to be converted; and a voice emphasizing unit configured to increase fluctuation of an amplitude envelope of the waveform in the emphasis section detected by said emphasis utterance section detection unit from the input speech waveform, wherein said emphasis utterance section detection unit is configured to (i) detect a state from the input speech waveform as a state where a vocal cord of the speaker is strained, and (ii) determine a time duration of the detected state as the emphasis section, the state having a frequency of the fluctuation of the amplitude envelope of the waveform within a predetermined range from 10 Hz to lower than 170 Hz, wherein said voice emphasizing unit is configured to modulate the waveform to periodically fluctuate the amplitude envelope, using signals having a frequency in a range of 40 Hz to 120 Hz.

2. The voice emphasizing device according to claim 1, wherein said voice emphasizing unit is configured to fluctuate the frequency of the signals to range from 40 Hz to 120 Hz.

3. The voice emphasizing device according to claim 1, wherein said voice emphasizing unit is configured to modulate the waveform to periodically fluctuate the amplitude envelope, by multiplying the waveform by periodic signals.

4. The voice emphasizing device according to claim 1, wherein said voice emphasizing unit includes:

an all-pass filter configured to shift a phase of the waveform; and an addition unit configured to add (i) the waveform provided to said all-pass filter with (ii) a waveform with the phase shifted by said all-pass filter.

5. The voice emphasizing device according to claim 1, wherein said voice emphasizing unit is configured to extend a dynamic range of an amplitude of the waveform.

6. The voice emphasizing device according to claim 5, wherein said voice emphasizing unit is configured to (i) compress the amplitude of the waveform when a value of the amplitude envelope of the waveform is equal to or smaller than a predetermined value, and (ii) amplify the amplitude of the waveform when the value is greater than the predetermined value.

7. The voice emphasizing device according to claim 1, wherein said emphasis utterance section detection unit is configured to detect the emphasis section based on a time duration where a glottis of the speaker is closed.

8. A voice emphasizing device comprising:

a processor;

an emphasis utterance section detection unit configured to detect an emphasis section from an input speech waveform, the emphasis section being a time duration having a waveform intended by a speaker of the input speech waveform to be converted; and a voice emphasizing unit configured to increase fluctuation of an amplitude envelope of the waveform in the emphasis section detected by said emphasis utterance section detection unit from the input speech waveform, wherein said emphasis utterance section detection unit is configured to (i) detect a state from the input speech waveform as a state where a vocal cord of the speaker is strained, and (ii) determine a time duration of the detected state as the emphasis section, the state having a frequency of the fluctuation of the amplitude envelope of the waveform within a predetermined range from 10 Hz to lower than 170 Hz, and wherein said emphasis utterance section detection unit is configured to detect, as the emphasis section, a time duration in which the frequency of the fluctuation is within a predetermined range from 10 Hz to lower than 170 Hz and an amplitude modulation ratio indicting a ratio of the fluctuation is smaller than 0.04.

9. A voice emphasizing method comprising:

detecting an emphasis section from an input speech waveform, the emphasis section being a time duration having a waveform intended by a speaker of the input speech waveform to be converted; and increasing fluctuation of an amplitude envelope of the waveform in the emphasis section detected in said detecting from the input speech waveform, wherein said detecting includes (i) detecting a state from the input speech waveform as a state where a vocal cord of the speaker is strained, and (ii) determining a time duration of the detected state as the emphasis section, the state having a frequency of the fluctuation of the amplitude envelope of the waveform within a predetermined range from 10 Hz to lower than 170 Hz, wherein said increasing fluctuation of the amplitude envelope of the waveform comprises modulating the waveform to periodically fluctuate the amplitude envelope, using signals having a frequency in a range of 40 Hz to 120 Hz.

10. A non-transitory computer-readable recording medium storing a program to cause a computer to execute a method comprising:

detecting an emphasis section from an input speech waveform, the emphasis section being a time duration having a waveform intended by a speaker of the input speech waveform to be converted; and increasing fluctuation of an amplitude envelope of the waveform in the emphasis section detected in said detecting from the input speech waveform, wherein said detecting includes (i) detecting a state from the input speech waveform as a state where a vocal cord of the speaker is strained, and (ii) determining a time duration of the detected state as the emphasis section, the state having a frequency of the fluctuation of the amplitude envelope of the waveform within a predetermined range from 10 Hz to lower than 170 Hz, wherein said increasing fluctuation of the amplitude envelope of the waveform comprises modulating the waveform to periodically fluctuate the amplitude envelope, using signals having a frequency in a range of 40 Hz to 120 Hz.

11. A voice emphasizing system comprising:

a voice emphasizing device generating an output speech waveform by performing predetermined conversion processing on a part of an input speech waveform; and a terminal reproducing the output speech waveform, wherein said terminal includes:

an input speech waveform transmitting unit configured to transmit the input speech waveform to said voice emphasizing device;

an output speech waveform receiving unit configured to receive the output speech waveform from said voice emphasizing device; and a reproduction unit configured to reproduce the output speech waveform received by said output speech waveform receiving unit, and said voice emphasizing unit includes:

an input speech waveform receiving unit configured to receive the input speech waveform from said terminal;

an emphasis utterance section detection unit configured to detect an emphasis section from the input speech waveform received by said input speech waveform receiving unit, the emphasis section being a time duration having a waveform intended by a speaker of the input speech waveform to be converted;

a voice emphasizing unit configured to generate the output speech waveform by increasing fluctuation of an amplitude envelope of the waveform in the emphasis section detected by said emphasis utterance section detection unit from the input speech waveform; and an output speech waveform transmitting unit configured to transmit the output speech waveform to said terminal, wherein said emphasis utterance section detection unit is configured to (i) detect, from the input speech waveform, a state where a vocal cord of the speaker is strained, and (ii) determine, as the emphasis section, a time duration of the detected state, the state having a frequency of the amplitude envelope of the waveform within a predetermined range from 10 Hz to lower than 170 Hz, and wherein said voice emphasizing unit is configured to modulate the waveform to periodically fluctuate the amplitude envelope, using signals having a frequency in a range of 40 Hz to 120 Hz.

* * * * *